US012495900B1

(12) United States Patent
Roth

(10) Patent No.: US 12,495,900 B1
(45) Date of Patent: Dec. 16, 2025

(54) MODULAR COLLECTION AND STORAGE SYSTEM AND METHOD

(71) Applicant: Yael Roth, San Diego, CA (US)

(72) Inventor: Yael Roth, San Diego, CA (US)

( * ) Notice: Subject to any disclaimer, the term of this patent is extended or adjusted under 35 U.S.C. 154(b) by 0 days.

(21) Appl. No.: 18/984,636

(22) Filed: Dec. 17, 2024

Related U.S. Application Data

(60) Provisional application No. 63/679,991, filed on Aug. 6, 2024.

(51) Int. Cl.
*A47B 87/00* (2006.01)
*A47B 81/00* (2006.01)

(52) U.S. Cl.
CPC ..... *A47B 87/005* (2013.01); *A47B 81/00* (2013.01)

(58) Field of Classification Search
CPC ..... A47B 87/005; A47B 81/00
USPC ..... 220/909
See application file for complete search history.

(56) References Cited

U.S. PATENT DOCUMENTS 1,281,587 A * 10/1918 Kovachevich ..... B65F 1/1426 232/1 R
1,552,290 A 9/1925 Folwer
2,646,891 A 7/1953 Morgan
3,784,024 A 1/1974 Kristy
D260,700 S 9/1981 Patrick et al.
4,717,020 A 1/1988 Viira
4,795,046 A * 1/1989 Rath ..... B65F 1/10 15/257.1
D301,415 S 6/1989 Fry et al.
D307,986 S 5/1990 Falk
5,039,180 A 8/1991 Lemons
5,044,644 A 9/1991 Duran et al.
5,090,785 A 2/1992 Stamp
5,417,338 A 5/1995 Roy et al.
5,676,274 A 10/1997 Green et al.
5,785,369 A 7/1998 Ridely, Sr. et al.
6,244,439 B1 6/2001 Dennis
6,685,529 B1 2/2004 Sarabia
7,037,165 B2 5/2006 Garr
7,878,337 B2 2/2011 Abdullah
8,522,993 B2 * 9/2013 Flewelling ..... B65F 1/163 220/255
8,955,699 B2 2/2015 Wilder
10,265,637 B2 4/2019 Bernbaum et al.
(Continued)

FOREIGN PATENT DOCUMENTS

CH 394938 A 6/1965
CN 210149895 U 3/2020
(Continued)

*Primary Examiner* — Stephen J Castellano
(74) *Attorney, Agent, or Firm* — Dicke, Billig & Czaja, PLLC

(57) ABSTRACT

A modular collection and storage system comprising a plurality of removable, reconfigurable, or permanently affixed bins; and a versatile collection interface operable in a collection configuration to collect items to be stored in the bins and a deposit configuration to deposit the collected items into the bins. The system is adaptable for a wide range of applications, including residential, commercial, industrial, agricultural, and educational environments, and may incorporate additional features such as sorting mechanisms, configurable partitions, and ergonomic or automated functionalities to enhance usability and efficiency.

2 Claims, 60 Drawing Sheets

(56) References Cited

U.S. PATENT DOCUMENTS

| | | | | |
|---|---|---|---|---|
| D1,027,514 | S | 5/2024 | Lo | |
| 2001/0045371 | A1* | 11/2001 | Ordonez | B65F 1/02 206/499 |
| 2003/0214141 | A1* | 11/2003 | Morris | B65F 1/1646 294/176 |
| 2004/0089657 | A1 | 5/2004 | Waszak | |
| 2005/0164594 | A1 | 7/2005 | Garr | |
| 2009/0139880 | A1* | 6/2009 | Abdullah | A45C 11/36 206/214 |
| 2012/0201644 | A1 | 8/2012 | Wilder | |
| 2012/0234989 | A1 | 9/2012 | Perlman | |
| 2018/0009559 | A1 | 1/2018 | Richison | |
| 2021/0015271 | A1 | 1/2021 | Lyons | |
| 2022/0168893 | A1 | 6/2022 | Hamilton et al. | |

FOREIGN PATENT DOCUMENTS

| | | | |
|---|---|---|---|
| CN | 111806924 | A | 10/2020 |
| CN | 112896748 | A | 6/2021 |
| CN | 114506537 | A | 5/2022 |
| DE | 9000878 | U1 | 7/1990 |
| GB | 317196 | A | 8/1929 |
| KR | 10-2018-0012155 | A | 2/2018 |
| KR | 10-1897252 | B1 | 10/2018 |
| KR | 10-2671476 | B1 | 6/2024 |

* cited by examiner

52
Cars
Blocks
Legos
68
18
36
50
42
48
40
46
44
38
88

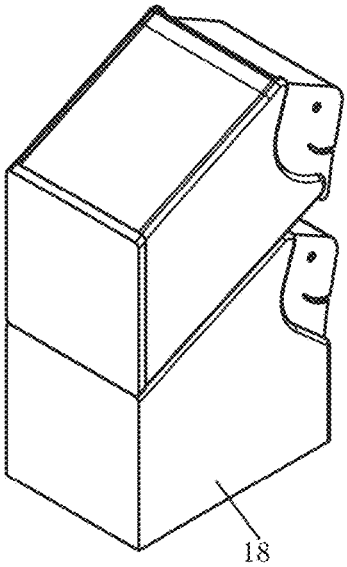
FIG. 5N
FIG. 5O
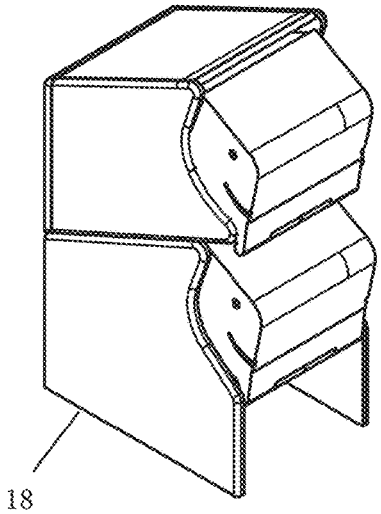
FIG. 5P
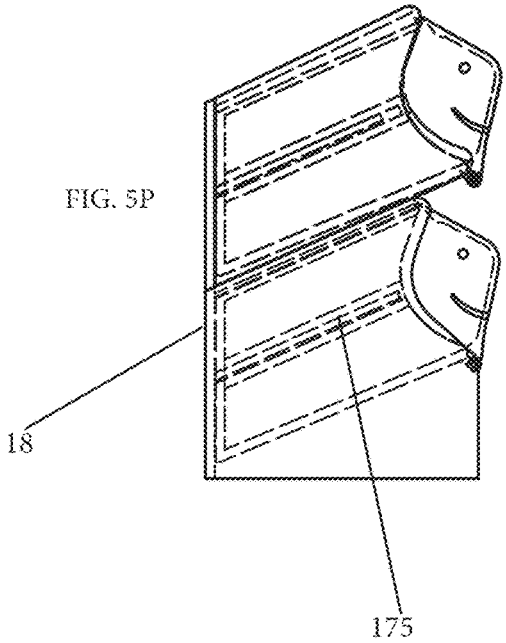

FIG. 5S
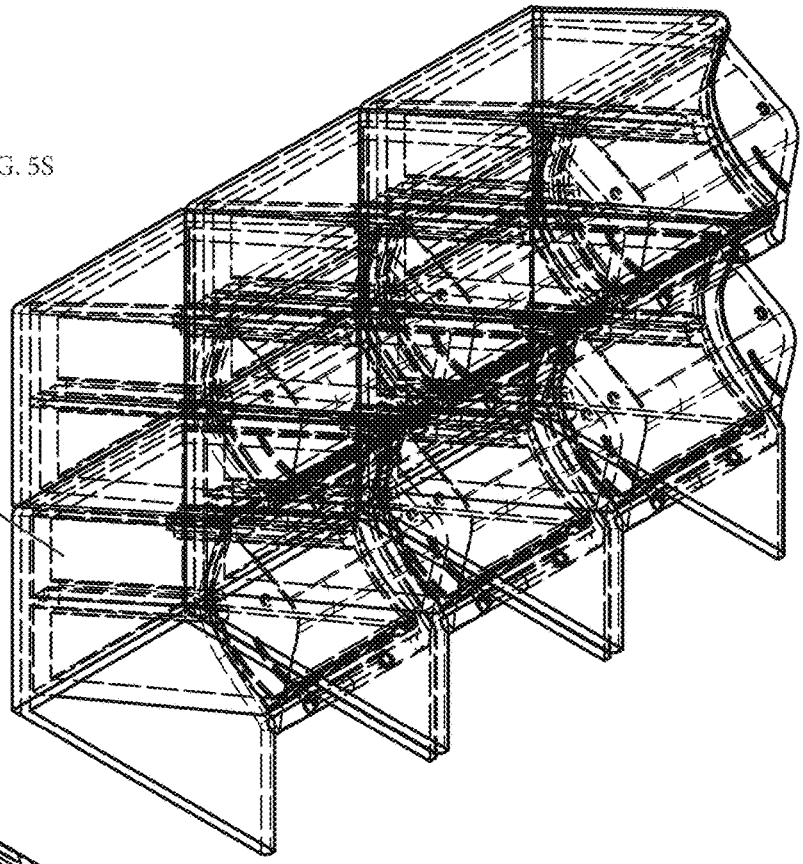
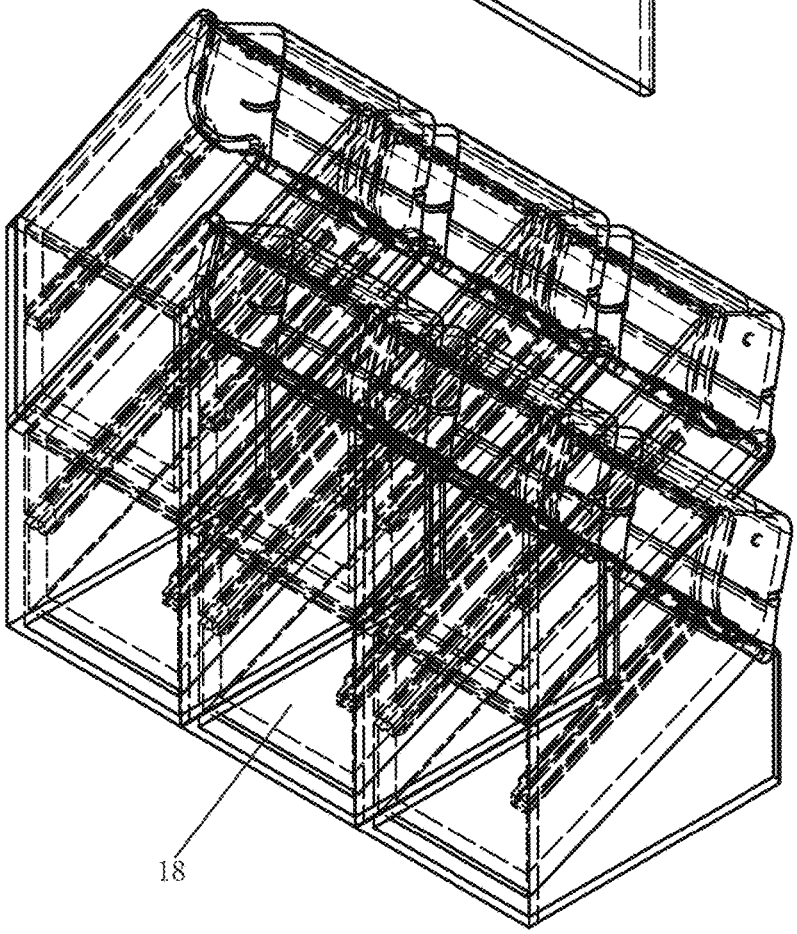
FIG. 5T

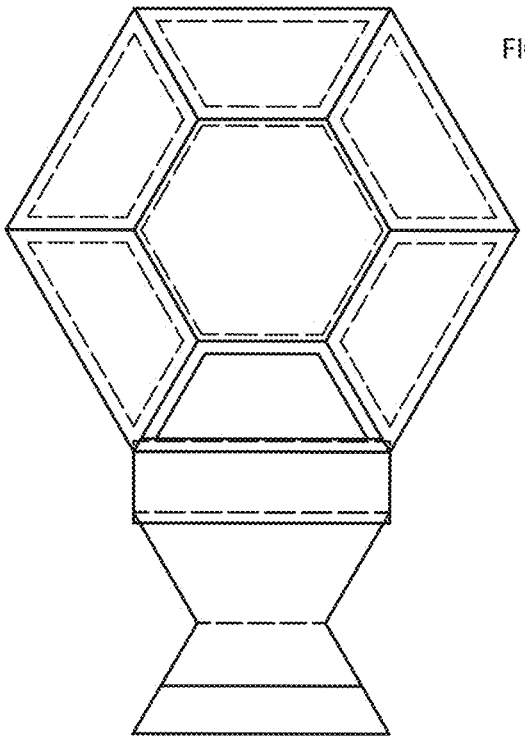
FIG. 9C
FIG. 9D
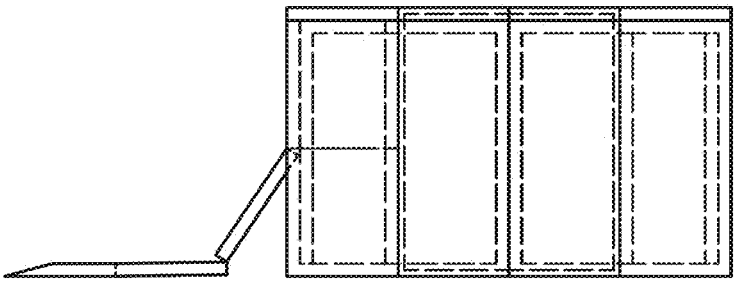

FIG. 9E
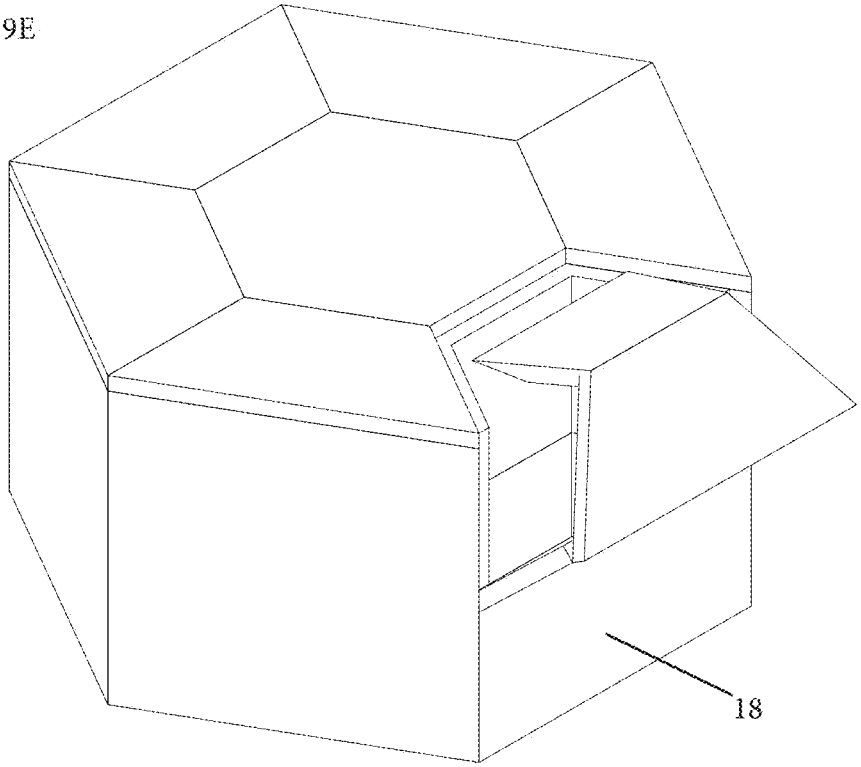
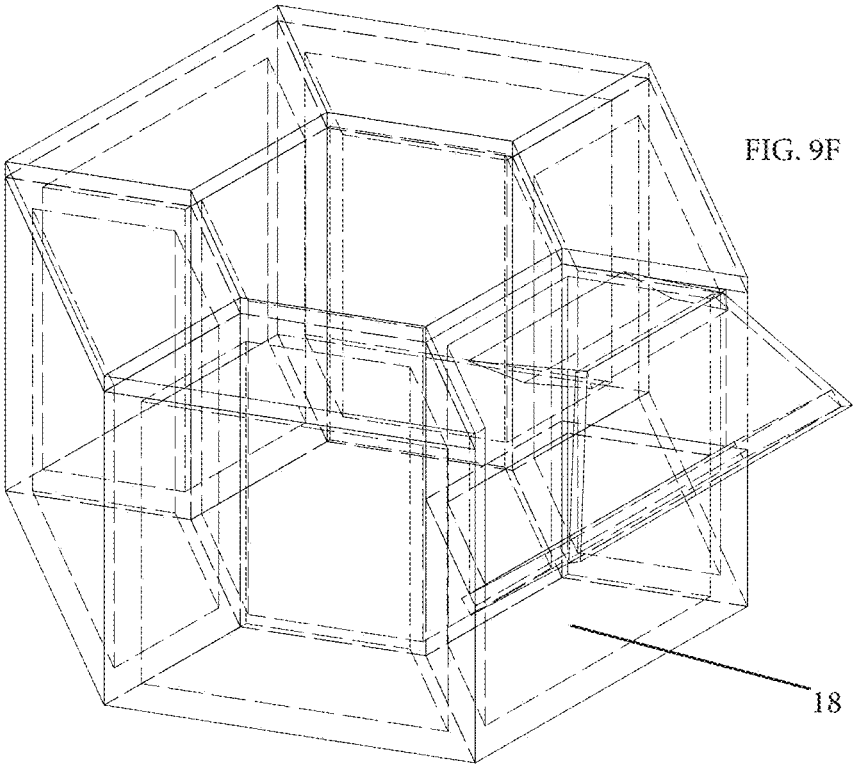
FIG. 9F

FIG. 9G
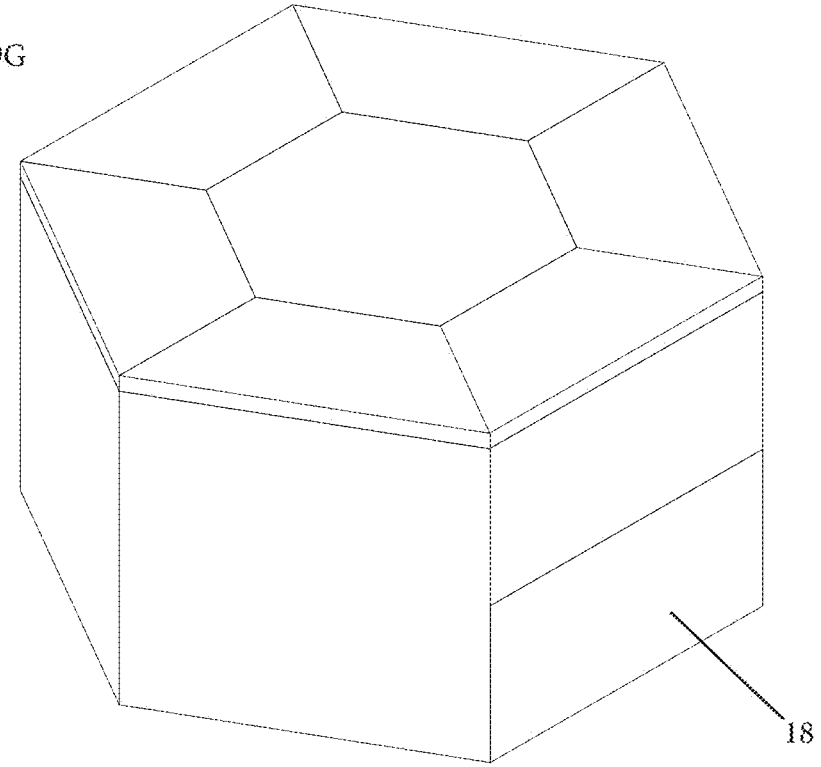
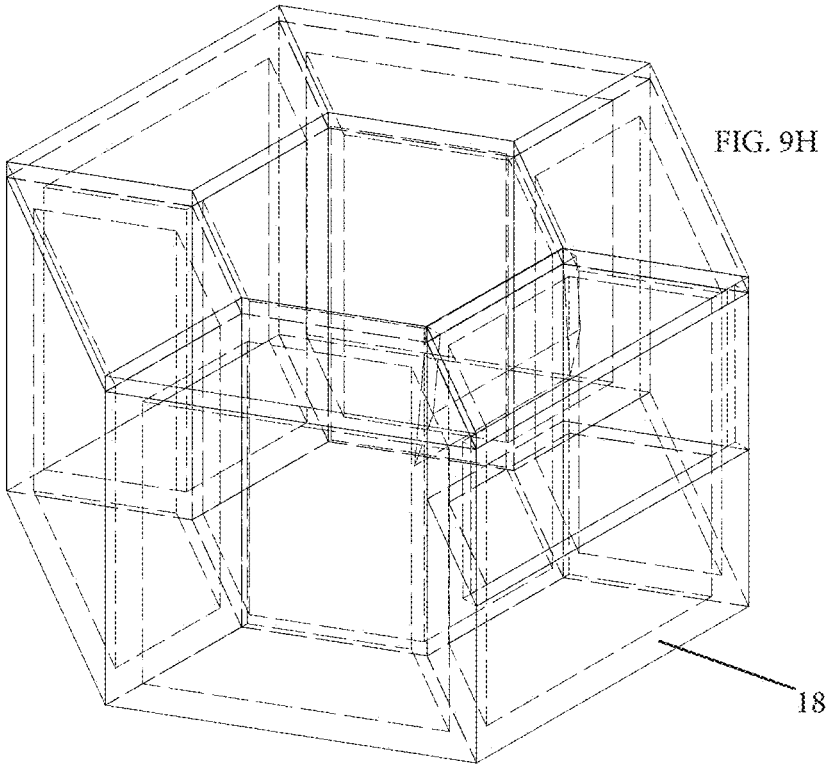
FIG. 9H

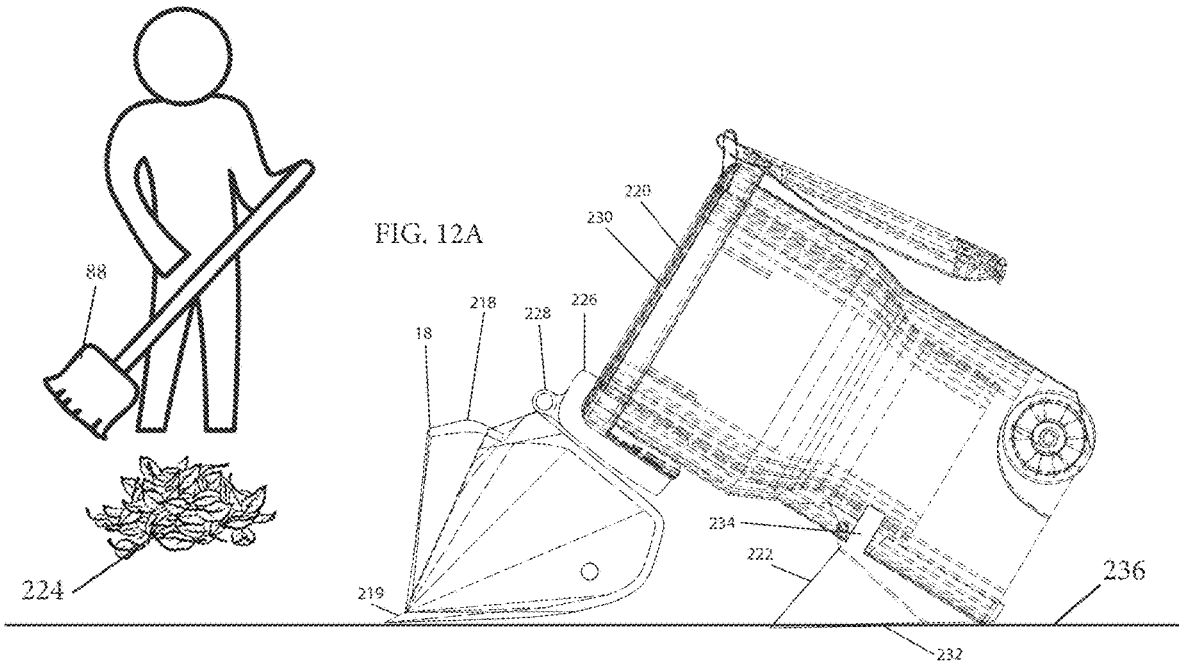
FIG. 12A
FIG. 12B
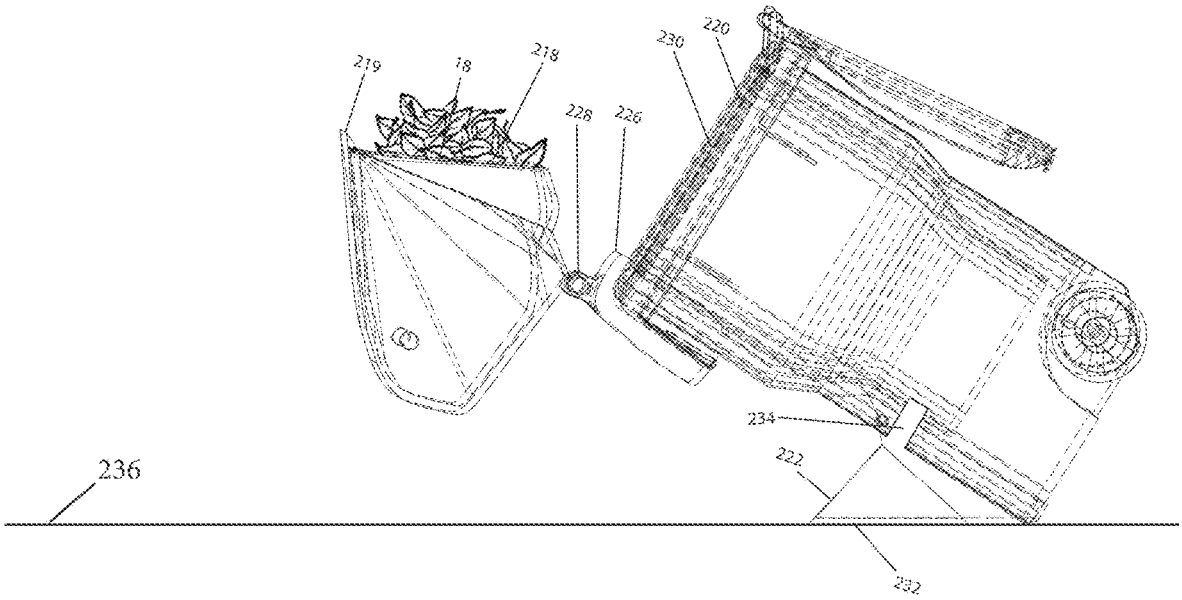

MODULAR COLLECTION AND STORAGE SYSTEM AND METHOD

CROSS-REFERENCE TO RELATED APPLICATION

This application claims the benefit of U.S. Provisional Patent Application No. 63/679,991, filed Aug. 6, 2024, under 35 U.S.C. 119 and is incorporated by reference herein.

FIELD OF THE INVENTION

The present invention relates to modular systems and methods for efficient collection, sorting, and storage of diverse materials across residential, educational, industrial, and commercial applications.

BACKGROUND OF THE INVENTION

The need for efficient sorting, collection, and storage spans various environments, from residential and educational spaces to janitorial, food service, retail, and industrial settings. Traditional storage systems lack adaptability, resulting in disorganization and increased handling time. For example, conventional dustpans and bins do not support systematic sorting in high-traffic or multi-use environments, leading to redundant handling and elevated labor costs. Educational and residential settings with young children, in particular, require effective organization of toys, tools, and materials to minimize labor and maintain organized spaces. Additionally, existing solutions fail to provide flexible configurations or ergonomic features tailored to high-traffic or specialized environments, such as janitorial services or agricultural applications.

SUMMARY OF THE INVENTION

Implementations of the present disclosure solve these limitations by introducing a highly modular, scalable, and configurable system that streamlines collection, sorting, and secure storage of varied materials across residential, commercial, industrial, agricultural, and public environments.

An aspect of the disclosure involves a highly adaptable modular collection, sorting, and storage system designed for diverse, multi-industry applications, including but not limited to residential, commercial, janitorial, educational, retail, food service, and agricultural environments. Central to the system is a multi-functional collection interface that functions both as a direct collection aid and as an optional secure lid for bins, addressing both item gathering and storage needs. This interface is specially designed to deposit items into storage bins, streamlining collection without necessarily requiring transfer, and optionally serving as a lid to enclose items post-collection. The system can be adapted for standalone use, multi-bin setups, or integrated with existing containers or furnishings such as tables, shelving units, ottomans, and other storage forms. The system includes detachable, reconfigurable bins with modular interfaces that are optimized to gather, sort, and store items such as toys, recyclables, tools, compostables, and medical or sensitive materials, providing a cohesive solution for both collection and secure storage. Additionally, the interface supports secure attachment mechanisms compatible with various bin types, including heavy-duty commercial bins and standard residential containers, and specialized receptacles designed for extraterrestrial environments, such as Mars, where collection and storage of planetary specimens are critical. The system includes options for tilt and securement to facilitate ergonomic handling, ensuring stability and case of use.

The system is designed for seamless operation, accommodating both manual use (e.g., compatible with conventional tools like brooms) and advanced automation integration (e.g., robotic arms, IoT sensors, or AI-driven modules). For extraterrestrial applications, the system may include modifications for compatibility with robotic rovers, autonomous sampling devices, and real-time monitoring through space-grade IoT technologies. This enables scalable, efficient, and technologically adaptable sorting and storage in environments with extreme conditions, such as varying atmospheric pressures, temperatures, and gravitational forces.

Another aspect of the disclosure involves a modular collection, sorting, and storage system, which includes a primary structure featuring a dual-purpose collection interface designed to facilitate efficient gathering and secure storage of various items. The modular design accommodates standalone setups, multi-bin configurations, and attachments to existing containers a wide range of environments, including but not limited to residential, commercial, industrial, and public spaces. Applications of this system encompass toy organization and janitorial tasks to recycling, food handling, retail storage, and general sorting needs. Key features of the system include a collection interface that transforms into a secure lid, modular attachment options, and optional configurable partitions within each bin and/or collection interface, enabling flexible multi-category sorting. These features reduce repetitive handling, streamline sorting workflows, and enhance productivity across diverse use cases, ranging from small-scale household cleanup to large-scale, high-capacity waste management applications.

A further aspect of the disclosure involves a modular collection, sorting, and storage system comprising one or more removable, reconfigurable, or permanently affixed bins, each equipped with a versatile collection interface operable as:

(a) a deposit-only interface for collecting and directing items into the bin;

(b) a secure lid for enclosing items within the bin post-collection; and (c) as a dustpan, funnel, scoop, or similar collection mechanism, facilitating dual functionality for direct collection and secure storage.

One or more implementations of the above aspect of the disclosure include one or more of the following: a sorting aid or mechanism that facilitates sorting, within the bin or at subsequent stages, without requiring sorting to be performed in every use case; a modular configuration designed for adaptability across residential, educational, janitorial, industrial, food service, healthcare, commercial applications, and agricultural applications, including integration with furniture, public structures, and specialized housing units, and agricultural fixtures such as tree trunks, poles, or plant rows, enhancing ergonomic accessibility, spatial efficiency, and cross-industry applicability; the modular system capable is of functioning independently or as part of an interconnected sorting network, supporting standalone and multi-bin configurations; the system may incorporate mechanisms that direct materials to be sorted by passive or active sorting methods, either within the system or at later stages, providing flexibility across various sorting and collection environments; a customizable attachment mechanism is included, configured to securely attach the collection interface to various bin types, including but not limited to commercial-grade dumpsters, residential waste bins, and other standardized or non-standard receptacles; Such mechanisms include adjustable fasteners, clamps, interchangeable connectors, or equivalent devices, allowing for secure attachment to bins of diverse shapes, dimensions, and configurations, supporting retrofitting capabilities; an integrated securement and tilting mechanism providing stability to the bin during collection while enabling controlled tilting or pivoting of the bin to ergonomic angles for enhanced accessibility and efficient material collection; the tilting mechanism is adaptable for both manual operation and integration with automated systems to accommodate diverse use cases, including high-throughput environments; flexible mounting and detachment options including a collection interface that may be (a) directly mounted on a bin using a hinge or similar connection; (b) incorporated within a structural housing as part of an integrated system; or (c) attached as part of a detachable modular unit, enabling remote collection and subsequent reattachment to the bin, allowing the collection interface to function as: (i) a secure lid, enclosing items within the bin; or (ii) a deposit-only interface for collecting and directing items into the bin without necessarily serving as a lid. The combination of attachment, securement, and tilting mechanisms, along with the collection interface, facilitates adaptable functionality for (a) toy organization and cleanup in residential and educational settings; (b) waste collection and sorting in janitorial, public, or industrial environments; and (c) material handling and sorting in agricultural, food service, pharmaceutical, medical, shipping or commercial environments; the collection interface operates in configurations that allow items to be collected and directed into the bin either as a deposit-only mechanism or as a dual-function mechanism capable of converting into a secure lid; the collection interface supports attachment to and retrofitting with existing bins, including waste containers and modular receptacles, to expand functionality and compatibility with pre-existing systems; configurable partitions within each bin and/or collection mechanism, enabling sorting and/or collection of items by characteristics such as ripeness, color, size, material type, or other distinguishing features, adaptable to diverse applications, including household organization, industrial and commercial sorting and/or collection, and agricultural use for collecting and sorting fresh produce directly at the source; mechanisms enabling modular bin arrangements in, but not limited to, side-by-side, circular, linear, or stacked formations, providing flexibility for use in environments such as parks, schools, retail spaces, residential spaces, food preparation, residential spaces, food preparation, industrial facilities, and agricultural settings where multi-category sorting and/or collection is required; the collection interface transitions between an open scooping or collection position and a closed, secured lid with minimal user effort, incorporating optional assistive mechanisms such as foot pedals, levers, or wheels to enhance usability, particularly in high-volume or industrial settings; the bins and collection interfaces are customizable with materials and features tailored to specific industries, including child-safe materials for educational environments, chemical-resistant coatings for healthcare, and reinforced structures for heavy-duty industrial applications; mobility aids, such as handles, wheels, extendable arms, or similar mechanisms, enabling case of transport between collection points and enhancing accessibility in larger environments, including public facilities, commercial spaces, and industrial sites; the collection and/or sorting interface may be configured to collect items into the bin and optionally facilitate sorting, either during collection, within the bin, or in subsequent stages, without requiring sorting to be performed in all embodiments; compatibility with standardized waste bins and receptacles, enabling retrofitting with existing municipal green bins, heavy-duty commercial dumpsters, or other receptacle types to enhance sorting and storage functionality across residential, municipal, commercial, and industrial settings; optional child-proof locking mechanisms restrict unauthorized access to bins, ensuring controlled storage solutions in environments involving young children or sensitive materials, thereby enhancing safety and security; automated sorting features including, wherein integration with IoT and smart technologies, including AI-based modules, robotic arms, or sensor systems, enables automated identification, collection, and sorting of materials based on size, shape, or material type, providing scalability and efficiency in high-traffic or industrial applications, whether sorting is done during collection or in subsequent stages; a method for collecting, sorting, and storing Materials using the modular collection and sorting system, comprising configuring the system based on specific user or environmental needs, activating the collection interface to gather items, optionally facilitating sorting within the bin or in subsequent stages, and converting the interface into a secure lid to enclose items within the bin; adjusting system features, such as partitioning and collection interfaces, for adaptation to specialized environments, including recycling centers, educational spaces, pharmaceutical facilities, healthcare facilities, and industrial sites where multi-category sorting is necessary; standalone and multi-bin configurations, enabling bins to (a) attach to vertical agricultural fixtures, such as tree trunks, poles, or similar supports, for direct collection of materials at the source during harvesting or other agricultural operations; (b) be arranged modularly in rows, clusters, circular, linear, or stacked formations, providing flexibility for sorting and storage across diverse environments, including parks, schools, retail spaces, industrial facilities, and agricultural settings; agricultural precision features; integration with GPS, IoT sensors, or mobile apps to monitor bin placement, usage, and fill levels during harvesting or field operations; assignment of specific bins to rows, sections, or crop types for traceability and compliance with agricultural certifications; harvesting and waste management applications; a design adaptable for use in rows of trees or plants, allowing for continuous or sequential collection during manual or automated harvesting tasks and supporting efficient operations in agricultural environments; features supporting transportability, enabling bins to be easily detached, replaced, and transported for storage, further processing, or multi-stage sorting applications; configurations for collecting organic waste, fallen fruit, or debris, with options for sorting compostable and non-compostable materials; livestock and aquaculture adaptations; configurations for collecting and sorting livestock feed, aquatic harvests, or organic waste, including features for water drainage, aeration, or portion control; automated and sensor-based compatibility, allowing integration with robotic devices, sensors, or AI-based modules to facilitate automated sorting and material handling, suitable for high-traffic, industrial, or public applications requiring scalability and efficiency. Each bin and/or collection mechanism may include adjustable partitions to enable in-bin sorting based on attributes such as type, color, size, or material, supporting applications in residential, commercial, and educational environments for organized collection and categorization; furniture and structural integration, allowing incorporation into tables, cabinets, shelving units, or other furnishings to enhance ergonomic accessibility and space efficiency, suitable for homes, offices, and public facilities; adaptable for multi-industry use, wherein the bins and collection interfaces are constructed with customizable materials and features designed to meet specific operational demands across residential, educational, janitorial, industrial, pharmaceutical, medical, and food service applications, ensuring versatility and durability; high-durability materials, including options that are weatherproof, UV-resistant, and impact-resistant, suitable for outdoor and intensive use in public spaces, parks, and industrial facilities, ensuring long-term performance under demanding conditions; a mechanism enabling bins to attach securely to tree trunks, poles, or similar vertical structures, or automated devices, allowing collection directly at the source during agricultural tasks such as fruit harvesting; said attachment mechanism may include adjustable straps, clamps, or equivalent devices to accommodate varying trunk diameters and ensure stability during collection; agricultural use, wherein bins are constructed from materials suitable for collecting, sorting, and transporting fresh produce, including (a) breathable materials to prevent spoilage; (b) UV-resistant coatings to protect contents from sun damage; and (c) insulated walls to maintain product quality during collection and transport; bin features such as detachable lids, stackable designs, and color-coded partitions for sorting agricultural products by ripeness, size, or type; features supporting automated or manual harvesting, wherein the collection interface integrates with robotic arms, drones, or similar automated systems to directly collect materials from trees, plants, or other agricultural sources; mobile harvesting units such as carts, tracks, or vehicles that transport and detach bins for seamless collection during agricultural operations; manufacturing line integration such as compatibility with assembly lines, robotic arms, or conveyor belts for collecting and sorting parts, raw materials, or waste during production processes; features for quality control sorting, including sensors or cameras to detect defects or classify items based on size, weight, or material properties; raw material handling and distribution such as configurations to handle and sort raw materials such as grains, powders, liquids, or components in manufacturing or processing plants; airtight or spill-proof storage options for sensitive materials, ensuring safety and efficiency in handling and transportation; recycling and waste separation such as modular bins for separating recyclable materials such as plastics, metals, and paper in industrial settings; bins with customizable labels, partitions, or compartments for sorting materials at the point of collection or during subsequent stages; supply chain integration such as modular transport units equipped with RFID tags, barcode systems, or IoT connectivity to track inventory and facilitate sorting at various points in the supply chain, ensuring material traceability and streamlined logistics; and/or a harvesting configuration including use in rows of trees or plants, enabling multiple bins to be arranged in a series along the trunks, poles, or support structures, providing continuous collection points during harvesting operations.

A further aspect of the disclosure involves a modular collection and storage system comprising a plurality of removable, reconfigurable, or permanently affixed bins; and a collection interface including a collection configuration to collect items to be stored in the bins, and a deposit configuration to deposit the collected into the bins.

One or more implementations of the above aspect of the disclosure include one or more of the following: the collection interface further includes a lid configuration to cover the bins and enclose the collected and stored items; a sorting mechanism configured to sort the items with respect to the bins; the collection interface includes a dustpan, a funnel, or a scoop; an attachment mechanism to secure the collection interface to one or more of the bins; a securement and tilting mechanism configured to provide stability to one or more of the bins during collection of the items and configured to provide tilting of the bin to ergonomic angles for enhanced accessibility and efficient material collection, the securement and tilting mechanism including one or more of an adjustable clamp, a bracket, a pivot point, and a lockable hinge, enabling a user to engage or disengage a tilt function; the collection interface is coupled to one or more of the bins by direct mounting via a hinge, incorporation within a structural housing as part of an integrated system; or attached as part of a detachable modular unit, enabling remote collection and subsequent reattachment to one or more of the bins; the collection interface is a secure lid, enclosing the items within one or more of the bins; or a deposit-only interface for collecting and directing the items into one or more of the bins without serving as a lid; one or more of the bins include configurable partitions within each bin and/or collection mechanism, enabling sorting and/or collection of items by different characteristics; one or more of the bins are configured for arrangement in side-by-side, circular, linear, or stacked formations; a user-assist mechanism including one or more of foot pedals, levers, and wheels to enhance usability; a mobility-aid mechanism including one or more handles, wheels, and extendable arms.

An additional aspect of the disclosure involves a method of using a modular collection and storage system comprising a plurality of removable, reconfigurable, or permanently affixed bins; and a collection interface including a collection configuration to collect items to be stored in the bins, and a deposit configuration to deposit the collected into the bins, the method comprising providing the collection interface in the collection configuration to receive the items, which are swept by a sweeping apparatus, onto the collection interface; and providing the collection interface in the deposit configuration, depositing the collected items into the bins.

Another aspect of the disclosure involves a method of using a modular collection and storage system comprising a plurality of removable, reconfigurable, or permanently affixed bins; and a collection interface including a collection configuration to collect and store children's toys, the method comprising providing the collection interface in the collection configuration to receive children's toys, which are swept by one or more children with one or more sweeping apparatuses, onto the collection interface; and providing the collection interface in the deposit configuration, depositing the collected children's toys into the bins. The modular collection and storage system may include a sorting mechanism configured to sort the children's toys with respect to the bins, and providing the collection interface in the collection configuration includes providing the collection interface in the collection configuration to receive children's toys, which are swept by and sorted using the sorting mechanism by one or more children with one or more sweeping apparatuses, onto the collection interface.

One or more implementations of the above two aspects of the disclosure immediately above include one or more of the following: the collection interface further includes a lid configuration to cover the bins and enclose the collected and stored items; a sorting mechanism configured to sort the items with respect to the bins; the collection interface includes a dustpan, a funnel, or a scoop; an attachment mechanism to secure the collection interface to one or more of the bins; a securement and tilting mechanism configured to provide stability to one or more of the bins during collection of the items and configured to provide tilting of the bin to ergonomic angles for enhanced accessibility and efficient material collection, the securement and tilting mechanism including one or more of an adjustable clamp, a bracket, a pivot point, and a lockable hinge, enabling a user to engage or disengage a tilt function; the collection interface is coupled to one or more of the bins by direct mounting via a hinge, incorporation within a structural housing as part of an integrated system; or attached as part of a detachable modular unit, enabling remote collection and subsequent reattachment to one or more of the bins; the collection interface is a secure lid, enclosing the items within one or more of the bins; or a deposit-only interface for collecting and directing the items into one or more of the bins without serving as a lid; one or more of the bins and or one or more of the collection mechanisms include configurable partitions within each bin and or within each collection mechanism, enabling sorting and/or collection of items by different characteristics; one or more of the bins are configured for arrangement in side-by-side, circular, linear, or stacked formations; a user-assist mechanism including one or more of foot pedals, levers, and wheels to enhance usability; a mobility-aid mechanism including one or more handles, wheels, and extendable arms.

A further aspect of the disclosure involves a modular collection, optional sorting, and storage system comprising a plurality of removable, reconfigurable, or permanently affixed bins; each bin being configurable to function with a collection interface that allows for: (a) collection and deposit of items into the bins without requiring sorting; (b) optional sorting during collection, after collection, or at a subsequent stage.

A still further aspect of the disclosure involves a collection interface operable as one or more of a dustpan, funnel, scoop, or similar mechanism, wherein the collection interface is further configured to: (a) operate as a deposit-only interface for directing items into the bins; (b) optionally facilitate sorting of collected items into appropriate bins; or (c) serve as a secure lid enclosing the contents within one or more bins.

One or more implementations of the above two aspects of the disclosure immediately above include one or more of the following: configurable partitions within each bin, enabling sorting and/or collection of items by characteristics such as color, size, material, or other distinguishing features; the bins are arranged modularly in one or more of the following formations; side-by-side, circular, linear, stacked, or other configurations adaptable to different environments, including residential, commercial, and industrial settings; an attachment mechanism to secure the collection interface to one or more of the bins, wherein the attachment mechanism includes adjustable fasteners, clamps, interchangeable connectors, or equivalent devices; a securement and tilting mechanism configured to: (a) provide stability to the bins during collection of items; and (b) enable controlled tilting or pivoting of the bins to ergonomic angles for enhanced accessibility and efficient material collection; the collection interface is coupled to one or more of the bins by: (a) direct mounting via a hinge or similar connection; (b) integration within a structural housing as part of an integrated system; or (c) attachment as part of a detachable modular unit, enabling remote collection and subsequent reattachment to the bin; a mobility-aid mechanism, including one or more of handles, wheels, extendable arms, or similar devices to enhance transportability and usability; assistive mechanisms, including one or more of foot pedals, levers, or automated components to improve usability in high-volume or industrial applications; the bins are compatible with standardized waste bins or receptacles, enabling retrofitting with automated sorting features, including robotic arms, IoT sensors, or AI-based modules to identify, collect, and sort items based on size, shape, material, or other attributes; the configured for agricultural use, wherein the bins: (a) include materials suitable for collecting, sorting, and transporting fresh produce, such as breathable, UV-resistant, or insulated materials; (b) are attachable to vertical structures such as tree trunks or poles for direct collection during harvesting; and (c) support modular arrangements, enabling efficient sorting and collection across rows, clusters, or fields; child-proof locking mechanisms to restrict unauthorized access to the bins, enhancing safety in environments with young children or sensitive materials.

An additional aspect of the disclosure involves a method of using a modular collection, optional sorting, and storage system, the system comprising a plurality of removable, reconfigurable, or permanently affixed bins; each bin being configurable to function with a collection interface that allows for: (a) collection and deposit of items into the bins without requiring sorting; (b) optional sorting during collection, after collection, or at a subsequent stage, the method comprising: (a) configuring the collection interface to collect items and direct them into one or more bins; (b) optionally facilitating sorting of the items during or after collection; and (c) securing the items within the bins using the collection interface as a lid or other securement mechanism.

One or more implementations of the above two aspects of the disclosure immediately above include one or more of the following: retrofitting the system to existing bins, enabling enhanced collection, storage, and optional sorting functionalities; the system is further configured for furniture integration, wherein the bins and collection interface are incorporated into tables, cabinets, shelving units, or other furnishings to enhance ergonomic accessibility and spatial efficiency; the system is adaptable for multi-industry use, wherein the bins and collection interfaces are customizable with materials and features tailored for residential, educational, janitorial, industrial, healthcare, agricultural, and food service applications; the system further comprises advanced durability features, including weatherproof, UV-resistant, or impact-resistant materials suitable for outdoor use in public spaces, parks, and industrial environments.

BRIEF DESCRIPTION OF THE DRAWINGS

In order to describe the manner in which the present disclosure can be implemented, a more particular description will be rendered by reference to specific implementations thereof which are illustrated in the appended drawings. For better understanding, the like elements have been designated by like reference numbers throughout the various accompanying figures. Understanding that these drawings depict only typical implementations of the invention and are not therefore to be considered to be limiting of its scope, the invention will be described and explained with additional specificity and detail through the use of the accompanying drawings in which:

FIGS. 1A-1C illustrate an embodiment of the system implemented in a child's playroom or classroom for toy sorting and organization, in which FIG. 1A illustrates an elevated right-side view showing the lid in an open position for object collection; FIG. 1B illustrates an elevated right-side view with the lid being lifted to deposit objects into the bin; and FIG. 1C illustrates an elevated right-side view with the lid closed to secure stored items. These figures demonstrate the collection interface transitioning from an open (dustpan/scoop) configuration to a closed (secure lid) configuration, with optional child-friendly features like labeled partitions, low-height access, and childproof locks.

FIGS. 2A-2C illustrate rear perspective views of the system showing the lid in different positions, in which FIG. 2A illustrates the lid open for object collection; FIG. 2B illustrates the lid lifted for depositing objects into the bin; and FIG. 2C illustrates the lid closed over the bin for secure storage.

FIGS. 3A-3D illustrate front perspective views of an alternate embodiment featuring multiple bins, in which FIG. 3A illustrates lids flipped open for object collection; FIG. 3B-3C illustrate lids partially and fully lifted to facilitate depositing objects into the bins; and FIG. 3D illustrates lids closed over the bins for secure storage.

FIGS. 4A-4J depict an alternate version of the system with multiple bins and with elevated and perspective views illustrating bins in various positions, including open, closed, and during object collection, in which FIG. 4G-4J illustrate internal views showing sorting configurations for multi-category storage.

FIGS. 5A-5V depict detailed views of an alternative version of a multi-bin system for sorting and storage and illustrates configurations with stacked bins, showing lids in open, closed, and intermediate positions for sorting and storage, in which FIGS. 5E, 5G, 5J, 5M, 5P, 5S, and 5T illustrate hidden line views of internal components and sorting mechanisms and FIGS. 5U-5V demonstrate bin removal and reinsertion into a cabinet structure.

FIG. 7A illustrates the lid partially lifted to facilitate depositing objects into the bin; FIG. 7B illustrates an embodiment with a slanted opening and a skewed lid that is flipped open for object collection.

FIGS. 9A-9H depict a table-based system with integrated bins in accordance with another version. The figures illustrate perspective and top views showing bins in open, closed, and intermediate positions, with hidden line views included for certain figures to depict internal components and sorting mechanisms.

FIGS. 10A-10S illustrate a tilted bin system designed for ergonomic use, in which FIGS. 10A-10N illustrate individual bin transitioning between collection and storage positions, and FIGS. 10O-10S illustrate Multiple bins arranged in a tessellated layout for efficient sorting and storage.

FIGS. 11A-11O depict bins with lids transitioning between open and closed positions, optimized for multi-category sorting. FIG. 11P specifically demonstrates the cuboctahedron arrangement integrated with a handle-like structure, enabling the system to function as a janitor's dustpan for sorting and collecting refuse, showcasing its adaptability for cleaning and organizational tasks.

FIGS. 12A-12J illustrate side and perspective views of an alternate embodiment configured for use with a trash bin, in which FIG. 12A illustrates an attachment mechanism securing a custom-sized lid to the bin, with the lid hinged for depositing objects; FIGS. 12A-12D illustrate elevated side views of the lid shown in open, intermediate, and closed positions; and FIGS. 12E-12J illustrate perspective views demonstrating the stand holding the bin at a tilted angle for ease of use and ergonomic object collection.

DETAILED DESCRIPTION

In this disclosure, as illustrated in FIGS. 1-12J, specific terminology is employed for the sake of clarity. The invention as claimed in this application, however, is not intended to be limited to specific terminology so selected, and it is to be understood that each specific element includes all technical equivalents that operate in a similar manner to accomplish similar functions.

Figure 1A:
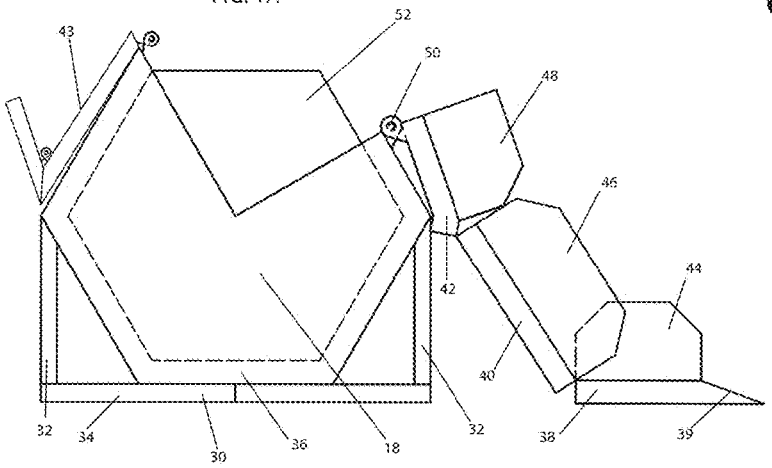
Figure 1A:
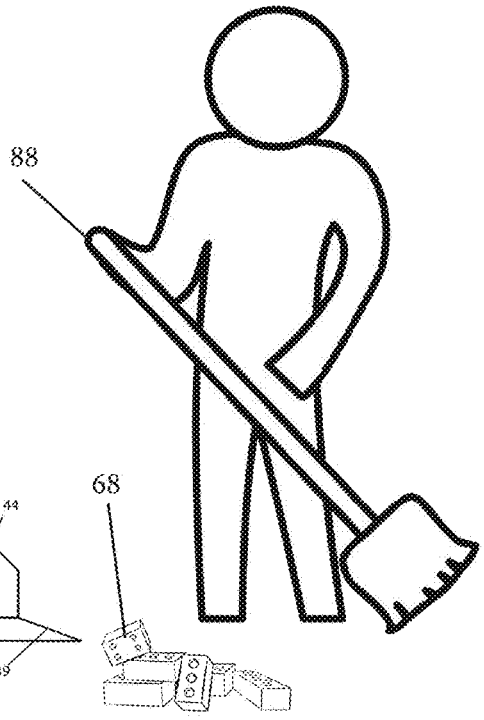
Figure 1A:
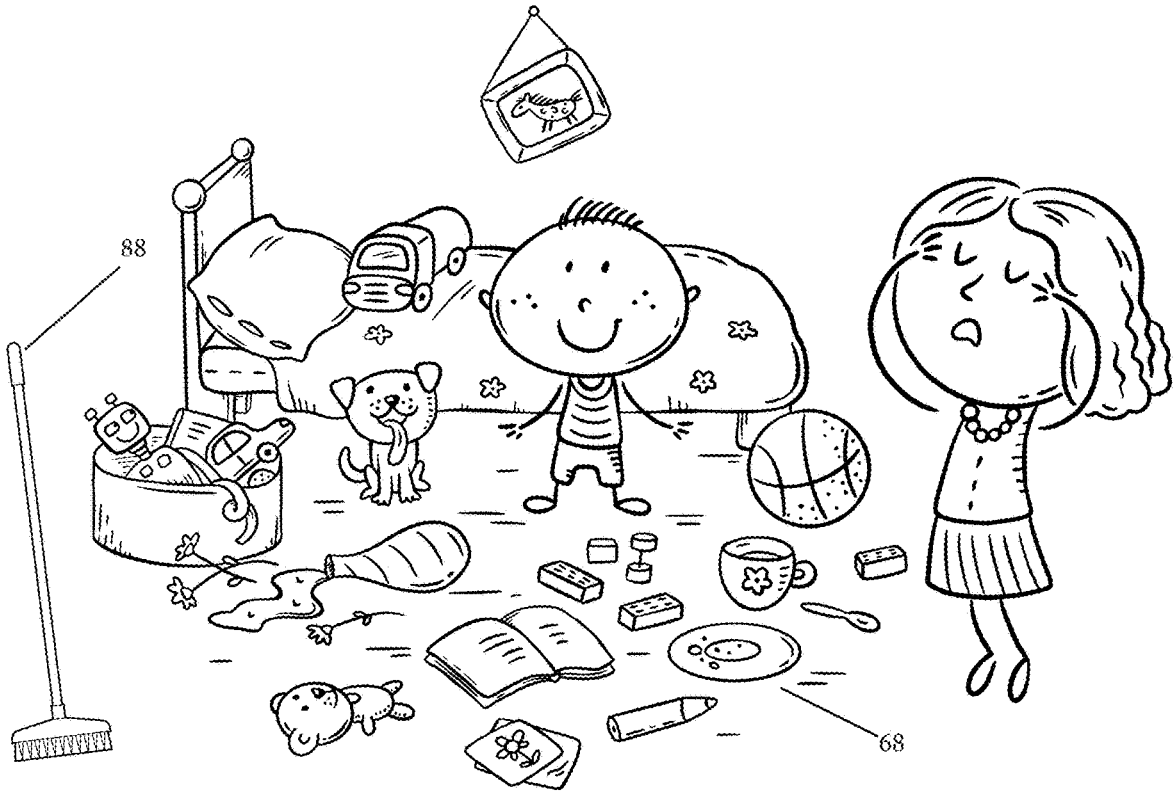
Figure 1B:
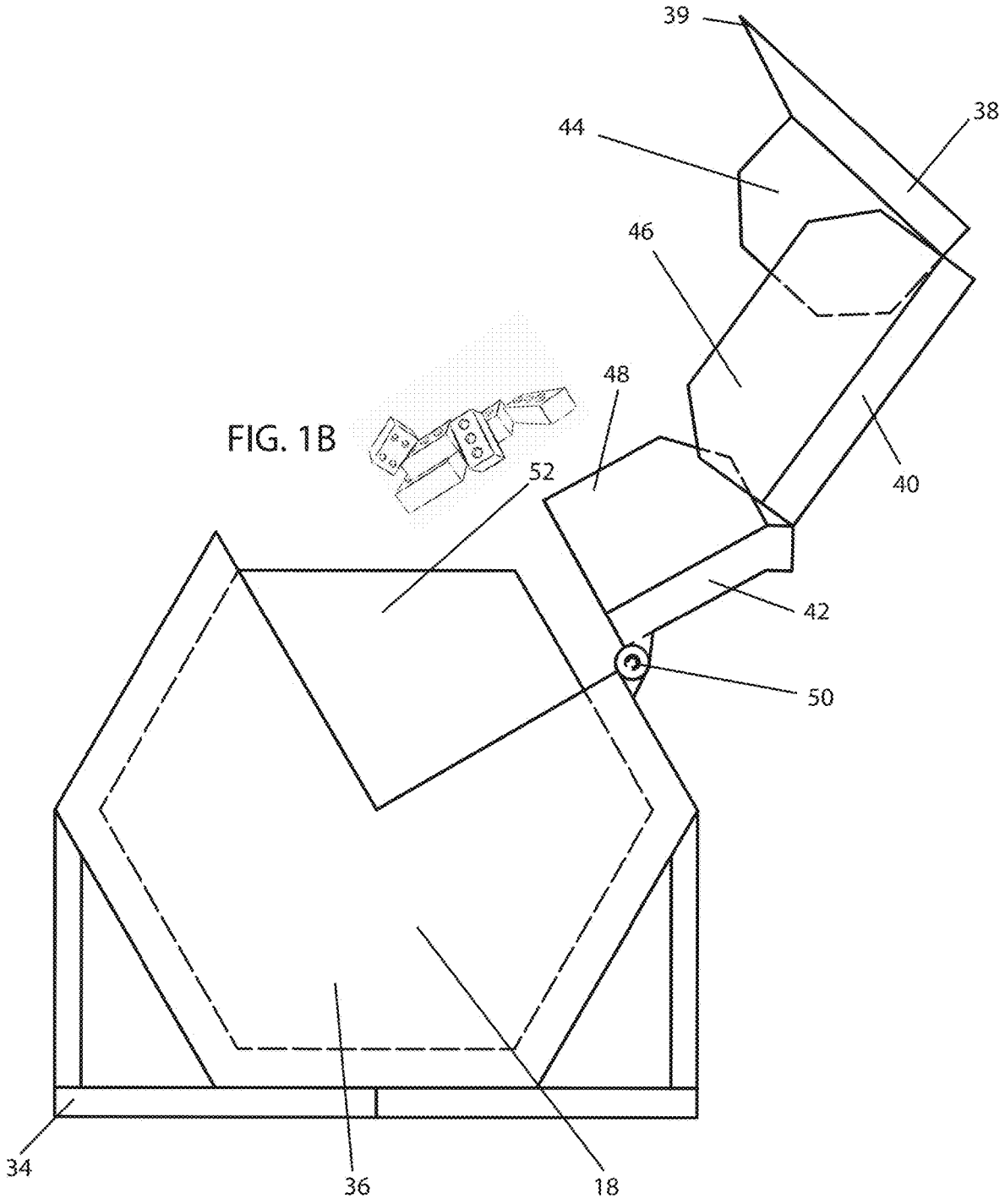
Figure 1C:
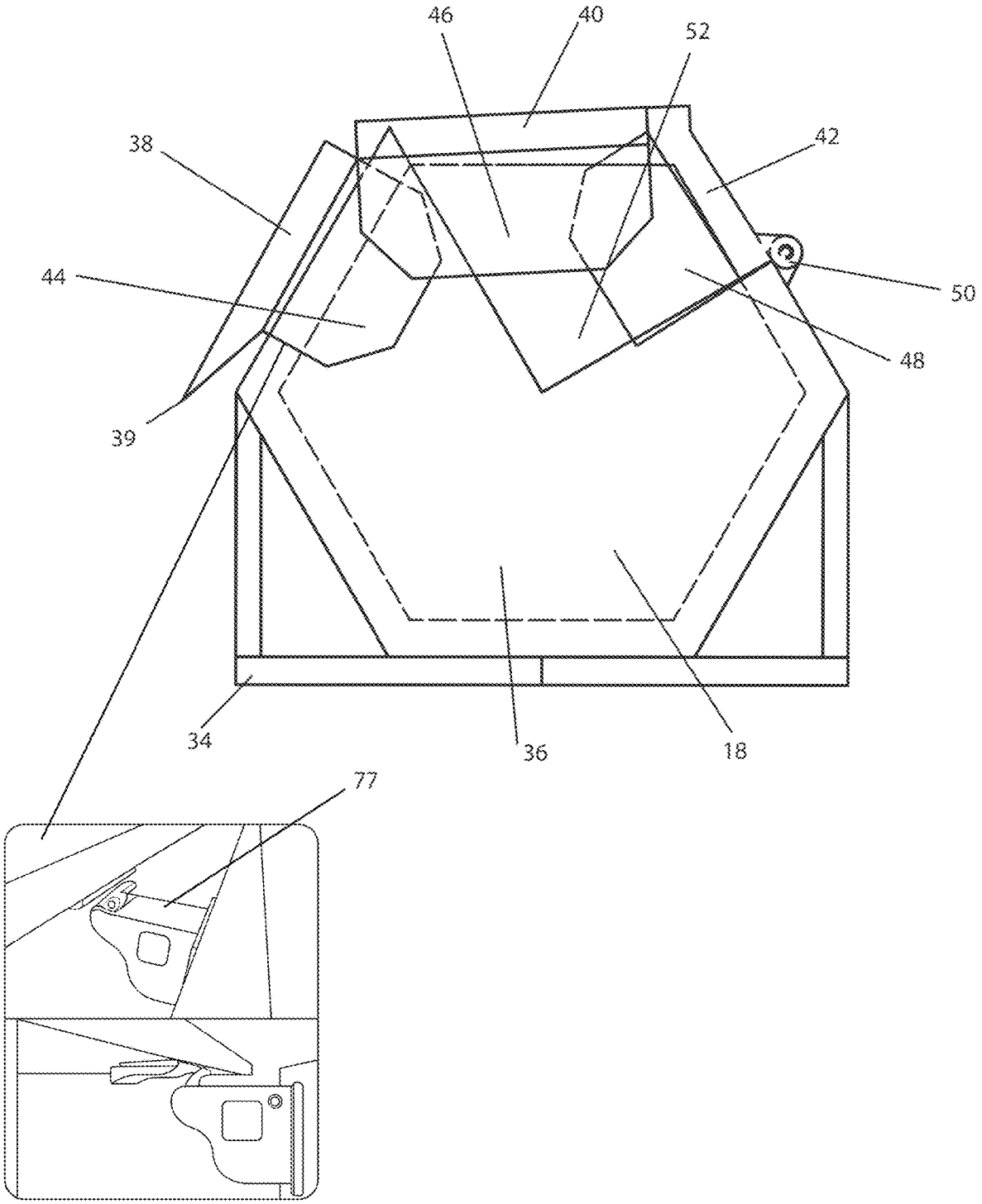

Reference will now be made to the figures to describe various aspects of example embodiments of the disclosure. FIGS. 1A-1C depict a modular system 18, shown with bins and lids for multi-category sorting for collection, sorting and storing of a variety of toys, toy parts, and other objects and debris 68, and is shown in an elevated right side view in FIGS. 1A, 1B and 1C. A cabinet bottom frame 34 is made up of a bottom base 30 and four sides 32 and contains a hexagonal bin 36 with a bin opening 52. A top bin lid 42 is attached to the bin opening 52 with a conventional hinge 50. The top bin lid 42 has a right side 48R and a left side 48L attached in a perpendicular fashion on each side. A middle bin lid 40 is attached to the top bin lid 42 with a conventional hinge (not shown). The middle bin lid 40 has a right side 46R and a left side 46L attached in a perpendicular fashion on each sides. A dustpan-like apparatus 38 is attached to the middle bin lid 40 with a conventional hinge (not shown). The dustpan-like apparatus 38 has a right side 44R and a left side 44L attached in a perpendicular fashion to both sides of the dustpan-like apparatus 38. A conventional lip 39 made of rubber or a variety of other materials is at the bottom end of the dustpan-like apparatus 38. When the dustpan-like apparatus 38 is in the position touching the floor as seen in FIG. 1A, the lip 39 is on the front portion of the top and/or bottom surfaces of the dustpan 38 and no gap exists between the lip 39 and the ground, or any other surface unto which the system 18 is placed. The lip 39 is typical in design to a conventional dustpan lip. The lip 39 may be affixed permanently to the dustpan 38 or may be replaceable when necessary. The top bin lid 42 and the middle bin lid 40 are preferably made out of wood. The dustpan-like apparatus 38 as well as sides of the top bin lid 48, the sides of the middle bin lid 46, and the sides of the dustpan-like apparatus 44 are preferably made out of plastic. Cabinet bottom frame 34 preferably is made of wood; the hexagonal bin 36 is preferably made of transparent plastic. All of the invention's components may also be made of a variety of other materials, shapes, and sizes to achieve the desired result.

Although cabinet bottom frame 34 is shown as rectangular, it may be a variety of other shapes. Also, although hexagonal bin 36 is shown as hexagonal, it may be a variety of other shapes, such as, but not limited to, square, rectangular, triangular, circular, oval, hemispherical, etc. Hexagonal bins can be interchangeable and stored similarly to the way cells are stored in a honey-comb. Like the cells of a honey comb, hexagonal-like bins utilize minimal building material for the bins, maximize storage space inside the bins, and are very sturdy. A hexagon has junctions of 120 degrees which are the most mechanically stable arrangement.

Cabinet bottom frame 34 and hexagonal bin 36 may be separable from each other so that bin 36 may be replaced with another bin, for compact storage, and for cleaning. Alternatively, frame 34 and hexagonal bin may be permanently connected into one bin which uses its own lid for the collection mechanism. Optionally, top bin lid 42 can be separated from the bin opening 52 so as to allow easier access to the objects within the hexagonal bin 36, for example, when a child wants to play with the toys inside the bin. Alternatively, the entire system 18 can be turned around to allow individuals to access the bin's contents without the bin lid in the way. The cabinet bottom frame 34 may optionally have wheels on the bottom to allow a user to more easily maneuver the system 18. Optionally, the middle bin lid 40 may be separated from the top bin lid 42 and the dustpan-like apparatus 38 may be separated from the middle bin lid 40 to permit easier access to the bin's contents. Optionally, the cabinet bottom frame 34 can be a variety of other shapes, such as but not limited to the shape matching the hexagonal bottom of the hexagonal bin 36 to allow the user to click the middle bin lid 40 and the dustpan-like apparatus into the front of the cabinet bottom frame 34 to allow a user to gain easier access to the bin's contents. This could involve folding both sides of the dustpan-like apparatus 44 inwards towards the top of the dustpan-like apparatus 38 or outwards and down towards the bottom of the dustpan-like apparatus 38 and folding both sides of the middle bin lid 46 inwards towards the top of the middle bin lid 40 or outwards and down towards the bottom of the middle bin lid 40 and using a conventional clicking method to connect the top of the dustpan-like apparatus 38 to the top of the middle bin lid 40 or to connect the bottom of the dustpan-like apparatus 38 to the bottom of the middle bin lid 40. The dustpan-like apparatus 38 or the middle bin lid 40 can be clicked into the front of the cabinet bottom frame 34, thus providing the user with more access to the contents of the bin 36.

Optionally, the hexagonal bin 36 may have an additional bin lid 43 connected with a conventional hinge to the front edge or back edge of the bin opening 52 (as shown in FIG. 1A). The benefit of this is that if the hexagonal bin 36 needs to be removed from the cabinet bottom frame 34 in order to replace it with an alternate hexagonal bin, the removed hexagonal bin 36 will still have its own bin lid 43. If the additional bin lid 43 is connected to the front edge of the bin opening 52, the additional bin lid 43 can click unto or otherwise connect to the inner surface of the top bin lid 42 and the middle bin lid 40 when both top bin lid 42 and middle bin lid 40 are flipped open towards the ground. If the additional bin lid 43 is connected to the back edge of the bin opening 52, the user simply lifts it open upwards towards the back to get it out of the way.

Figure 2A:
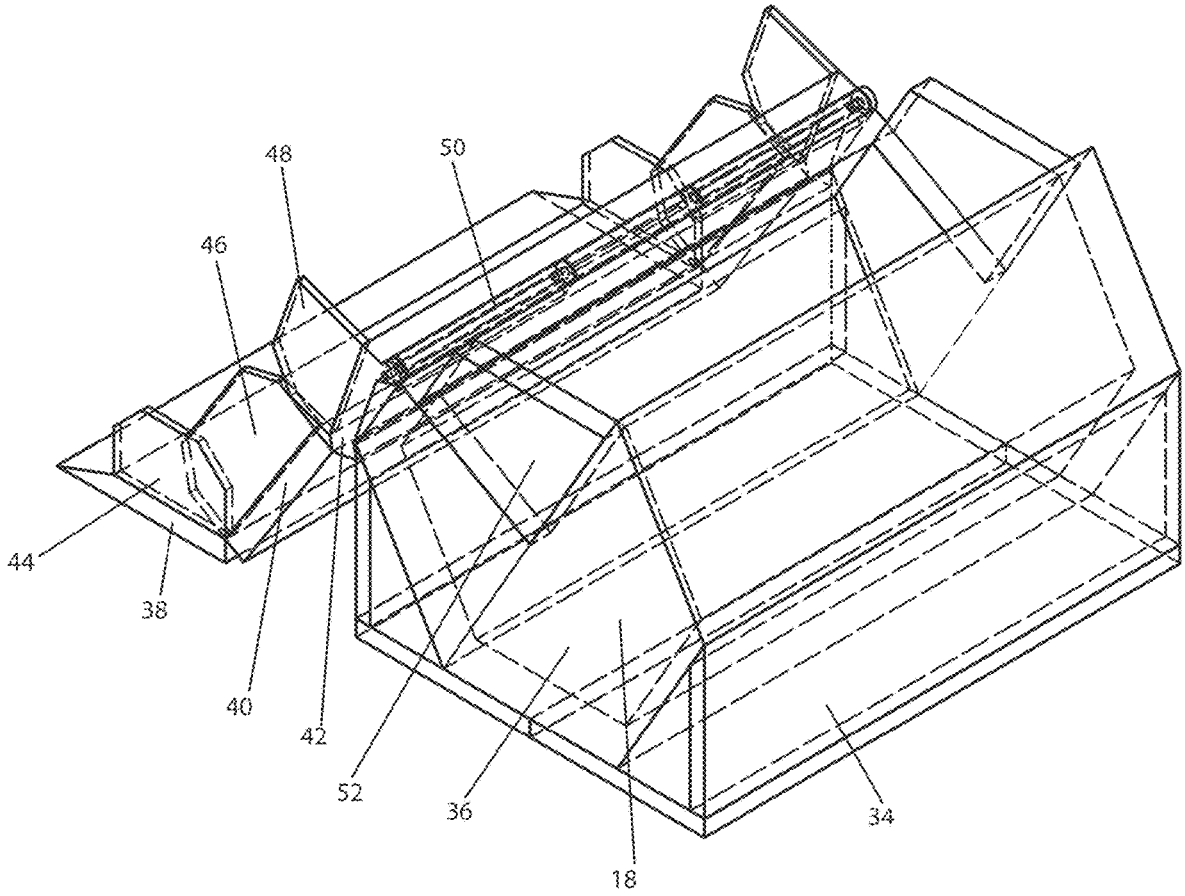
Figure 2B:
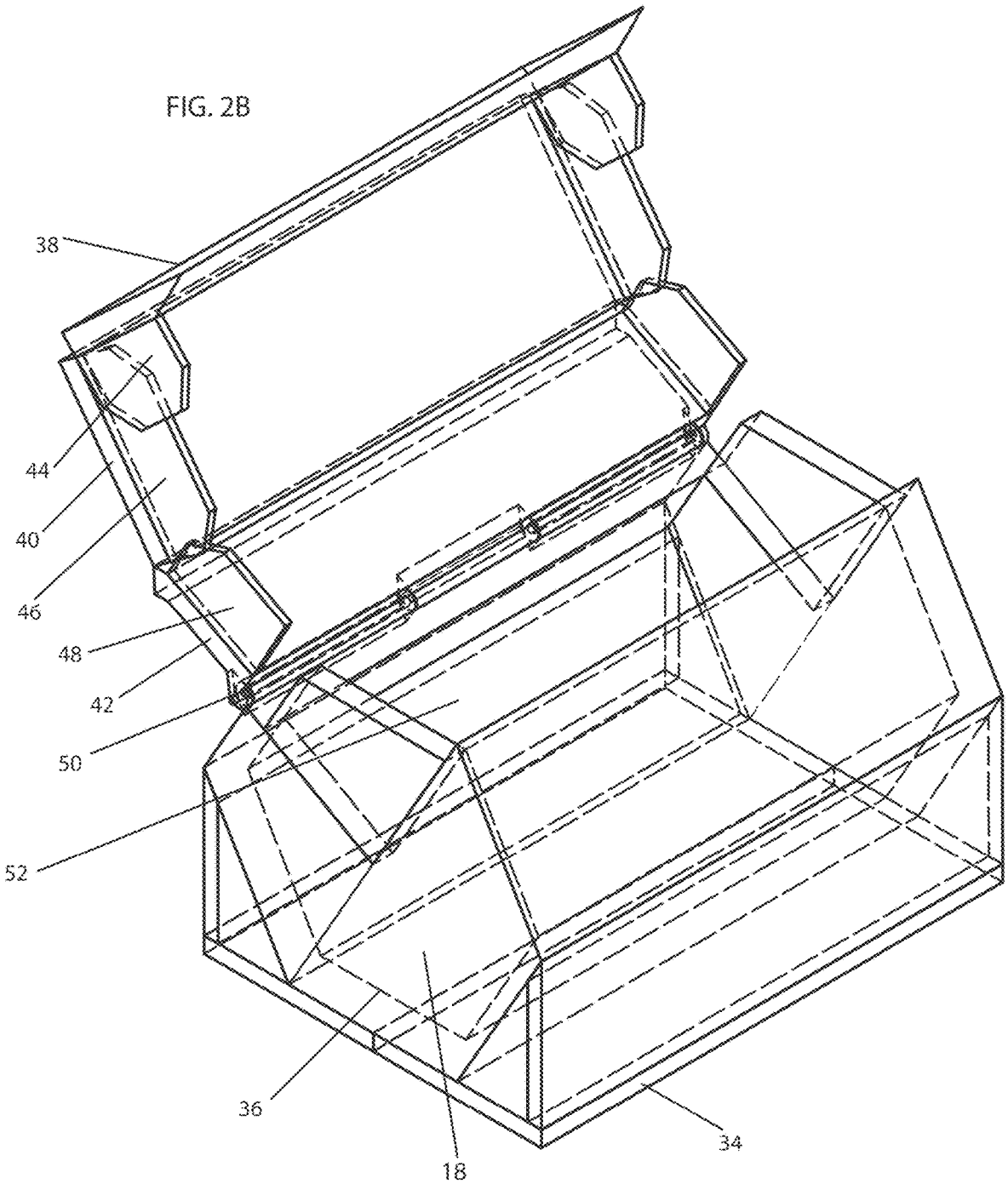
Figure 2C:
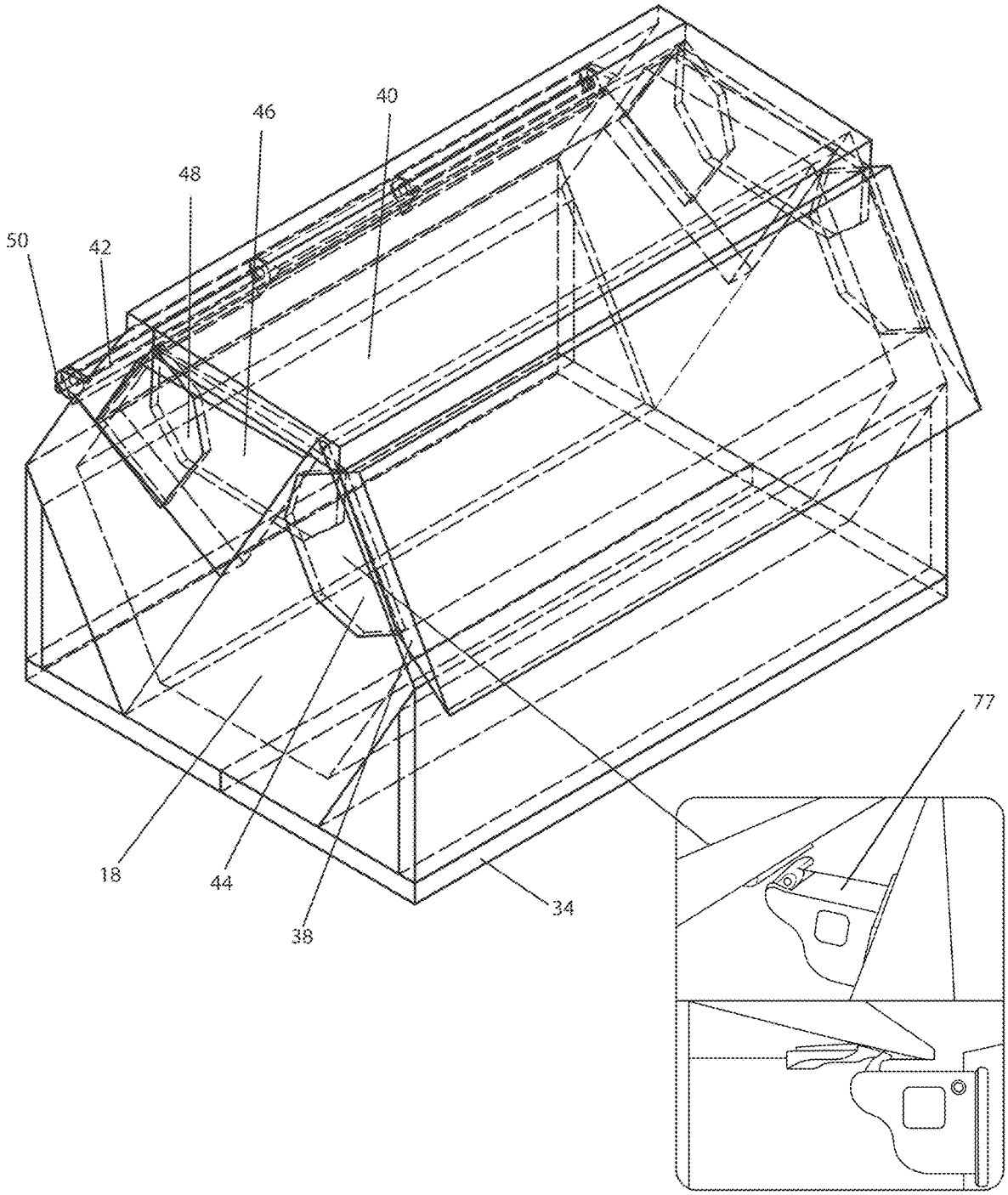
Figure 3A:
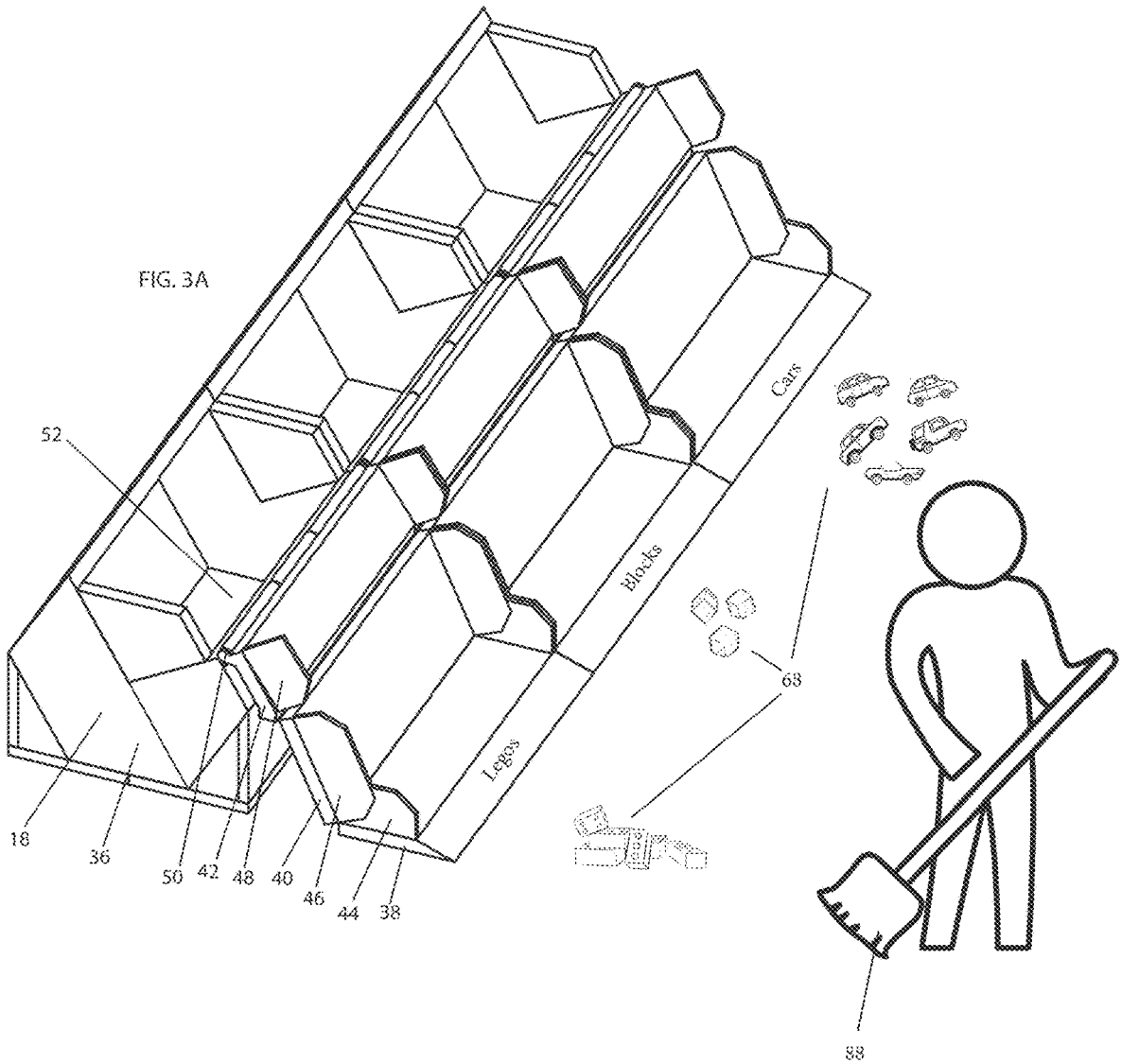
Figure 3B:
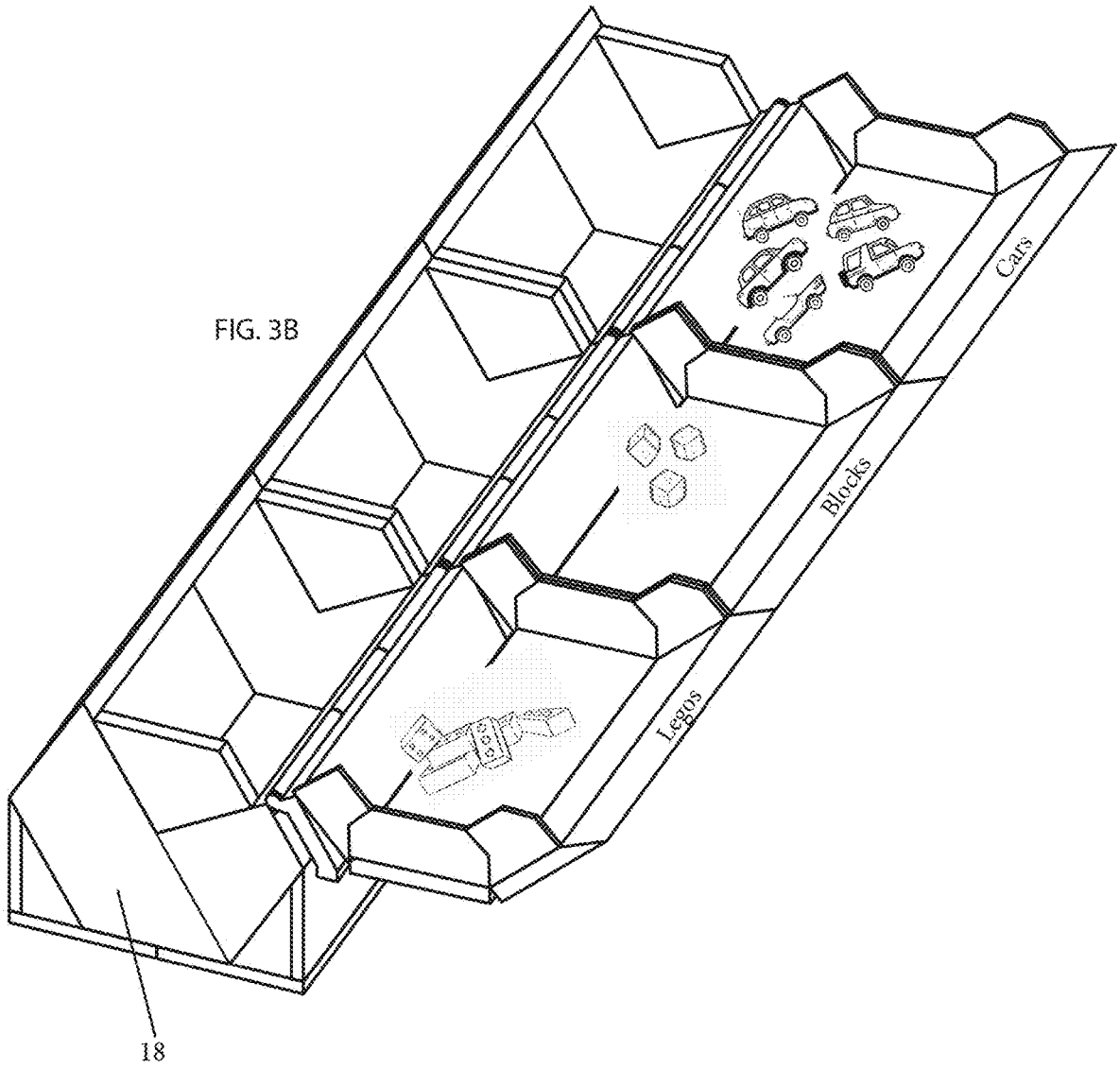
Figure 3C:
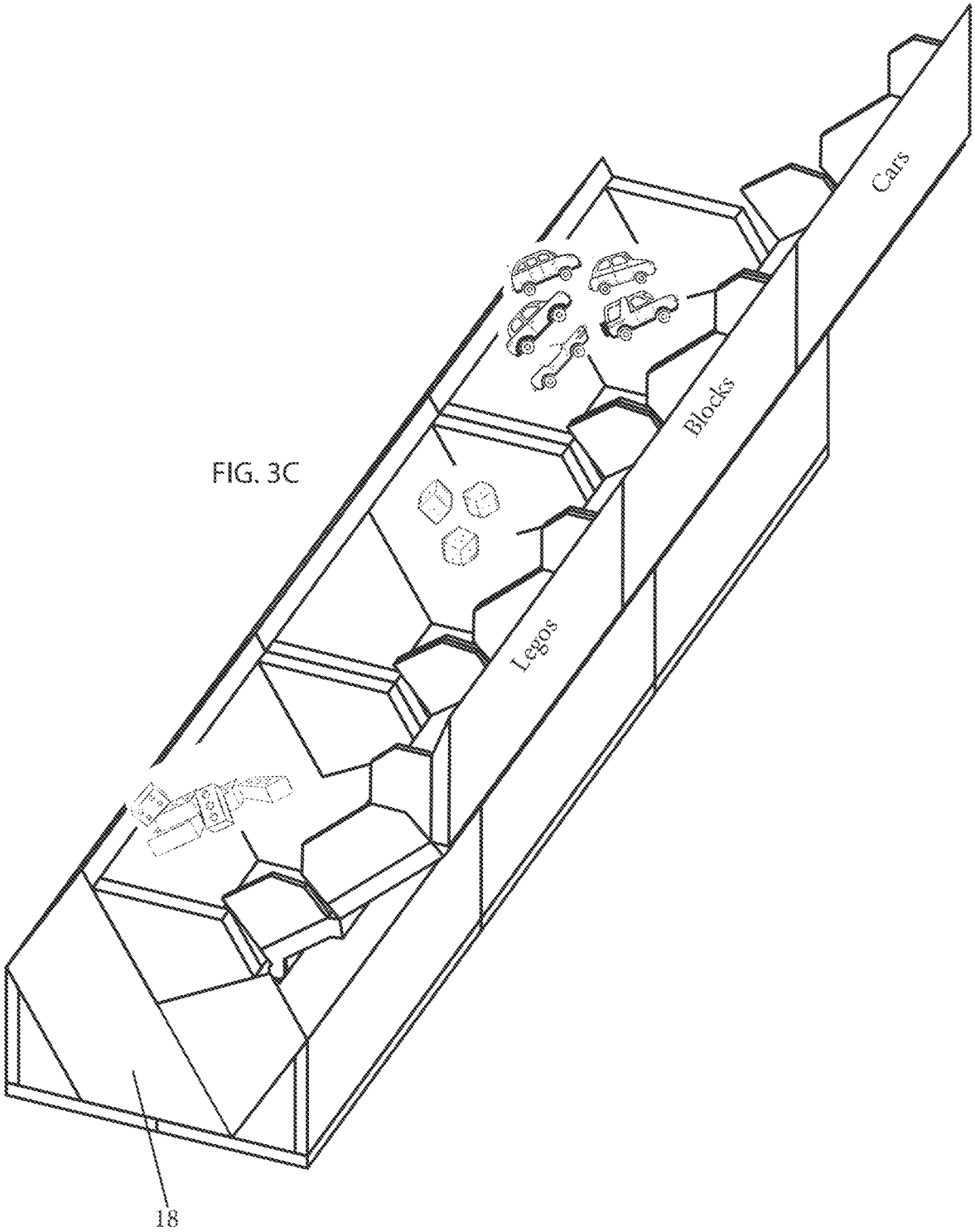
Figure 3D:
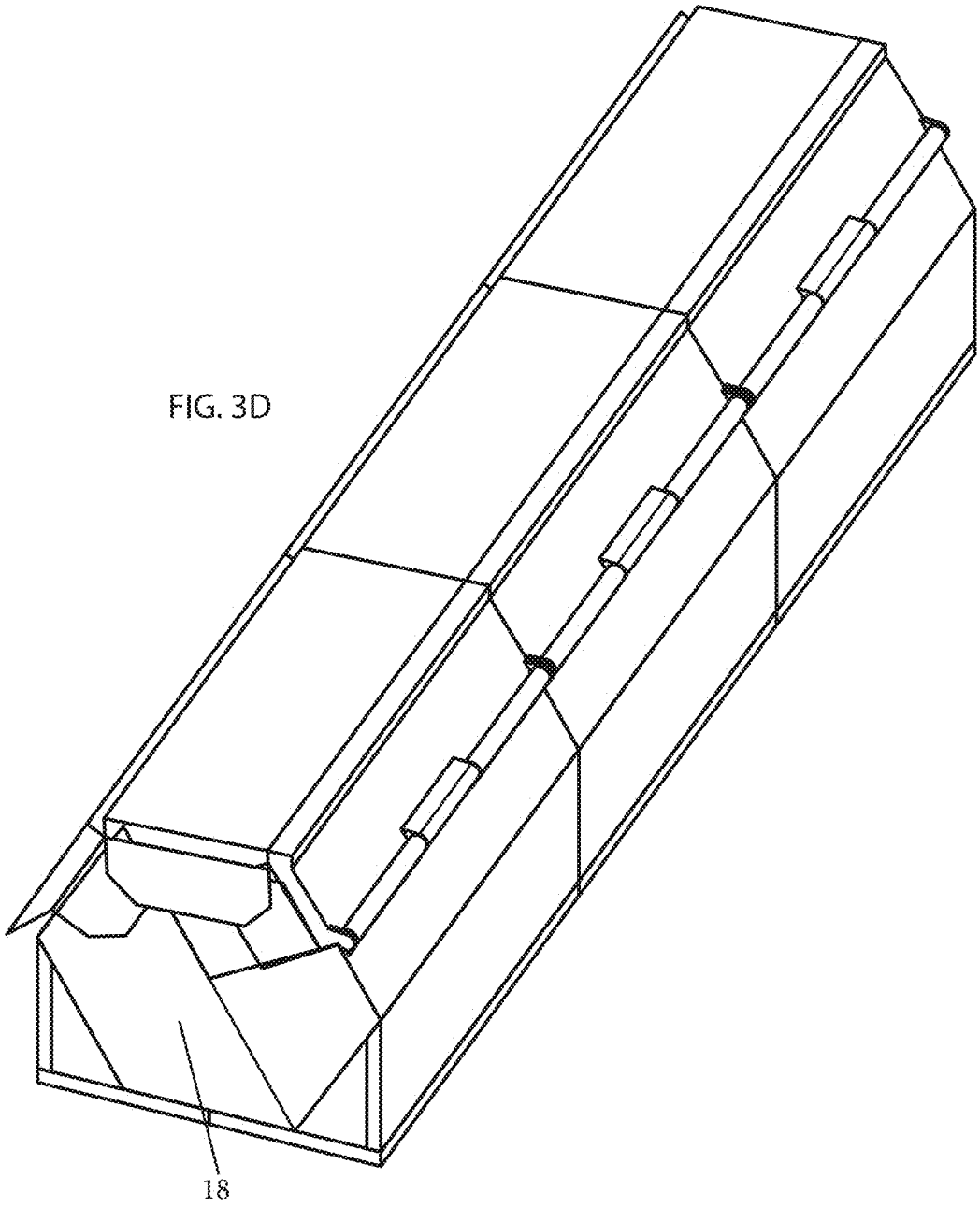

FIGS. 2A, 2B, and 2C show another perspective rear view of the system 18.

The system 18 will now be described in operation or use. FIG. 1C shows the hexagonal bin 36 closed or the system 18 in a closed configuration with the dustpan-like apparatus 38, the middle bin lid 40 and the top bin lid 42 closed over the top of the hexagonal bin 36, including over the bin opening 52. In FIG. 1B, a user 92 opens the hexagonal bin 36 by lifting the dustpan-like apparatus 38 towards the front of the hexagonal bin 36 manually or using a connected apparatus such as, but not limited to, a conventional lever, wheel, foot pedal, etc. (not shown). The user lifts the dustpan-like apparatus 38 towards themselves if they are standing in front of the hexagonal bin 36 or to the right if they are standing to the right of the hexagonal bin 36, and the middle bin lid 40, and the top bin lid 42 are also pulled up and away from the bin since they are all connected with a hinge 50 or alternate connecting mechanism. Alternatively, the user can open the hexagonal bin 36 by lifting the middle bin lid 40, or other portions of any of the lids.

In step 1, in a collection configuration as shown in FIG. 1A, the dustpan-like apparatus 38 is flipped over and the lip 39 is touching the ground or bottom surface. The user uses a broom 88 or other collection mechanism to sweep, gather, or collect a desired category of objects such as toys, toy parts, and other objects and debris 68 into the dustpan-like apparatus 38.

In step 2, once the user has completed collecting all of the relevant objects into the dustpan-like apparatus 38, the user returns the system 18 to the position shown in FIG. 1B by lifting up dustpan-like apparatus 38, the middle bin lid 40, or the top bin lid 42 or any other portion of the lids either manually or using a connected apparatus such as, but not limited to, a lever, wheel, foot pedal, etc. and flips the dustpan 38 back over the bin opening 52. As the dustpan 38 is flipped over, the objects inside of it are deposited into the hexagonal bin 36 and the dustpan 38, the middle bin lid 40, and the top bin lid 42 serve as the lid of the hexagonal bin 36.

In step 3, in the orientation shown in FIG. 1C, any one of the bin lids 40 or 42 or the dustpan-like apparatus 38 can optionally lock into place over the hexagonal bin 36 using a variety of conventional child-proof locking mechanisms 77 implemented using a variety of options including, but not limited to, magnetic child-proof locks, latch locks, etc. to prevent children from flipping open the bin lids 40 or 42 when it is desired that the bin's contents remain inaccessible to the child. Also, conventional magnet connectors or other connectors can be used on the sides of the dustpan-like apparatus 44, the sides of the middle bin lid 46, and the sides of the top bin lid 48 as well as the bin opening 52 and the hexagonal bin 36 to keep the respective lids held in place. The sides of the dustpan 44, the sides of the middle bin lid 46, and the sides of the top bin lid 48 all serve to minimize objects 68 from falling out as the dustpan-like apparatus 38 is lifted towards the bin opening 52.

FIGS. 3A-3D show a perspective front view embodying an additional embodiment/version of the system 18 featuring multiple side by side copies of the system 18. The operation of this second embodiment is the same as that described in the first embodiment, but, in this second embodiment, objects can be swept or otherwise collected into any one of the three dustpan-like apparatuses 38, thus allowing a user to sort multiple categories of objects into various bins. There can be any number of copies of the system 18, and in a variety of orientations and shapes. For example, the system 18 shown in FIG. 3A-3D can be re-configured to fit to be a part of, but not limited to, a variety of furniture categories, such as coffee tables, kids tables, dinner tables, ottomans, shelving units, cabinets, etc. Optionally, the dustpan-like apparatus 38, the middle bin lid 40, and the top bin lid 42 can be clicked into the respective dustpan-like apparatus 38, middle bin lid 40, and top bin lid 42 of the systems 18 located to their right or left, by connecting the respective sides of dustpan-like apparatus 44, sides of middle bin lid 46, and sides of top bin lid 48, or other portion of the lids, using conventional connection methods such as, but not limited to, latch clamps, magnetic catches, interlocking brackets, etc. so that the lids of multiple systems 18 can be lowered and lifted simultaneously. This can be maneuvered using a connected apparatus such as, but not limited to, a conventional lever, wheel, foot pedal, button, etc. (not shown). The ability to open and close the lids simultaneously creates a more efficient collection method for the user, and a more fun system 18 for children to interact with. Optionally, top bin lids 42 can be separated from the bin openings 52 so as to allow easier access to the objects within the hexagonal bins 36.

Thus, it can be seen that users of the system 18 will be able to sort, collect, and store objects more easily and quickly. Since sweeping is viewed as a fun game by children, they will be encouraged to participate in cleaning up their toys and learn sorting skills. Individuals will have an easier time organizing objects from the floor, minimizing bending and physical effort. Since the hexagonal bins are interchangeable, individuals can switch out the bins often, placing the unused bins in a storage shelf with hexagonal slots, for example, and thus keeping objects such as toys that are in the hexagonal bin that's in use, fresh for the child.

Figure 4A:
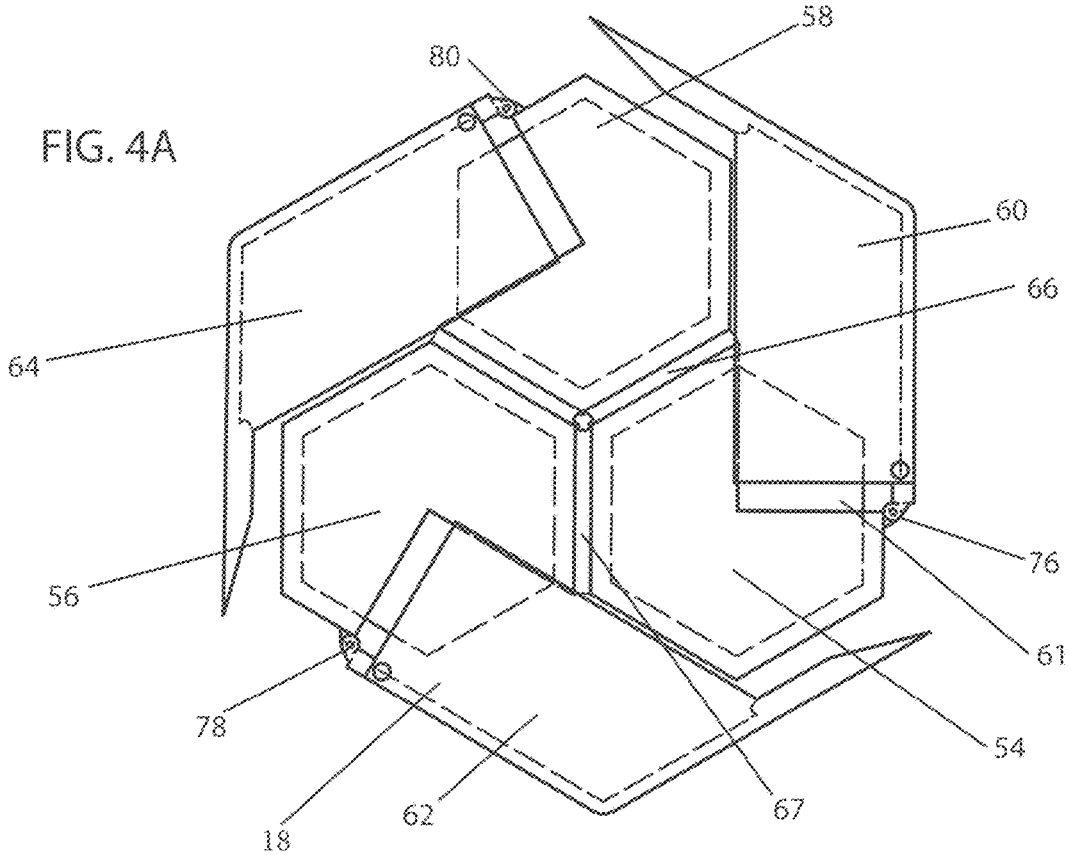
Figure 4B:
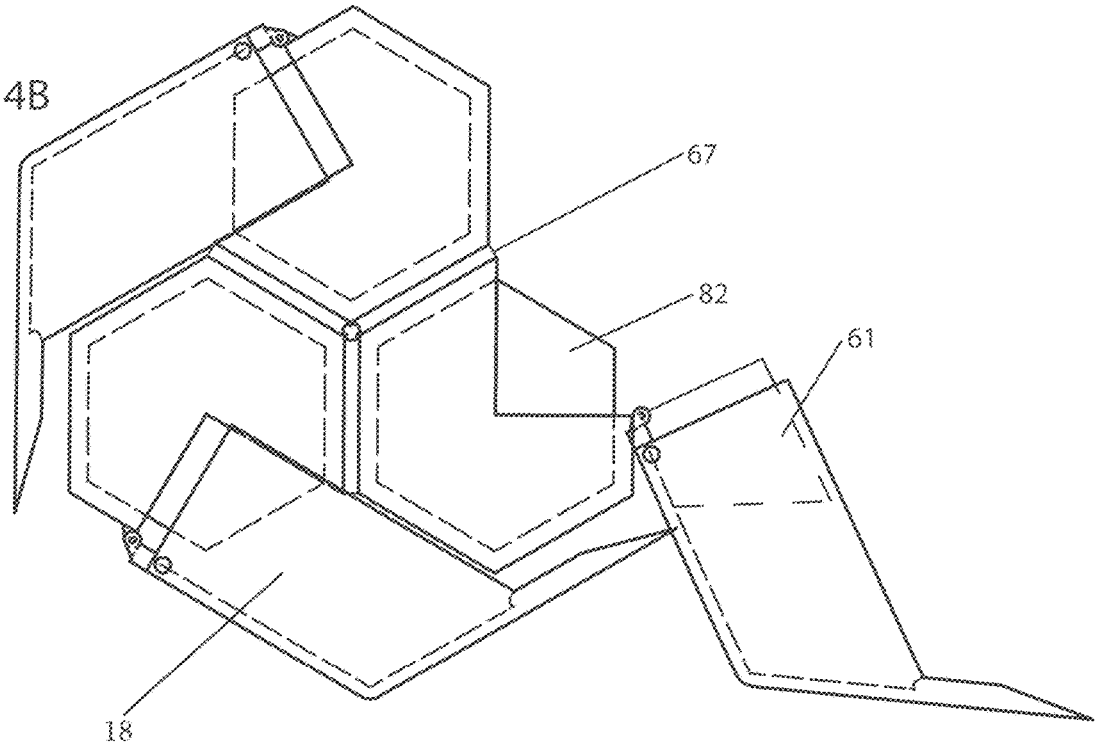
Figure 4C:
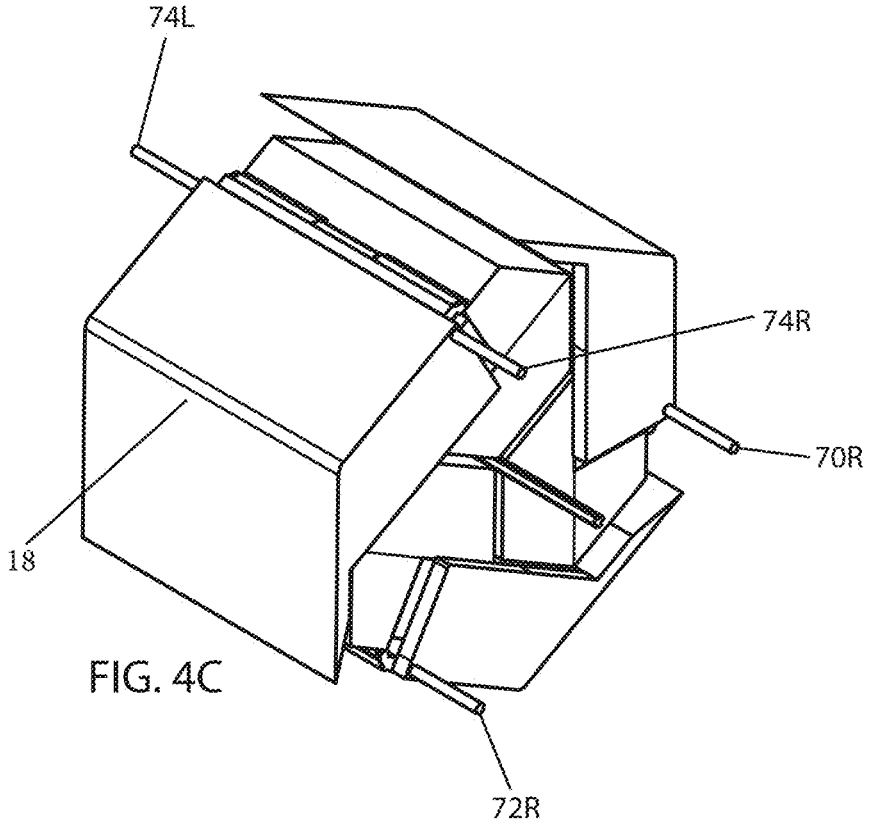
Figure 4D:
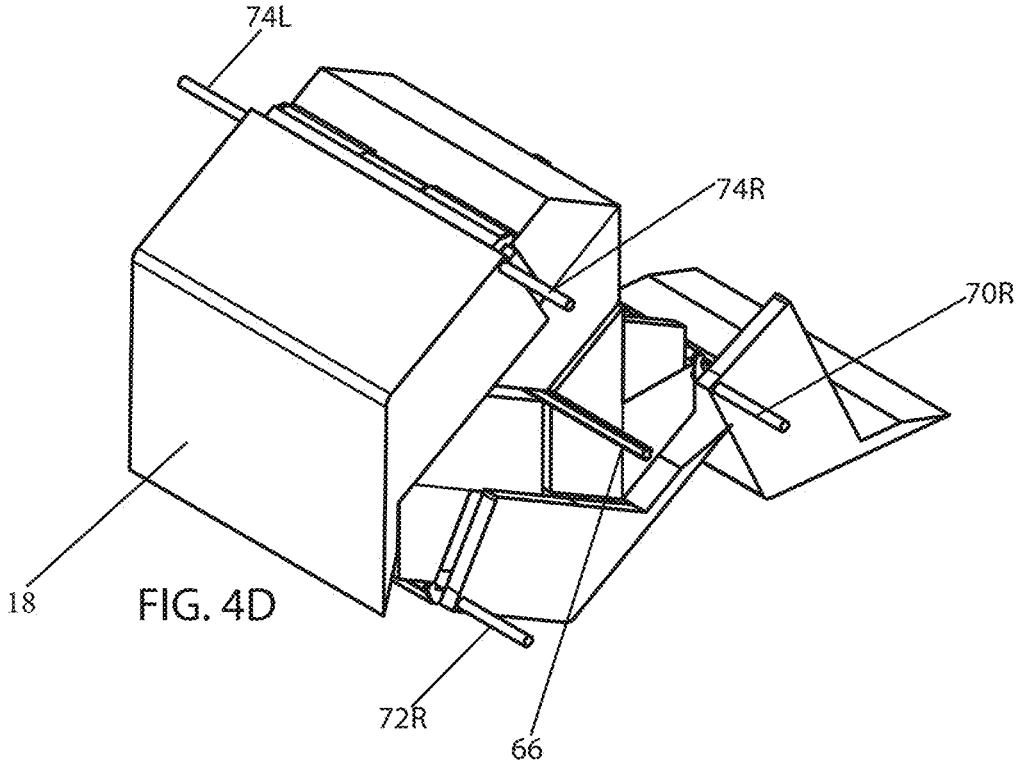
Figure 4E:
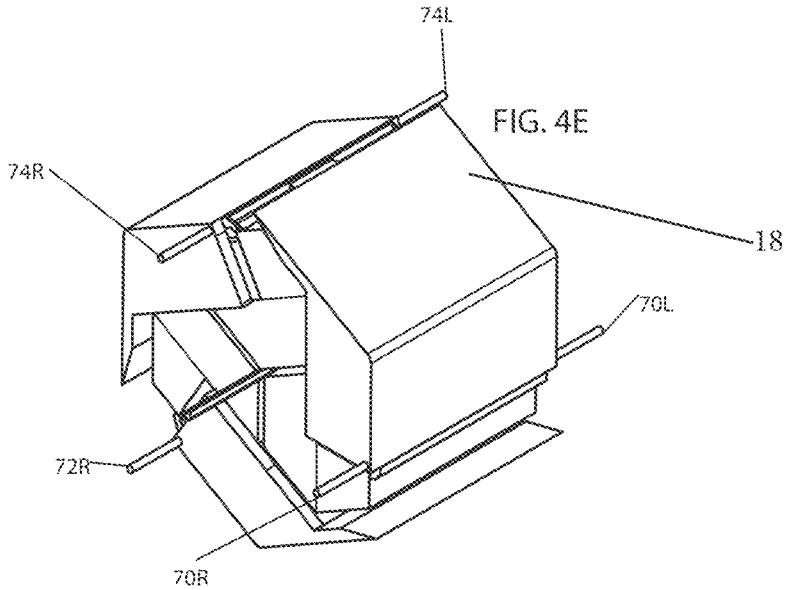
Figure 4F:
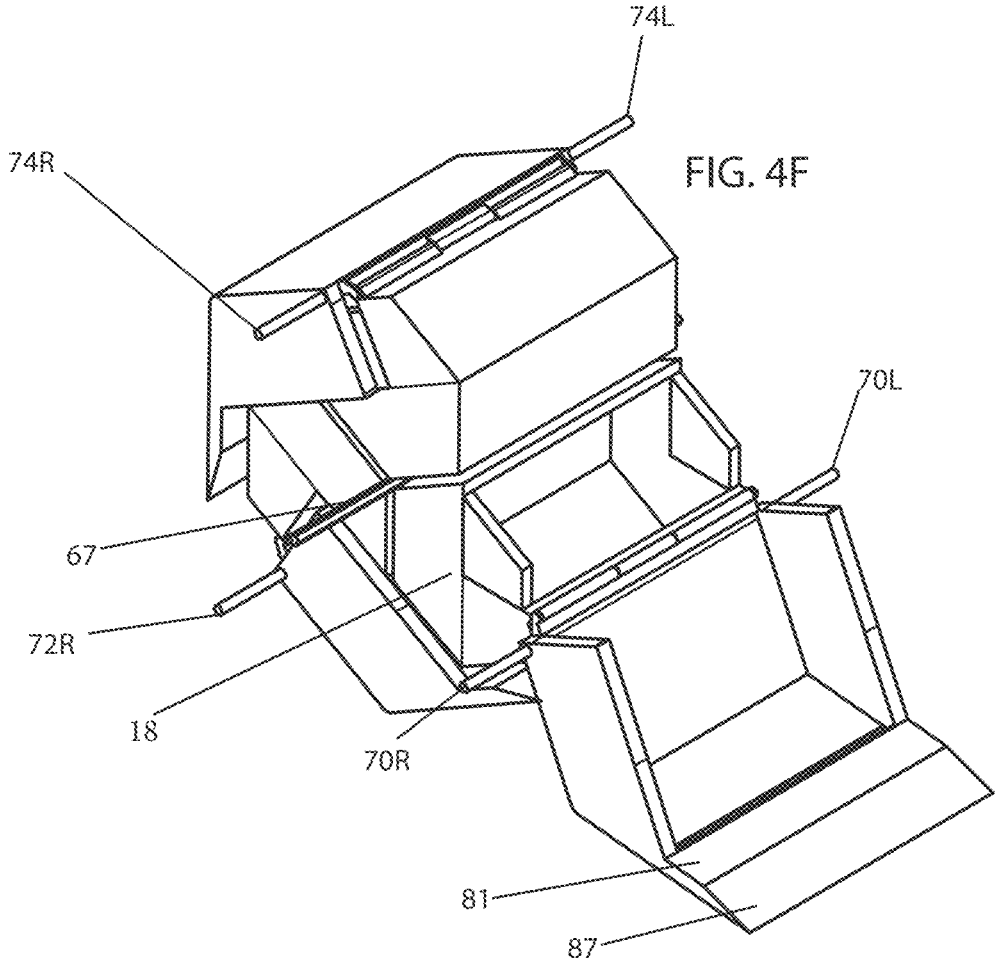
Figure 4G:
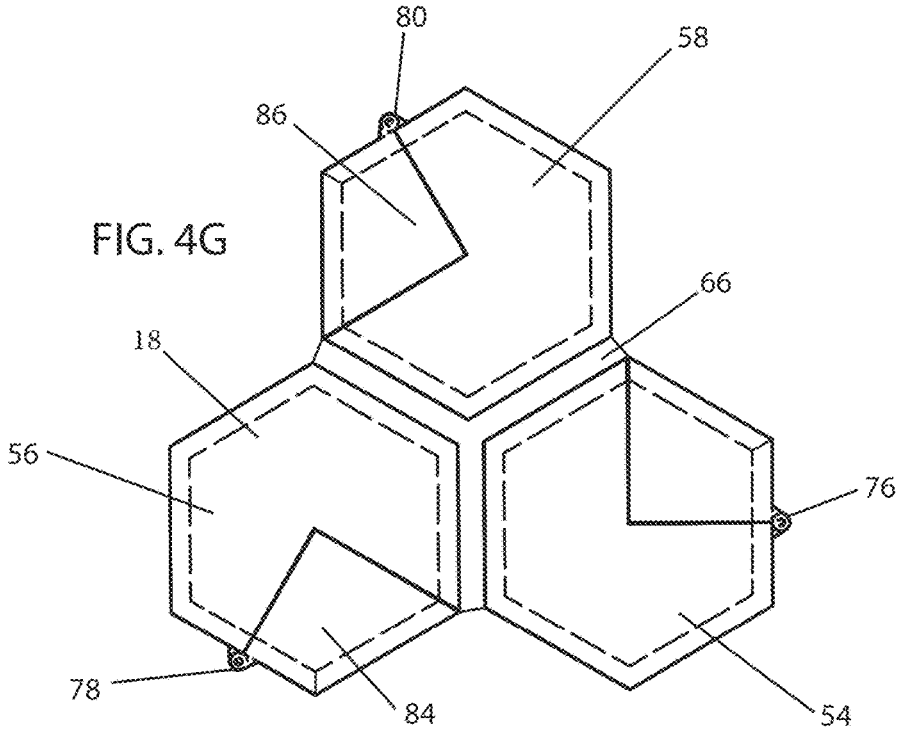
Figure 4H:
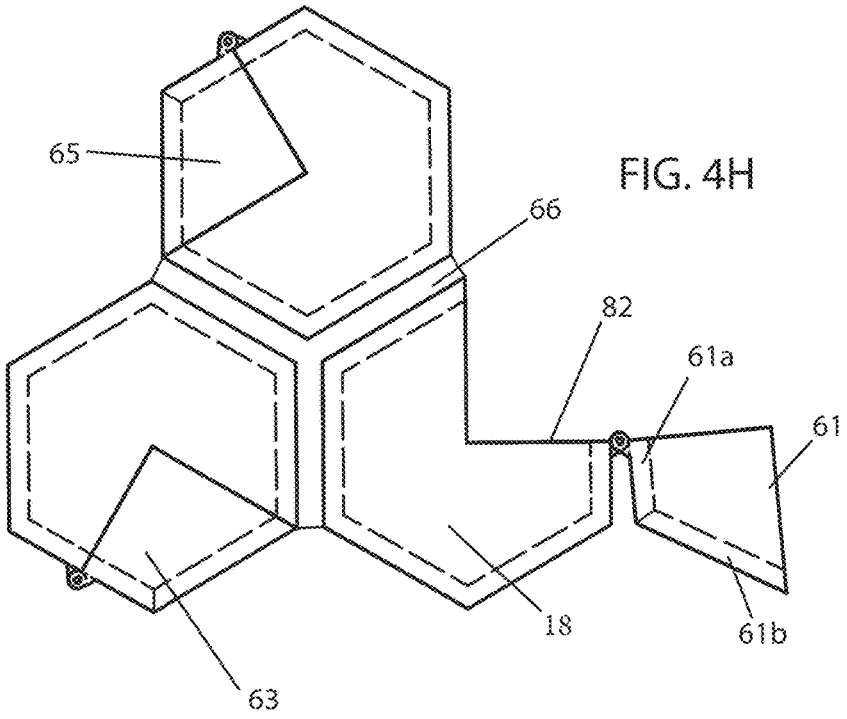
Figure 4I:
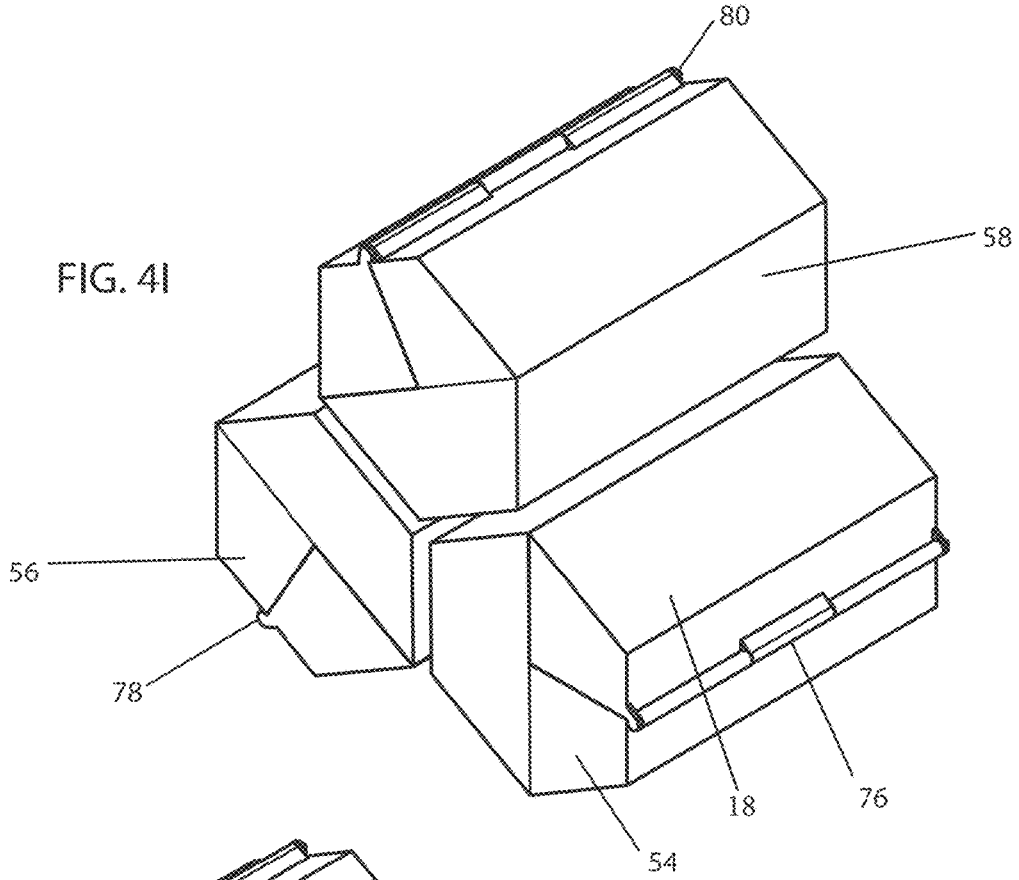
Figure 4J:
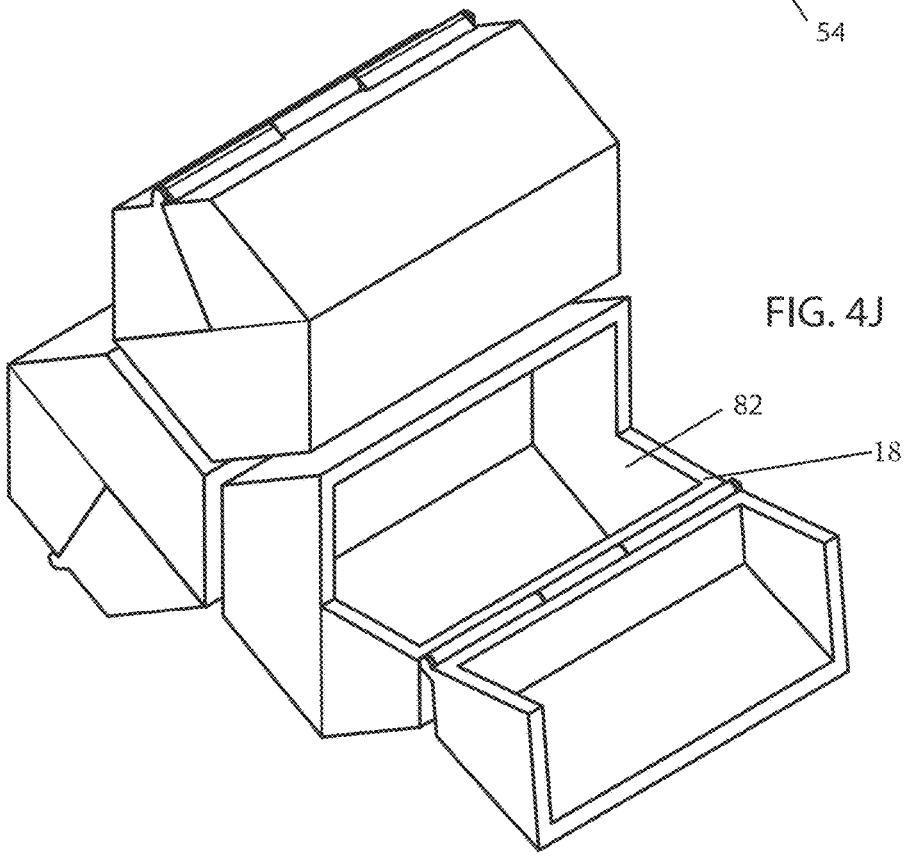

With reference to FIGS. 4A-4F, another embodiment of the system 18 for collection, sorting and storing of a variety of toys, toy parts, and other objects and debris 68 is shown in an elevated right side view in FIG. 4A and FIG. 4B. FIG. 4C and FIG. 4D are a perspective rear view of the same and FIG. 4E and FIG. 4F are a perspective front view of the same. FIG. 4G is an internal view of the inside of FIG. 4A and FIG. 4H is an internal view of the inside of FIG. 4B. FIG. 4I is a perspective front view of the inside of FIG. 4E and FIG. 4J is a perspective front view of the inside of FIG. 4F.

In FIG. 4A, three hexagonal bins include a first bin 54, a second bin 56, and a third bin 58. These bins are held together compactly with a y-like axel 66 that has three protruding arms 67 that hold the bins 54, 56, and 58 together using a temporary conventional click mechanism (not shown) or other connection mechanism, to allow the bins to be replaced with other bins when desired. The two sides of each bin 54, 56, and 58 that touch the protruding arm 67 can be clicked into and out of the respective surface of the y-like axel 66.

The first bin 54 has a lid 61 which is attached to the bin opening 82 using a hinge 76. The bottom edge of the lid 61 is connected with the hinge 76 or an alternate connecting mechanism, to the opening of the first bin 82 and allows the lid 61 to rotate around a fixed horizontal axis on the bottom front edge of the opening of the first bin 82.

The lid 61 rotates around the horizontal hinge of the first bin 76, changing its angle relative to the first bin 54 and moving upwards or downwards.

There is also a dustpan-like apparatus 60 temporarily attached to the hinge of the first bin 76. A variety of alternative methods can be used to attach the dustpan-like apparatus 60 to the hinge of the first bin 76.

There is an inner surface on the dustpan-like apparatus for the first bin 60 where there is a rubber lip 87. This surface is also called the scooping surface 81.

There is a conventional click mechanism (not shown) or other connection mechanism on the outer top portion of the lid for the first bin 61. This connection mechanism allows the lid for the first bin 61 to temporarily connect to and lie flat on the scooping surface 81 of the dustpan-like apparatus 60.

When the first bin's dustpan-like apparatus 60 is rotated upwards towards the third bin 58, the scooping surface 81 of the first dustpan-like apparatus temporarily clicks unto or otherwise connects to the top outer portion of the third bin 58.

When the user disconnects the scooping surface 81 of the first bin's dustpan-like apparatus 60 from the top outer portion of the third bin 58, the dustpan-like apparatus 60 rotates downwards towards the ground, and the bin lid for the first bin 61 moves with it, thus revealing the opening of the first bin 82.

Alternatively, the shape of the first bin's dustpan-like apparatus 60 and the shape of the first bin lid 69 can be modified to allow them to connect in other methods.

The same features and functionalities are replicated respectively for the second bin 56 and the third bin 58 and all of their respective parts.

In FIG. 4C and FIG. 4D, there is a right handle 70R and a left handle 70L for dustpan-like apparatus 60 that is permanently attached to and protrudes horizontally from the dustpan 60. Likewise, there is a right handle 72R and a left handle 72L for dustpan-like apparatus 62 that is permanently attached to and protrudes horizontally from the dustpan 62. Finally, there is a right handle 74R and a left handle 74L for dustpan-like apparatus 64 that is permanently attached to and protrudes horizontally from the dustpan 64.

Figure 5A:
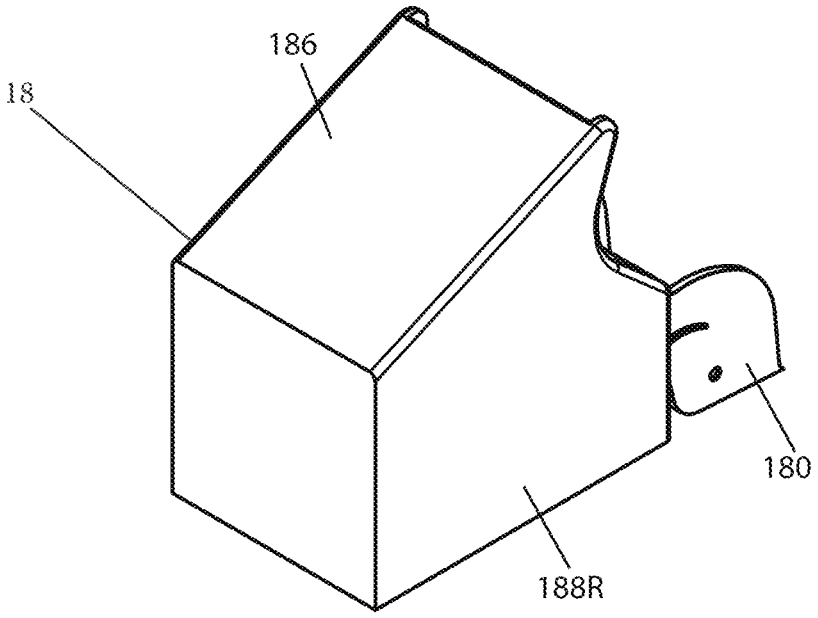
Figure 5B:
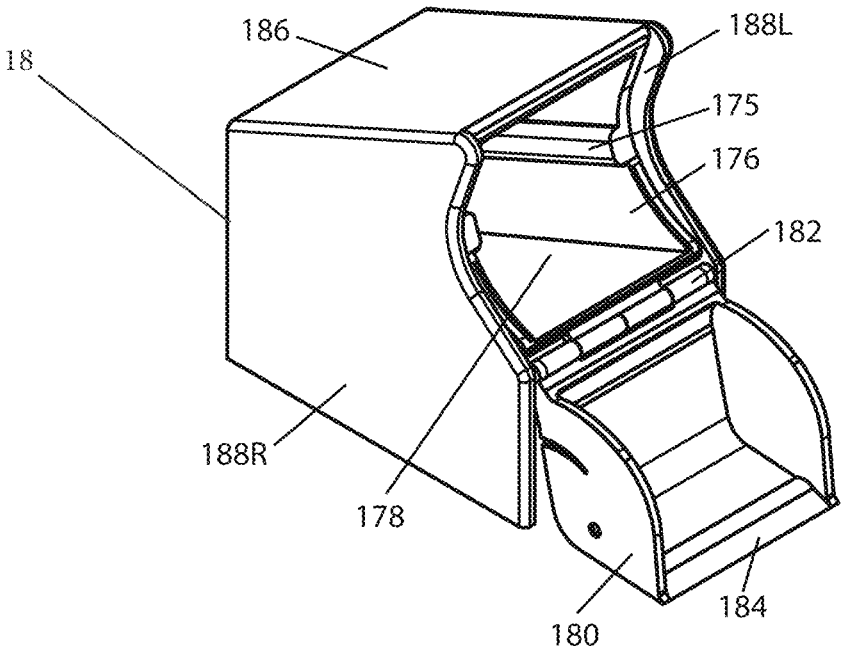
Figure 5C:
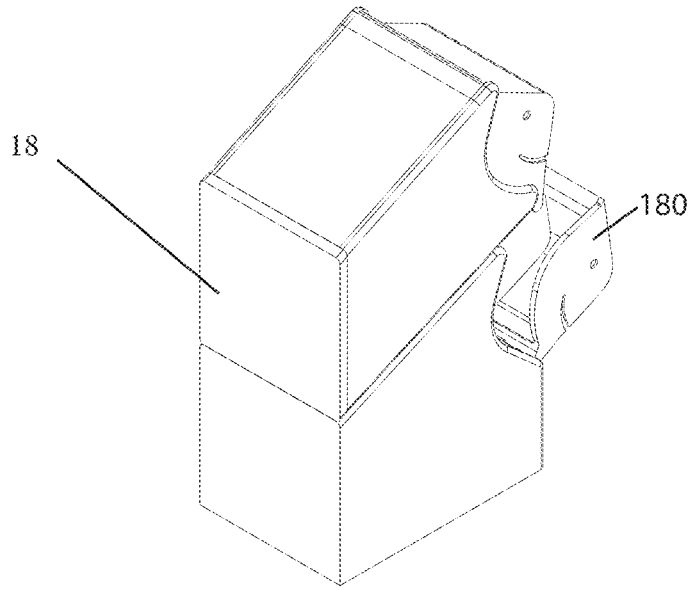
Figure 5D:
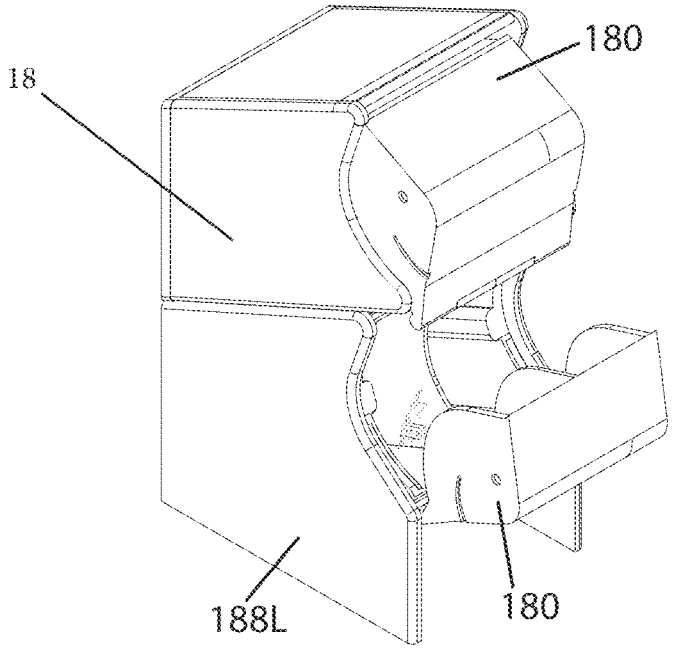
Figure 5E:
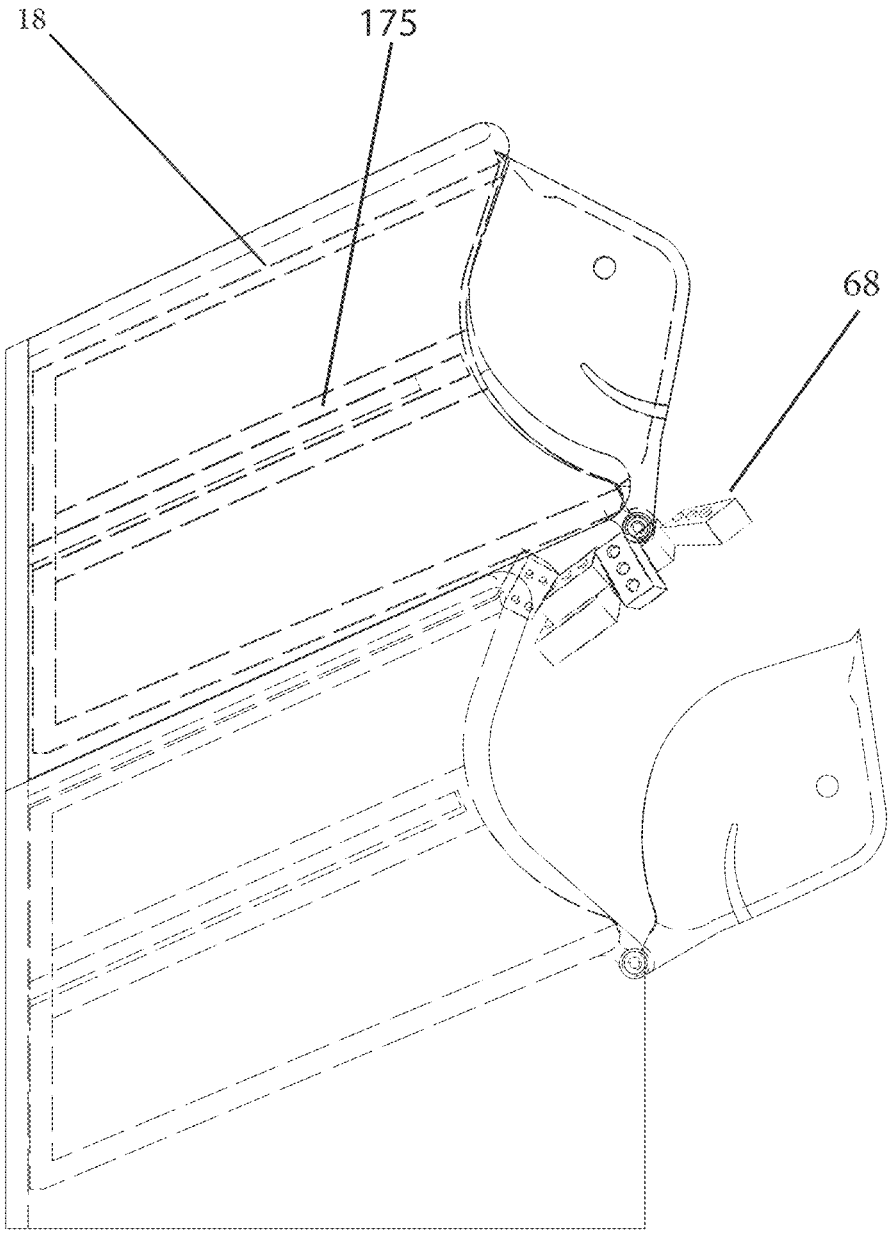
Figure 5F:
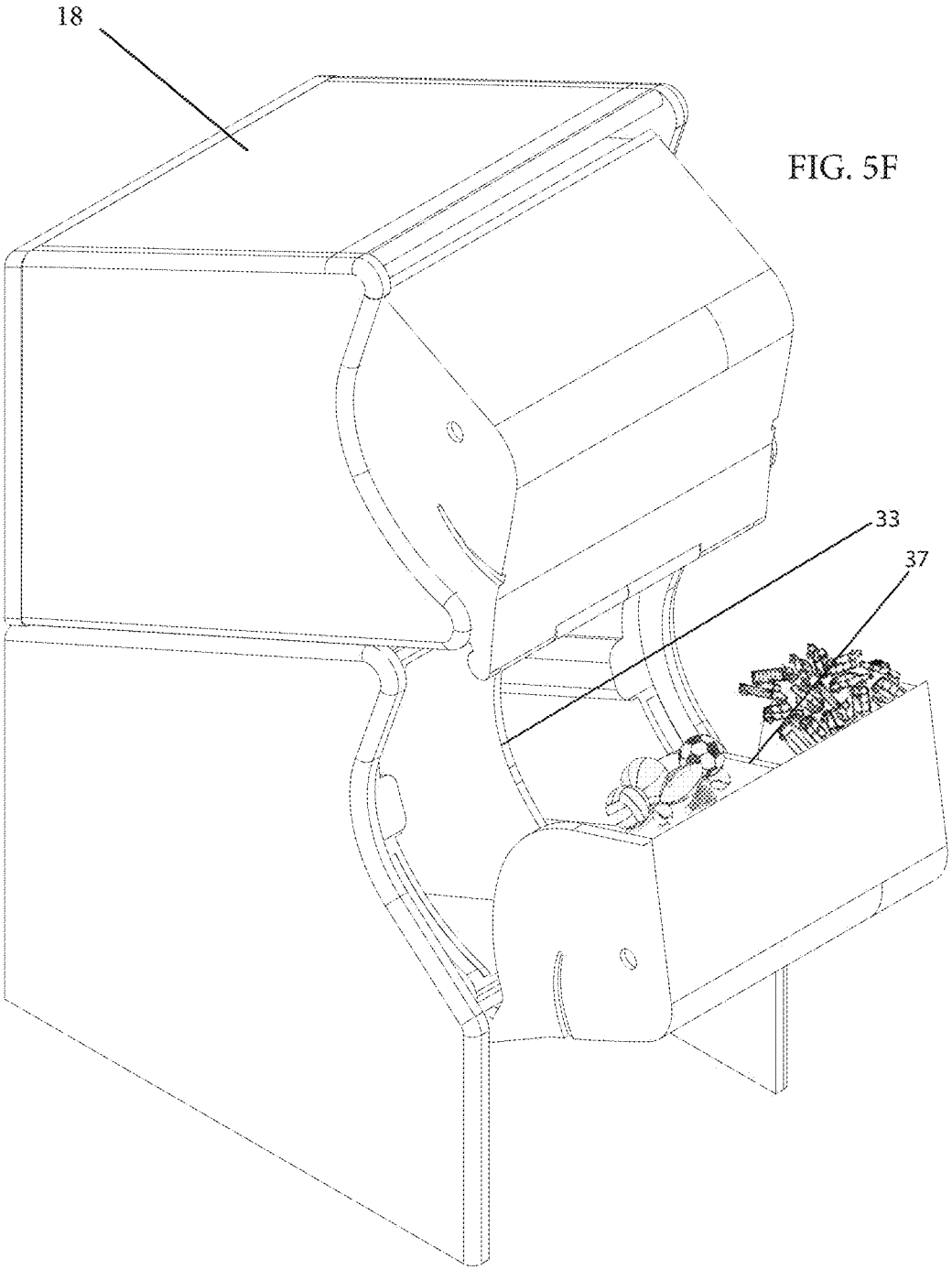
Figure 5G:
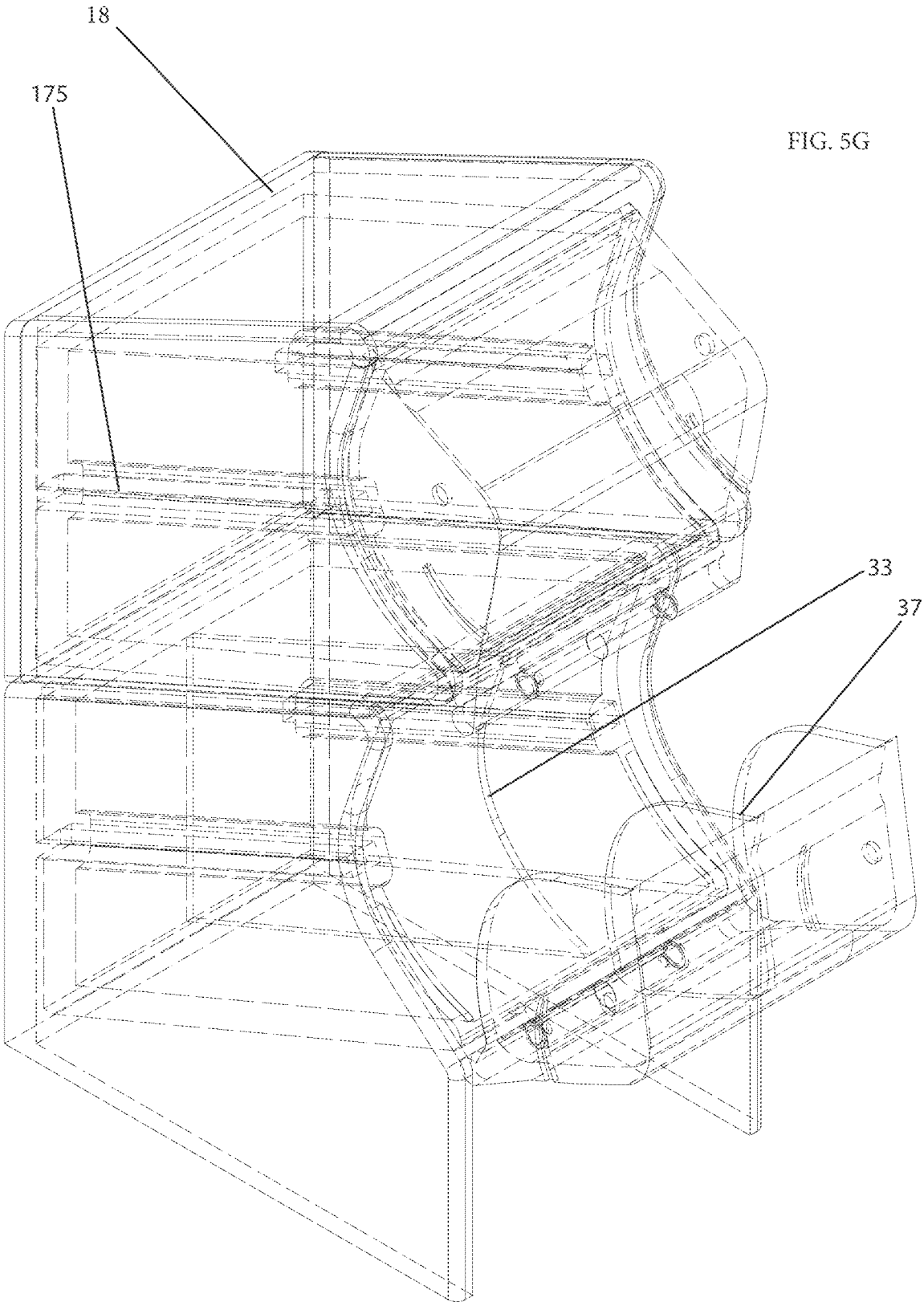
Figure 5H:
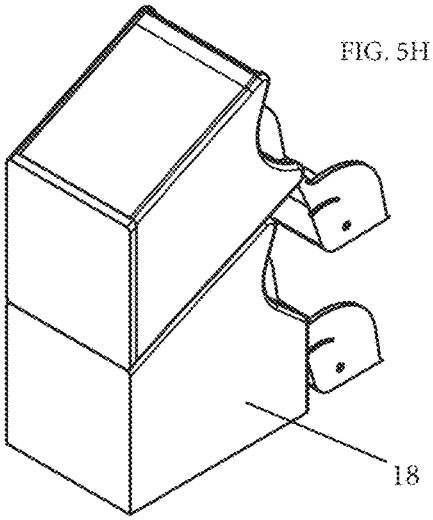
Figure 5J:
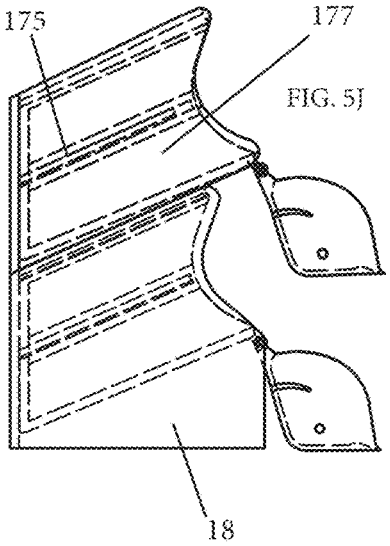
Figure 5I:
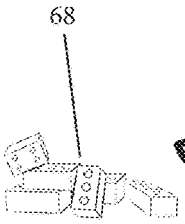
Figure 5I:
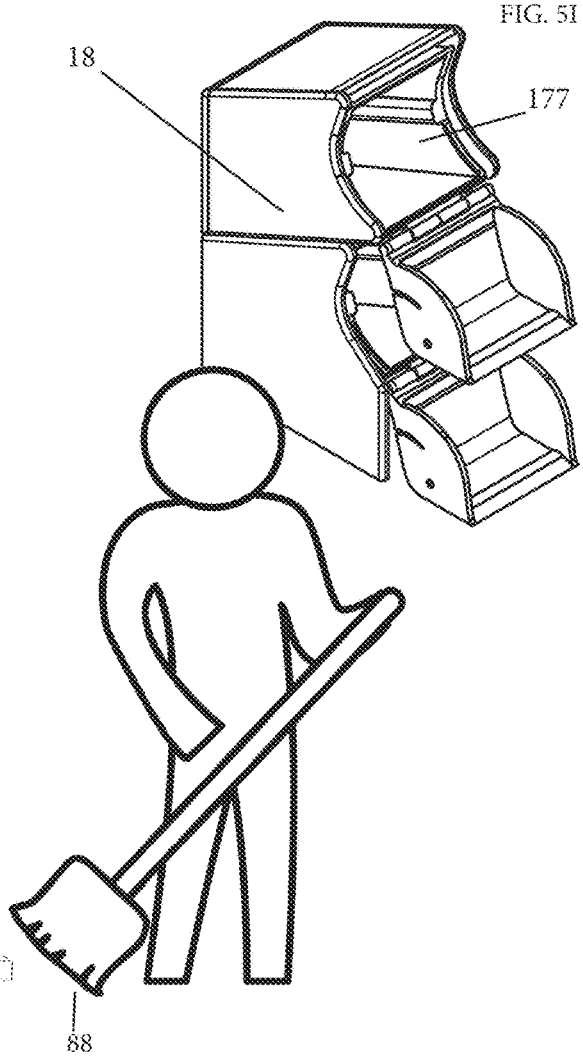
Figure 5K:
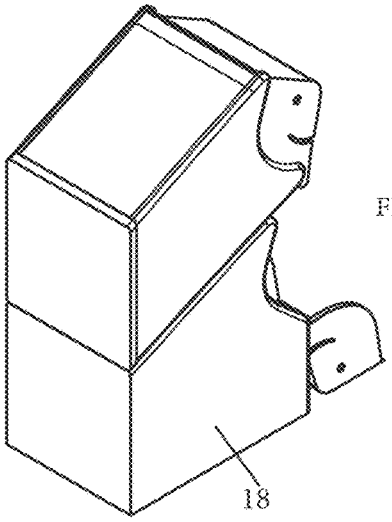
Figure 5L:
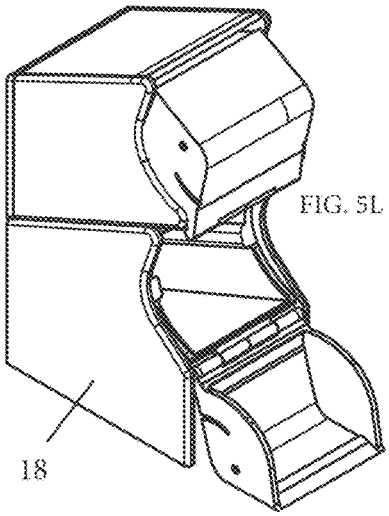
Figure 5M:
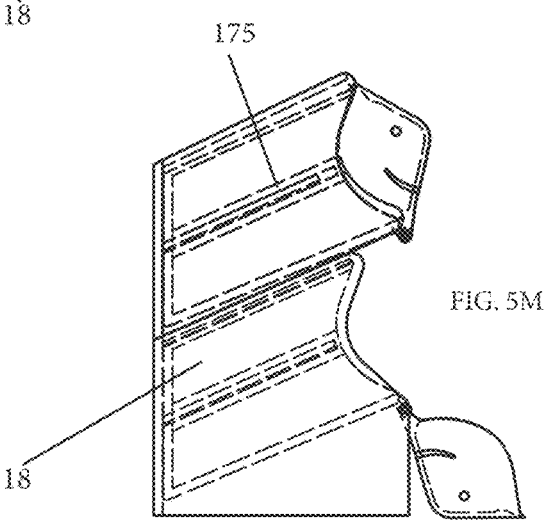
Figure 5Q:
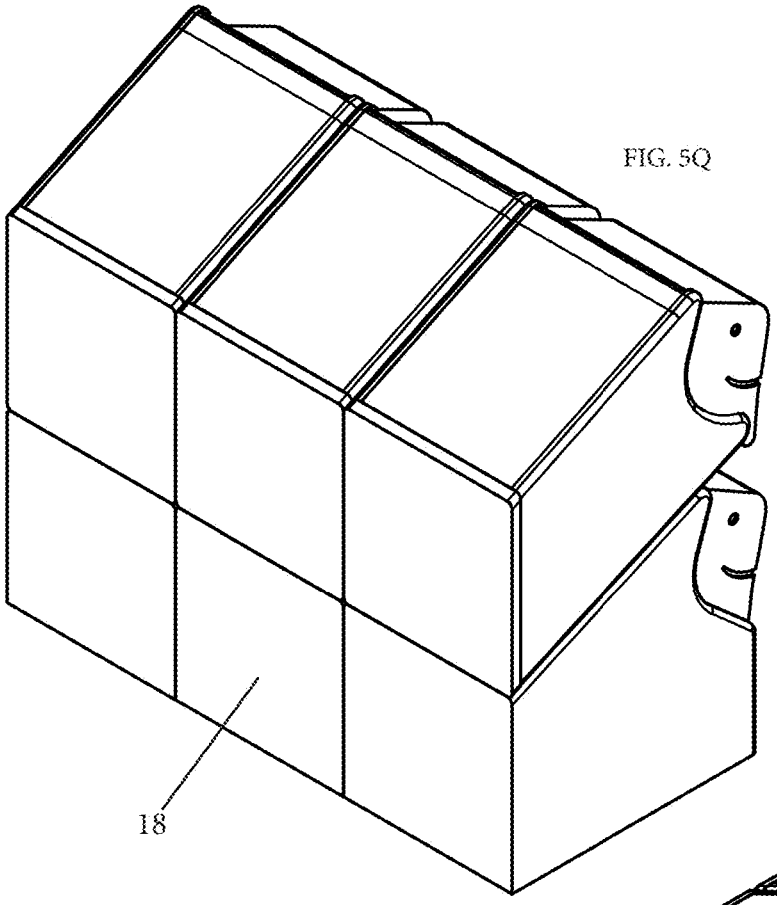
Figure 5R:
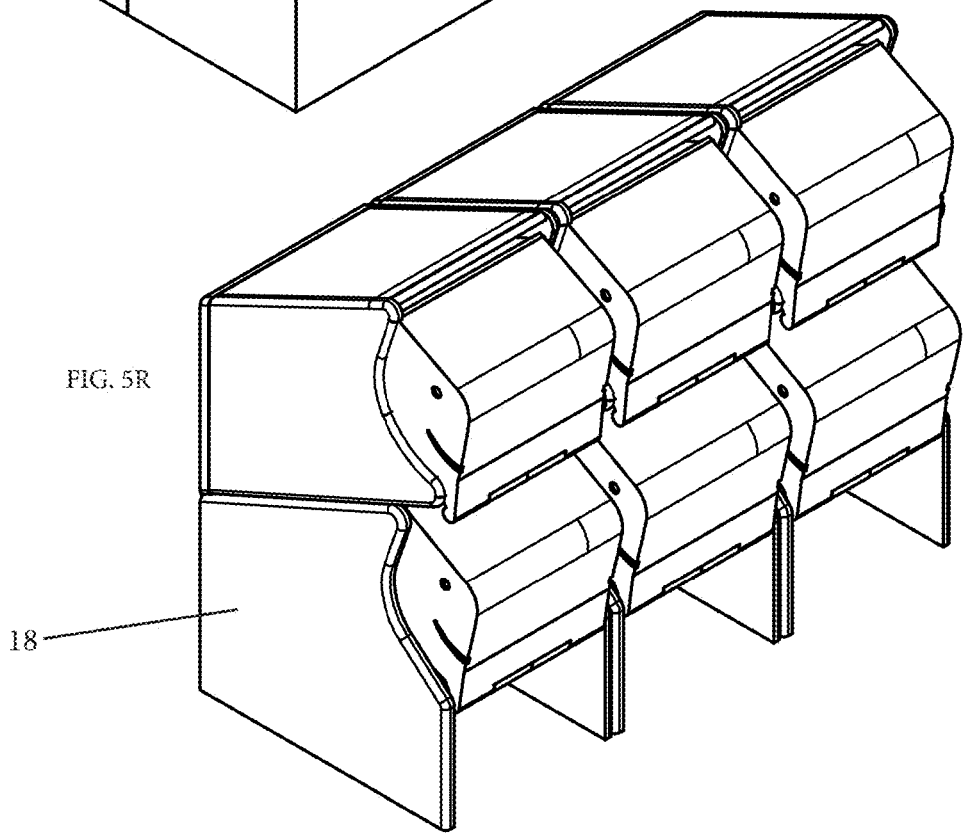
Figure 5U:
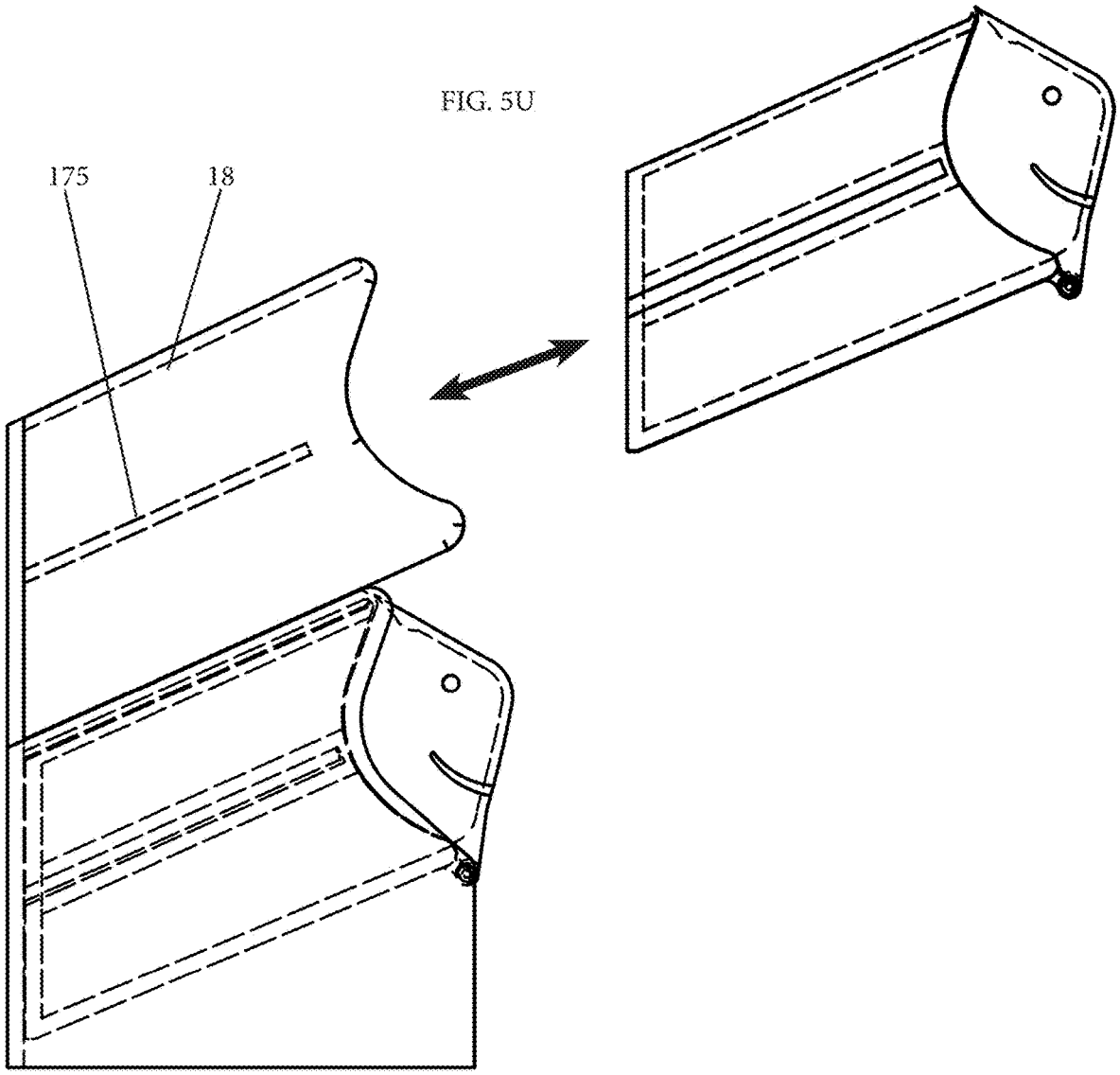
Figure 5V:
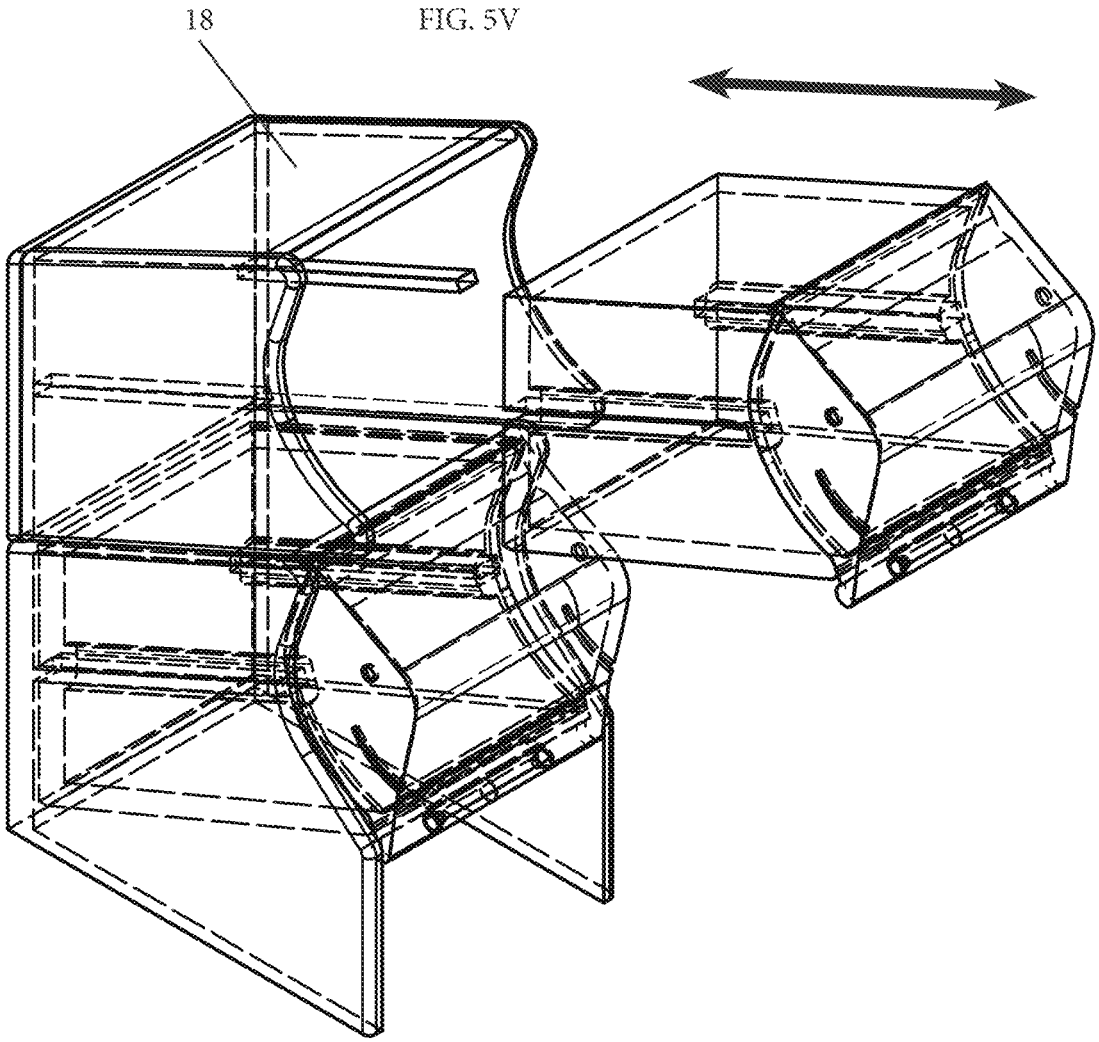

FIGS. 5A-5V depict detailed views of an alternative version of a multi-bin system 18 for sorting and storage and illustrates configurations with single bins, stacked bins, and side by side bins, showing lids in open, closed, and intermediate positions for sorting and storage, in which FIGS. 5E, 5G, 5J, 5M, 5P, and 5S-5V illustrate hidden line views of internal components and sorting mechanisms. FIGS. 5U-5V demonstrate bin removal and reinsertion into a cabinet structure.

In FIGS. 5A-5V, a still further embodiment of the system 18 for collection, sorting and storing of a variety of toys, toy parts, and other objects and debris 68 is shown. FIG. 5A is a perspective back side view featuring a bin 176 that is positioned in a tilted fashion with the front portion of the bin lifted upwards. FIG. 5A-5B feature the bin 176 with its opening 178 at the front and a lid 180. The lid 180 is attached with a conventional hinge 182 connected at the bottom of the lid 180 to the bottom edge of the bin opening 178. The hinge 182 allows the lid 180 to rotate around the bottom edge of the opening 178 so that the lid 180 can fully close the bin opening 178 when the lid 180 is lifted up as well as rotate towards the ground to serve as a dustpan-like apparatus for collecting objects 68 into the bin.

In this example, the bin is attached to a stand 186 with a right side 188R and a left side 188L. The sides 188 are higher towards the front of the bin than at the back so as to support the bin in a tilted fashion. The front portion of the bin must be tilted high enough off the ground to allow the bin's lid to open and close at the front of the bin but low enough to the ground to enable the lid to be used as a dustpan-like scooping apparatus when its flipped open and touches the ground or other flat surface.

The bin lid 180 is shaped like a dustpan.

The bin 176, bin opening 178, bin lid 180, stand 186, and stand's sides 188, and any of the connecting sides or parts can be made from a variety of materials and sizes and with a variety of shapes and connectors to allow the scooping function to occur.

A variety of connecting apparatus such as, but not limited to, a lever, wheel, foot pedal, etc. can be used to minimize the need for a user bending to open and close the lid 180.

A conventional lip 184 made of rubber or a variety of other materials is at the surface of the lower front end of the bin lid 180. When the bin lid 180 is in the position touching the floor as seen in FIG. 5A to 5B, the lip 184 is on the surface of the lid 180 and no gap exists between the bin lid 180 and the ground, or any other surface unto which the system 18 is placed. The lip 184 is typical in design to a conventional dustpan rubber lip. The lip 184 may be affixed permanently to the lid 180 or it may be replaceable when necessary. The stand 186, stand sides 188, bin lid 180, and bin 176 can be made out of a variety of materials, including but not limited to plastic, wood, and metal.

The stand 186 and bin 176 may be separable from each other so that bin 176 may be replaced with another bin, for compact storage, and for cleaning. Alternatively, the stand 186 and bin 176 may be permanently connected as one piece. Optionally, bin lid 180 can be separated from the bin opening 178 so as to allow easier access to the objects within the bin 176, for example, when a child wants to play with the toys inside the bin. Alternatively, the entire system 18 can be turned around to allow individuals to access the bin's contents without the bin lid in the way by adding an opening flap (not shown) on the top surface of the bin 176 and/or stand 186. The stand's sides 188 may optionally have a base connecting them and providing bottom support for the bin 176. The stand's sides 188 may optionally have wheels (not shown) on the bottom to allow a user to more easily maneuver the system 18. It's possible for a lid in a variety of other shapes to be connected directly with a conventional hinge or other mechanism to the front edge of a stand base (not shown) and for the bin 176 to have its own lid connected with a conventional hinge at the top edge of the bin 176 or elsewhere. This would allow for the bin 176 to not use its lid as a dustpan-like apparatus, but rather use the dustpan-like apparatus that is connected directly to the front edge of the stand's base (not shown) as a scooping mechanism on the stand which would, in turn, allow the bin 176 to be easily replaceable with other bins.

FIG. 5C to 5V show additional views embodying the above alternate version of the system 18 featuring multiple rows and/or columns of this embodiment. A top stand 187 is placed on top of the bottom stand 186 shown in FIGS. 5A-5B using conventional clicking methods or a variety of other connection methods. Alternatively, the top stand 187 can simply be a part of the bottom stand 186. The top stand 187 is similar in its tilted design to the bottom stand 186 but is shorter in height to allow for a snug fit on top of the bottom stand 186. A top bin 177 identical in size to the bottom bin 176, is placed inside of the top stand 187 and a bottom bin 176 is placed inside of the bottom stand 186 using rails 175 similar to those found in conventional drawers or other conventional sliding mechanisms. This allows bins 176 and 177 to be replaced as users 92 desire to have access to different objects 68 within those bins. The modular bottom stand 186 and top stand 187 provide the user 92 with controlled access to objects 68 within a variety of bins 176 and 177.

FIG. 5N to 5T show the bin 176 closed with the bin's lid 180 closed in the front over the opening 178 of the bin 176. In FIG. 5C to 5G, a user 92 (not shown) opens the bin 176 by pulling down the bin's lid 180 towards the front of the bin 176 and downwards, either manually or using a connected apparatus such as, but not limited to, a conventional lever, wheel, foot pedal, etc. (not shown). The user pulls down the bin's lid 180 towards themselves if they are standing in front of the bin 176.

In a method of operation/use, in step 1, as shown in FIG. 5H to 5M, the bottom bin's lid 180 is flipped over and the lip 184 is touching the ground or bottom surface. The user uses a broom 88 or other collection mechanism to sweep, sort, and collect a desired category of objects such as toys, toy parts, and other objects and debris 68 into the bin's lid 180. In FIGS. 5H to 5J, the lid 180 of the top bin 177 is also flipped over, thus providing the user with access to the objects 68 within the top bin 177.

In step 2, once the user has completed collecting all of the relevant objects into the bin's lid 180, the user returns the system 18 to the position shown in FIG. 5C to 5G by lifting up the bin lid 180 either manually or using a connected apparatus such as a lever, wheel, foot pedal, etc. and flips the bin lid 180 over the bin's opening 178. As the bin's lid 180 is lifted up, the objects 68 inside of it are deposited into the bin 176 and the bin's lid 180 serves as the lid of the bin 176.

In step 3, in the orientation shown in FIG. 5N to 5T, the bin's lid 180 can lock into place over the bin 176 using a variety of conventional child-proof locking mechanisms (not shown) implemented using a variety of options including magnetic child-proof locks, latch locks, etc. to prevent children from flipping open the bin lid 180 when it is desired that the bin remain inaccessible to the child. Also, conventional magnet connectors can be used on the sides of the bin lid 180, as well as the bin opening 178 and the bin 176 to keep the respective lid held in place.

The bowl-like shape of the bin lid 180, serves to minimize objects 68 from falling out as the bin lid 180 is lifted towards the bin opening 178.

FIGS. 5Q to 5T show multiple rows and columns of the bins 176 shown in FIG. 5A to 5B. The operation of this embodiment should be the same as that shown and described in FIG. 5A to 5P but in this embodiment, objects can be swept or otherwise collected into any one of the first row's bin's lids 180, thus allowing a user to sort multiple categories of objects into various bins. There can be any number of copies of the system 18, and in a variety of orientations. For example, the system 18 shown in FIG. 5A to 5B can be re-configured to fit to be a part of, but not limited to, a variety of furniture categories, such as coffee tables, kids tables, dinner tables, ottomans, shelving units, cabinets, etc. Optionally, the bin lid 180, can be clicked into the bin lids 180 of the bins 176 located to their right or left, by connecting the respective sides of bin lid 180, or other portion of the lids, using conventional connection methods such as, but not limited to, latch clamps, magnetic catches, interlocking brackets, etc. so that the lids of multiple bins 176 can be lowered and lifted simultaneously. This can be maneuvered using a connected apparatus such as a conventional lever, wheel, foot pedal, button, etc. (not shown). The ability to open and close the lids simultaneously creates a more efficient collection method for the user, and a more fun system 18 for children to interact with. Optionally, bin lids 180 can be separated from the bin openings 178 so as to allow easier access to the objects 68 within the bins 176.

FIGS. 5U-5V demonstrate bin 176 removal and reinsertion into the cabinet or stand 186 structure using conventional drawer rails 175 or other connection mechanism. This allows bins 176 to be switched out with other bins 176 (for example, in order to create a rotation of toys for children).

FIGS. 6A-6F illustrate elevated and perspective views of an embodiment of an individual bin 176 that may be utilized as a stand-alone unit or inserted into the cabinet structure depicted in FIGS. 5A-5V. These figures demonstrate the lid 180 transitioning between open, closed, and intermediate positions, facilitating object collection, sorting, storage, and access to the bin's contents. The portable nature of the bin 176 allows a child, for example, to move the bin 176 around to wherever they wish to play with the toys contained within the bin 176.

Figure 6A:
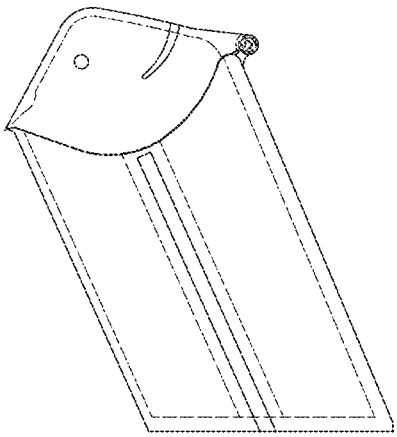
FIGS. 6A-6F illustrate elevated and perspective views of an embodiment of an individual bin that goes into the cabinet of FIGS. 5A-5V and show the lid transitioning between open and closed positions for object collection and secure storage.
Figure 6B:
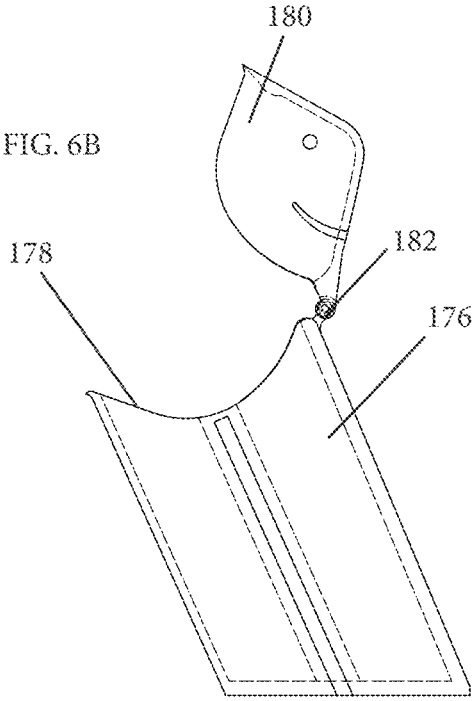
Figure 6C:
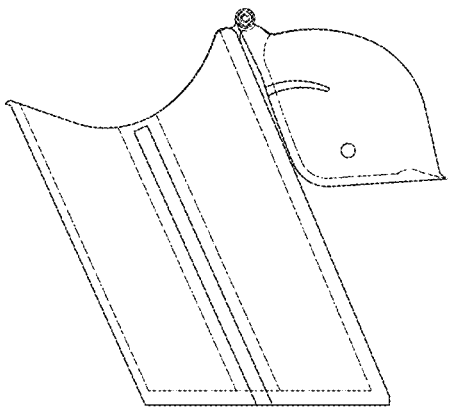
Figure 6D:
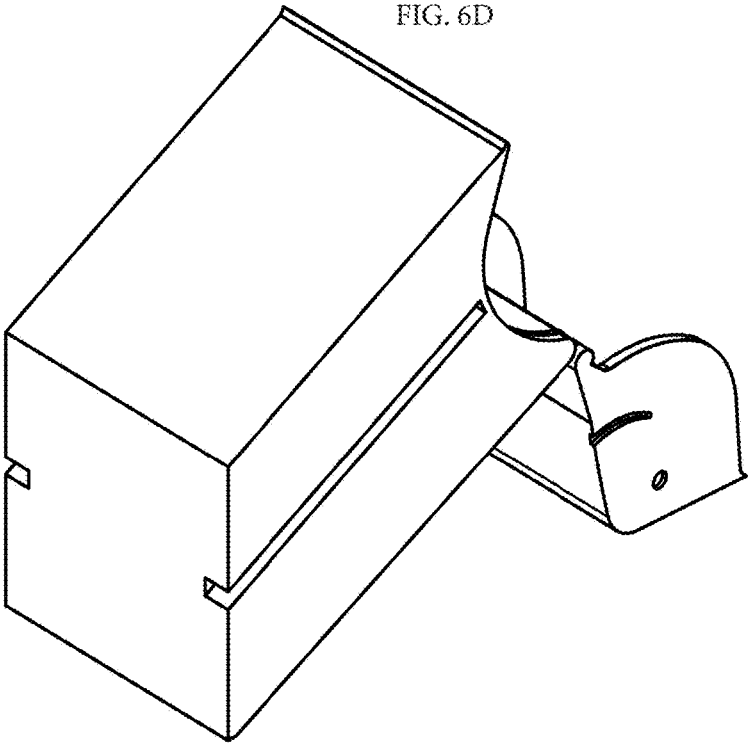
Figure 6E:
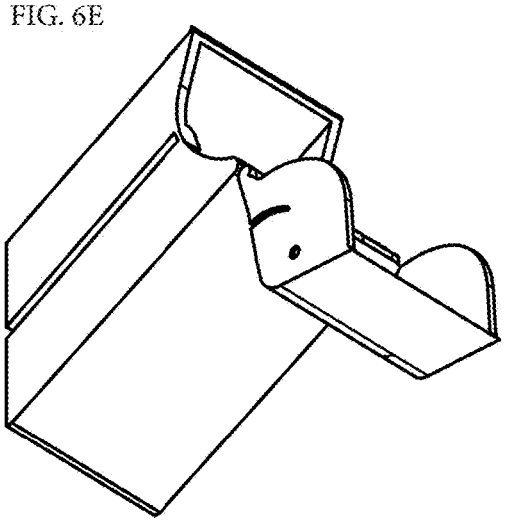
Figure 6F:
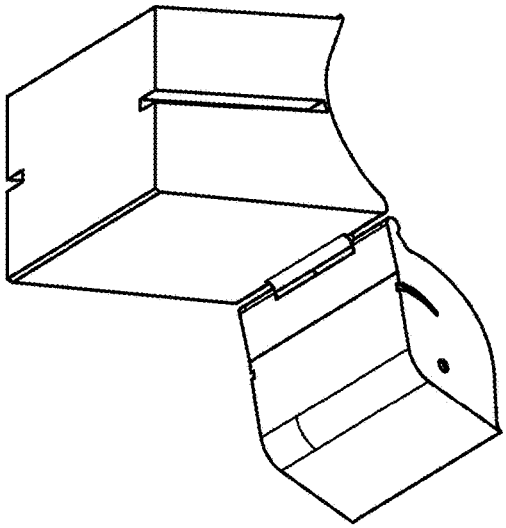

FIG. 6A shows an elevated side view of the bin 176, which features a self-supporting, tilted design. The bin includes a stable base configured for upright positioning and an upper portion with an open cavity defined by the bin opening 178. The lid 180 is pivotally attached via a hinge 182 located at the lower edge of the bin opening 178, allowing the lid 180 to rotate between a closed position, where it substantially encloses the bin opening 178 for secure storage, and an open position, providing unobstructed access for object collection or retrieval.

The bin 176 is adaptable for various uses and may include optional connecting mechanisms, such as a lever, wheel, foot pedal, or similar apparatus, to enhance user convenience. These mechanisms may assist with transporting the bin 176 to desired collection locations and rotating the lid 180 downward, enabling the lid to function as a dustpan-like apparatus for sweeping objects 68 directly into the bin cavity.

FIGS. 6A-6F collectively detail the bin 176 in different operational states and configurations, emphasizing its flexibility for integration with other embodiments, such as the cabinet structure in FIGS. 5A-5V, or for independent use as a portable and ergonomic storage and collection system.

Figure 7A:
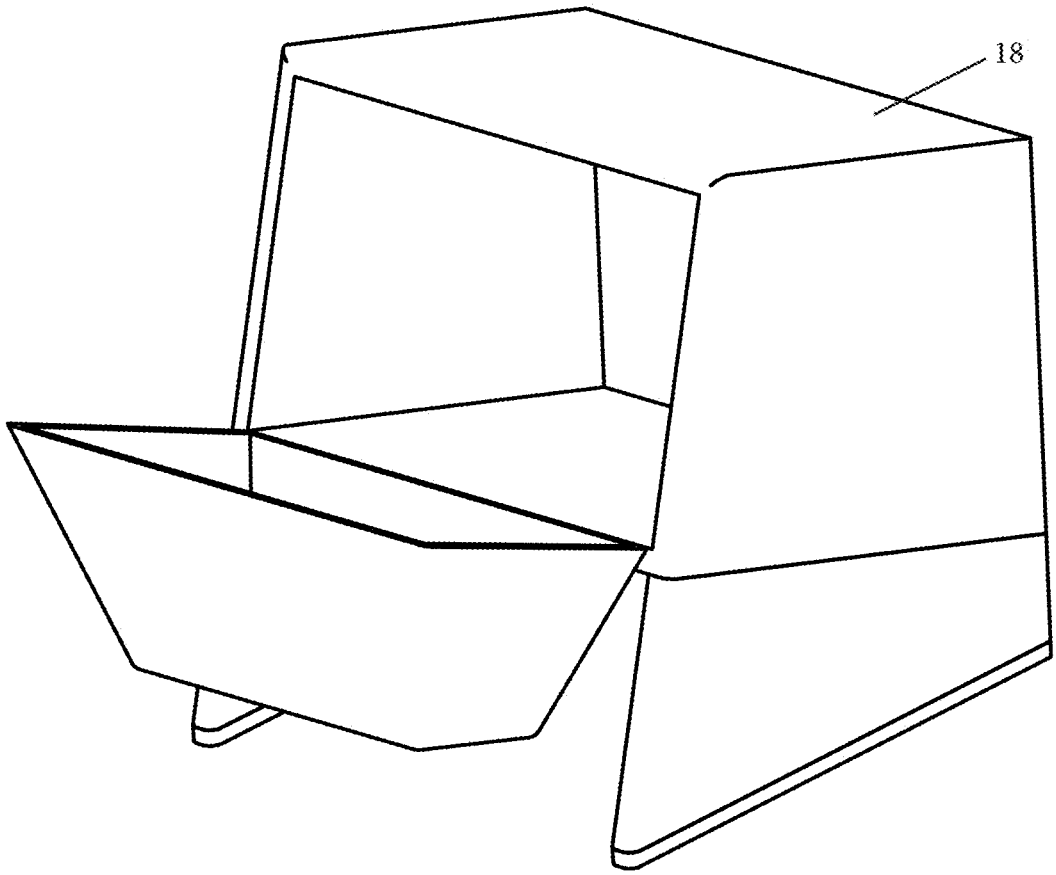
FIGS. 7A-7B illustrate a front perspective view of two alternate embodiments featuring a single bin.
Figure 7B:
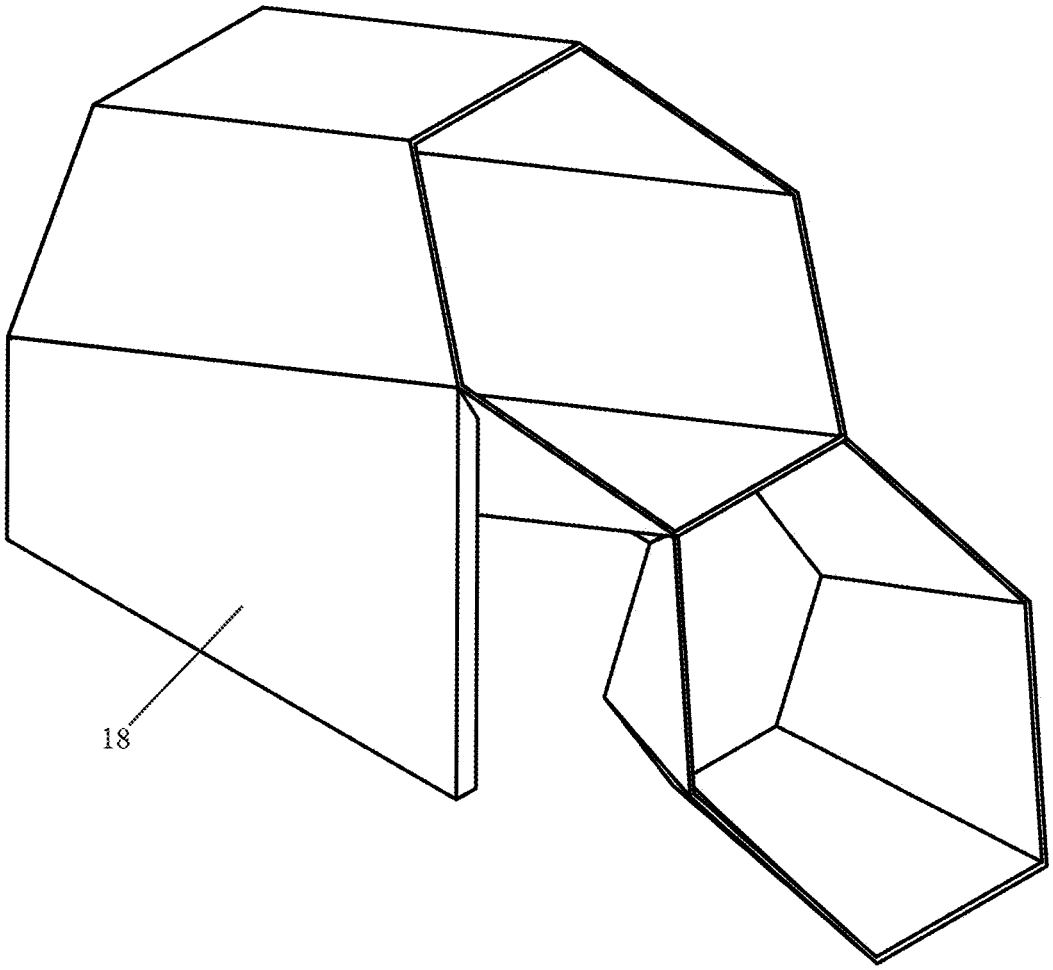

FIGS. 7A and 7B depict views of an alternative design of a single or multi-bin system 18 for collection, sorting, and storage.

Figure 8A:
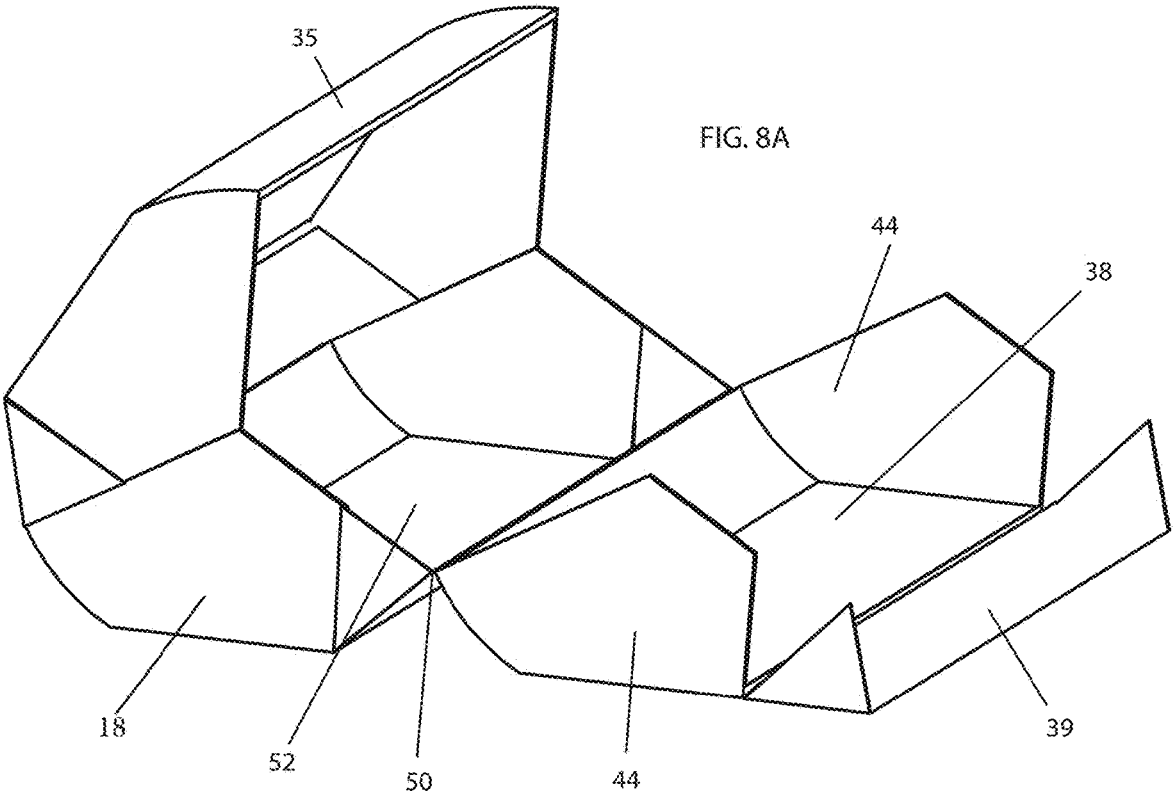
FIGS. 8A-8H depict perspective and side views of an alternate embodiment of the system. This embodiment features a bin configuration without internal vertical partitions, showcasing its versatility for general-purpose collection and storage of items such as toys, recyclables, compost, or agricultural produce. Although vertical partitions are not depicted in these figures, the system supports configurations from other embodiments that include partitions for multi-category sorting within the bin.
Figure 8B:
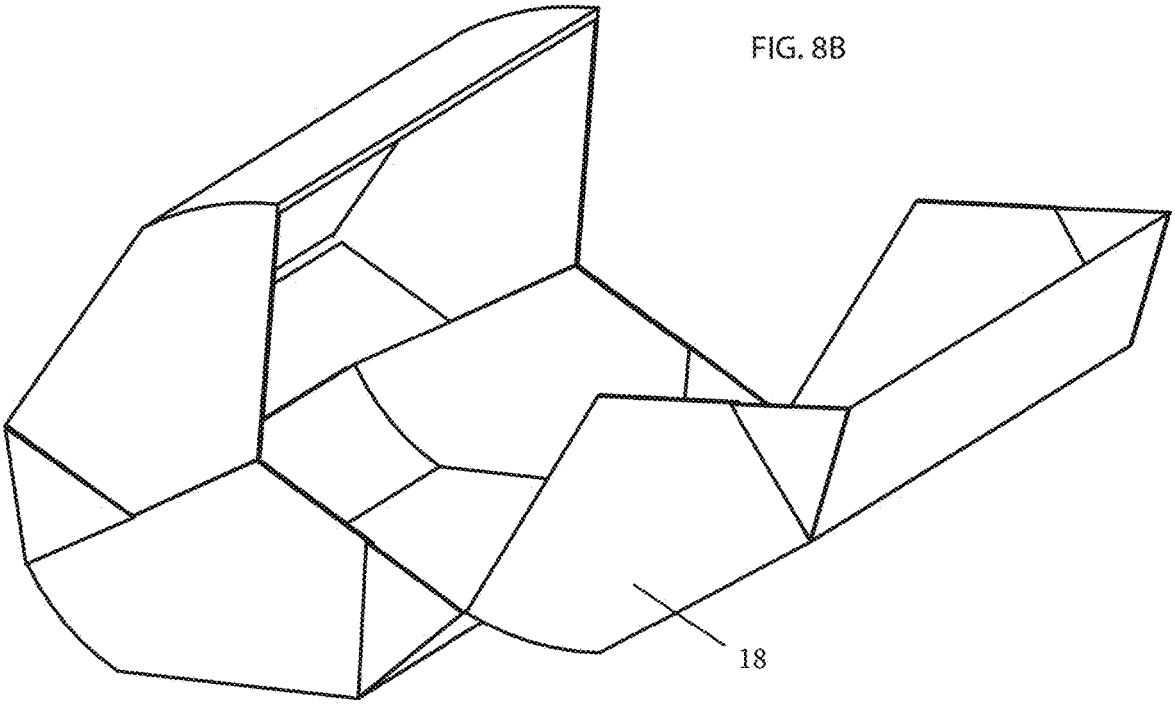
Figure 8C:
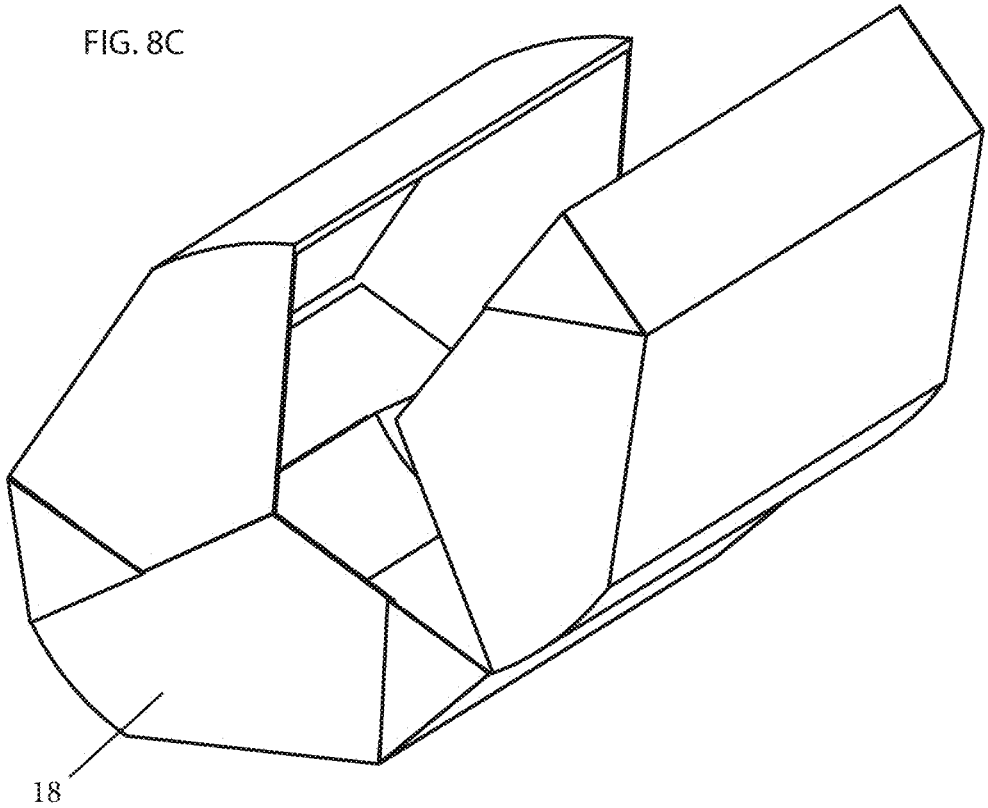
Figure 8D:
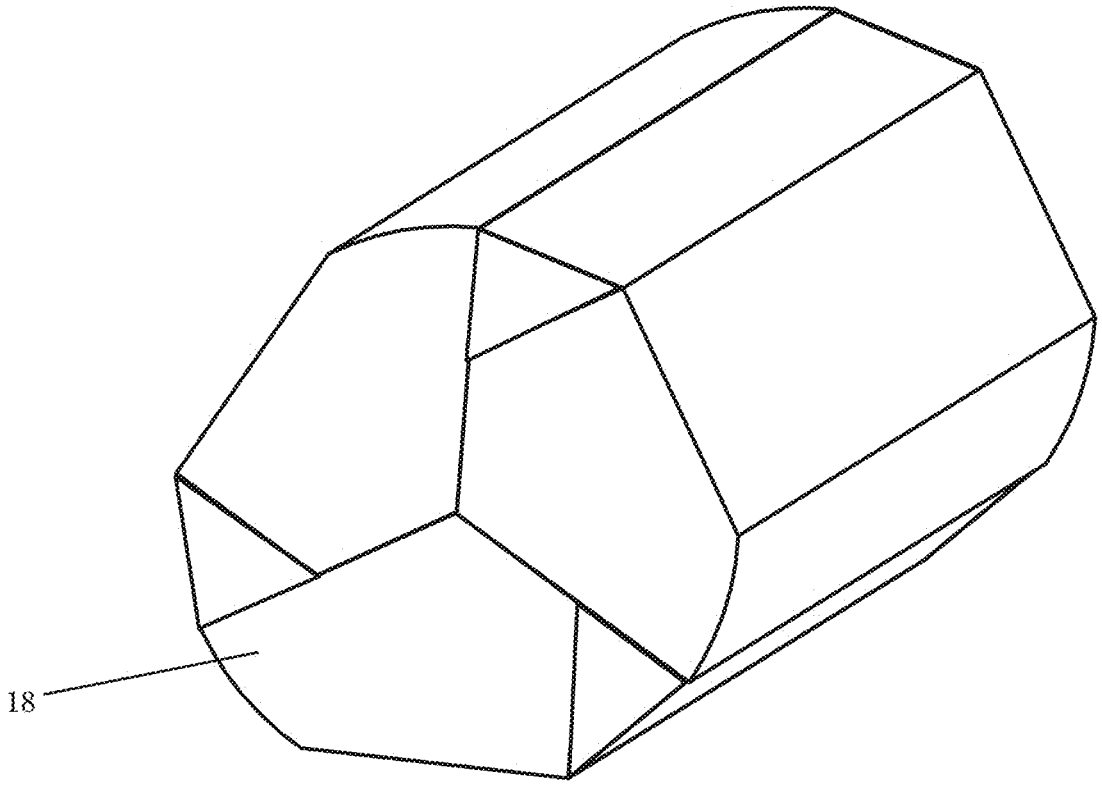
Figure 8E:
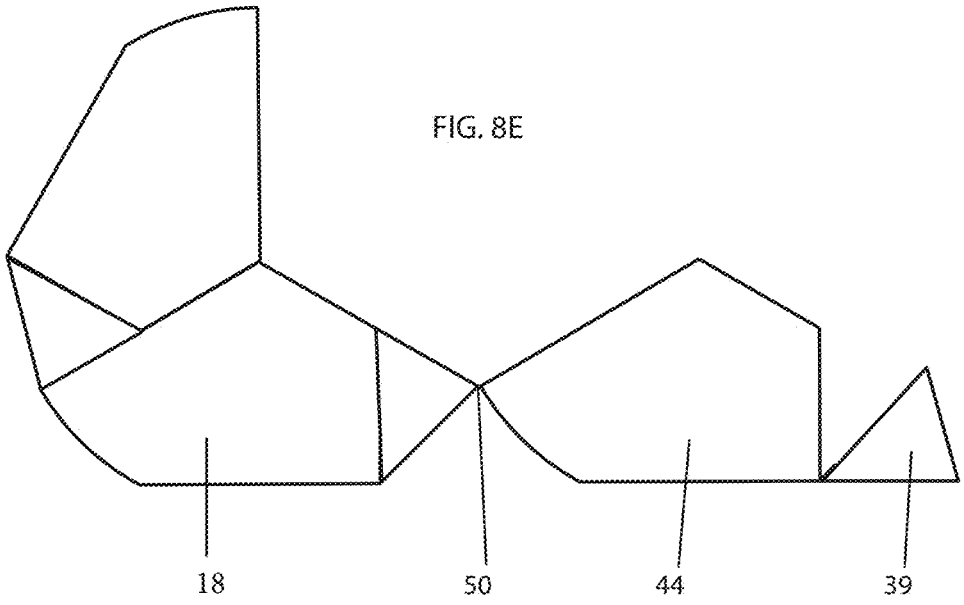
Figure 8F:
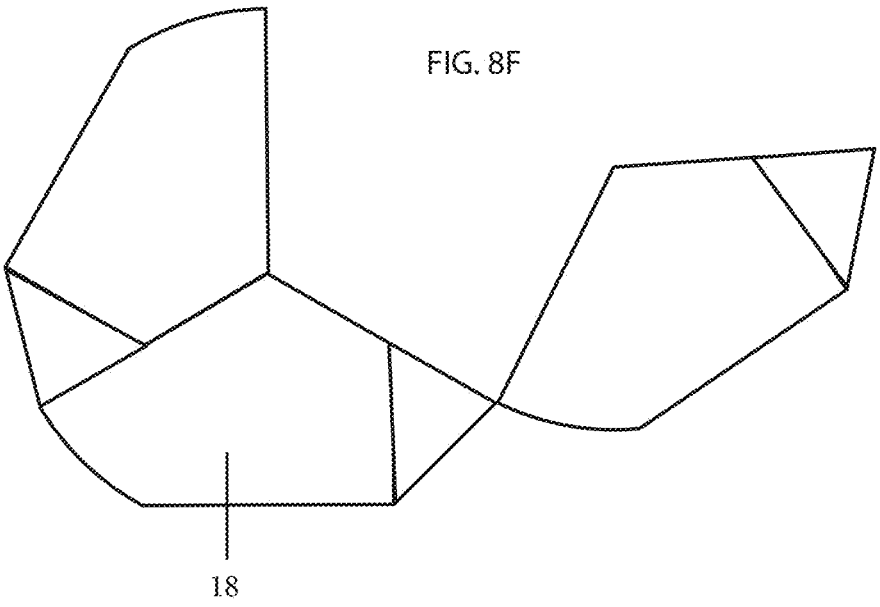
Figure 8G:
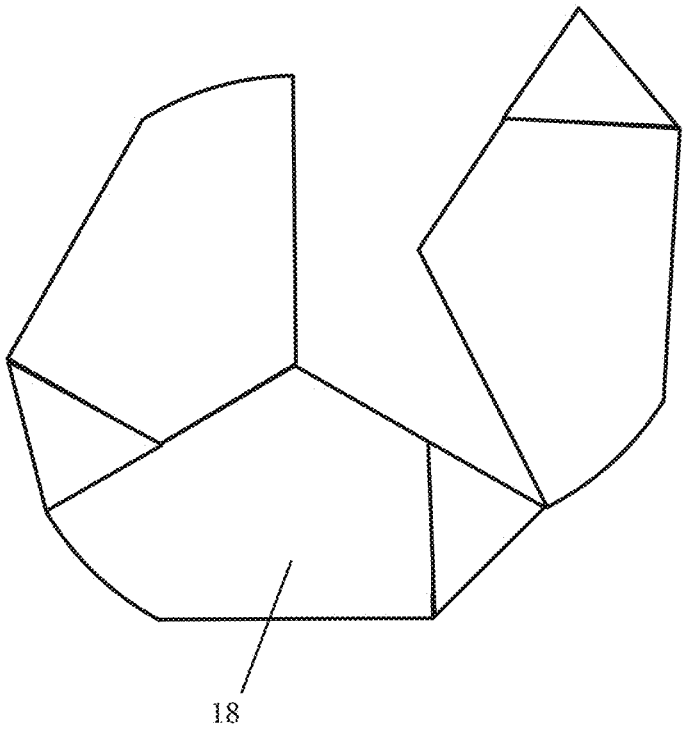
Figure 8H:
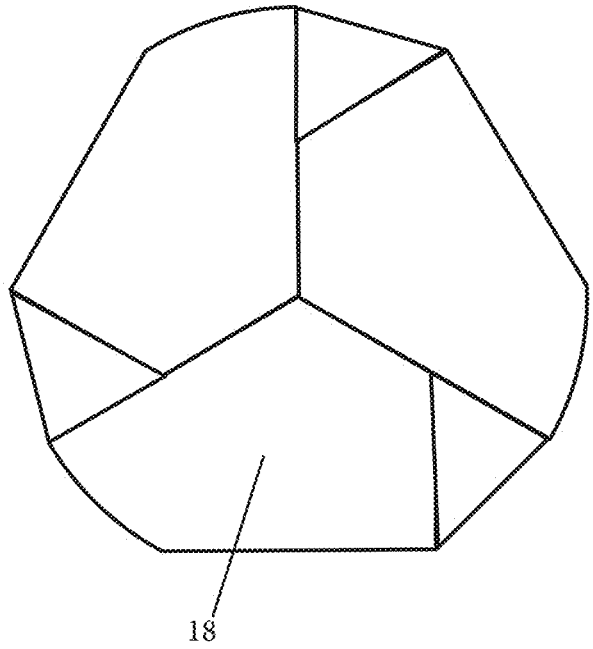

With reference to FIGS. 8A-8H, another embodiment of the system 18 for collection, sorting and storing of a variety of toys, toy parts, and other objects and debris 68 is shown. FIG. 8A is a perspective front view featuring a single bin 35 and the bin's dustpan-like apparatus 38 open. This embodiment functions in the same way as FIGS. 1A-1C, 2A-2C, and 3A-3D. Additionally, there is the option of using lid vertical dividers 37 and bin vertical dividers 33 similar to the lid vertical dividers 37 and bin vertical dividers 33 shown in FIGS. 5F and 5G to separate objects collected into the dustpan-like apparatus lid 38 into distinct sections/partitions of the bin. The lid vertical dividers 37 allow a user to sweep objects 68 into distinct sections of the dustpan-like apparatus 38 which also functions as a lid. The bin vertical dividers 33 match the position of the lid vertical dividers 37. This causes the objects 68 that were swept into the various sections of the dustpan-like apparatus 38 to get deposited into the matching divisions created by the bin's vertical dividers 33 when the dustpan-like apparatus 38 (aka, the lid) is lifted upwards above the bin opening 52 into the closed position to see the process (see FIG. 8C-8H).

Figure 9A:
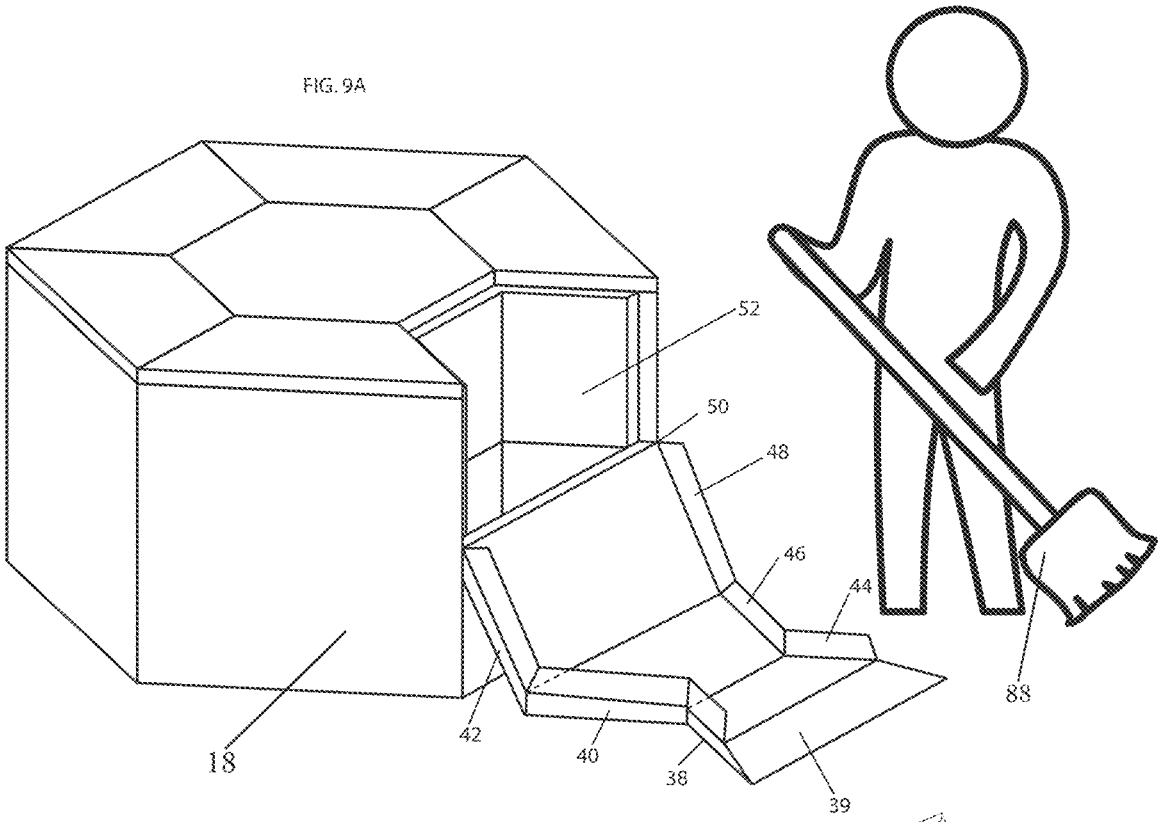
Figure 9B:
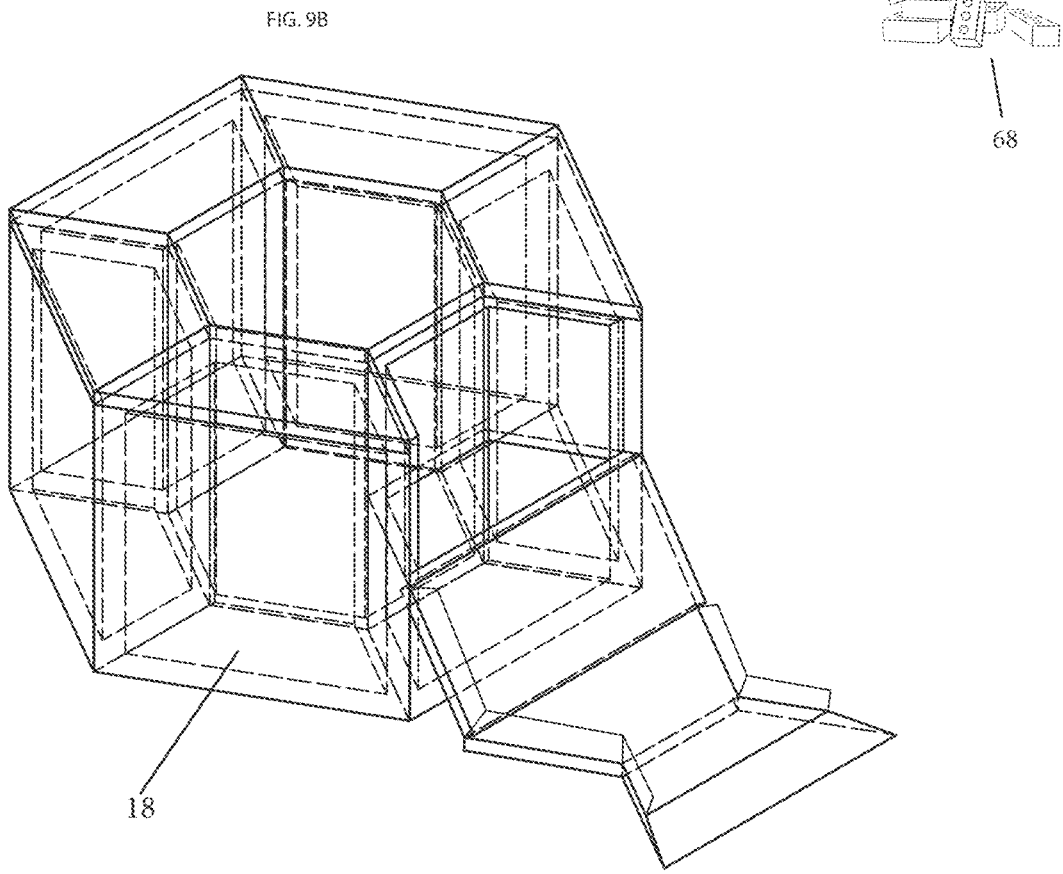

With reference to FIGS. 9A-9E, a further embodiment of the system 18 for collection, sorting and storing of a variety of toys, toy parts, and other objects and debris 68 is shown. FIGS. 9A and 9B illustrate a perspective front view featuring a table that contains six copies of the mechanism shown in FIG. 1A-1C in a rotational/circular orientation. This allows a furniture piece, such as, but not limited to, a coffee table or a children's table, to include storage units that also function as collection mechanisms with dustpan-like apparatus for lids. All of the components of the system 18 may also be made of a variety of other materials, shapes, and sizes to achieve the desired result of collecting, sorting, and depositing of items into compartments.

Figure 10A:
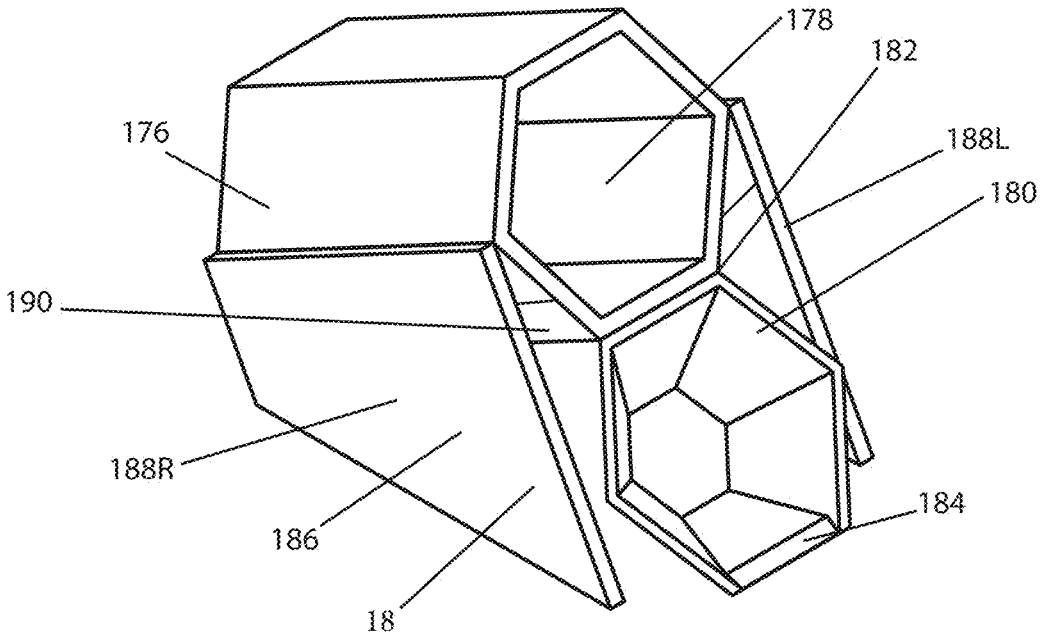
Figure 10B:
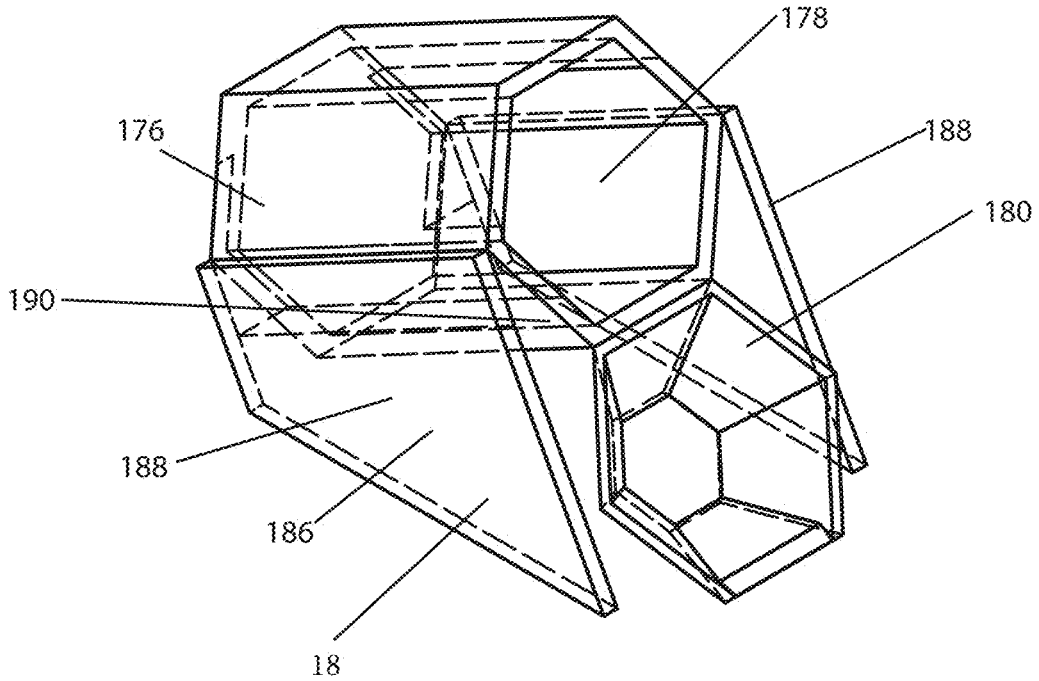
Figure 10C:
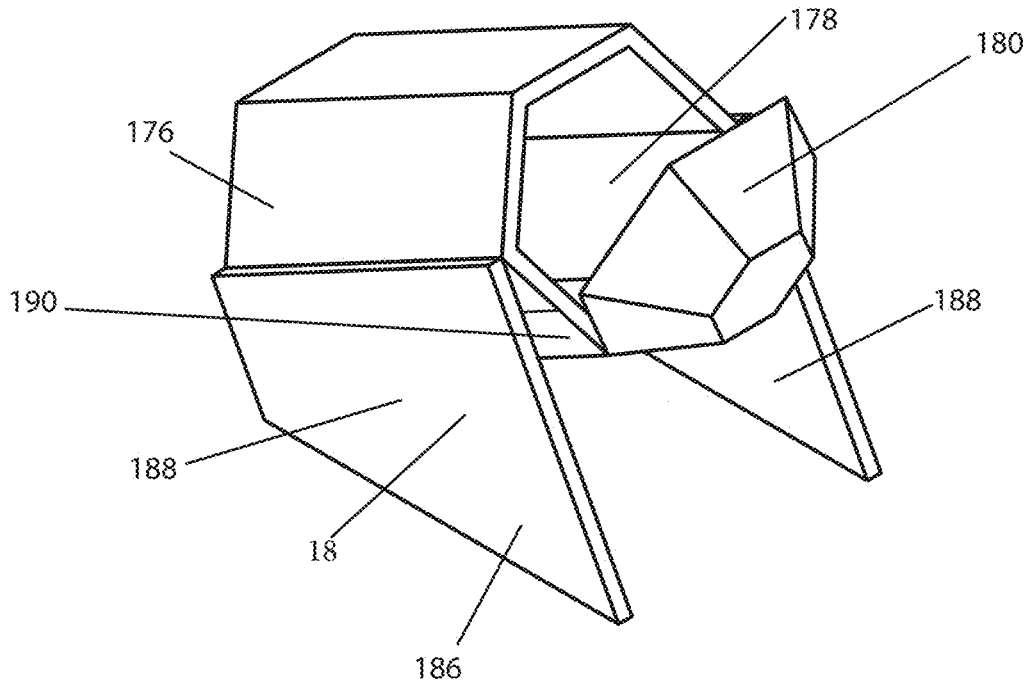
Figure 10D:
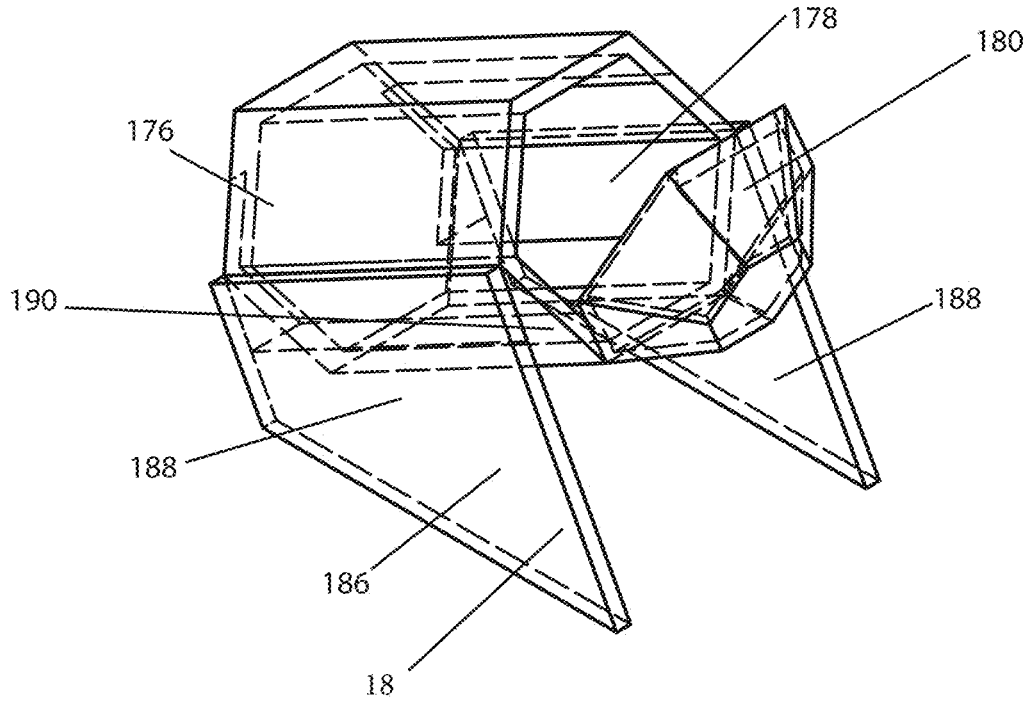
Figure 10E:
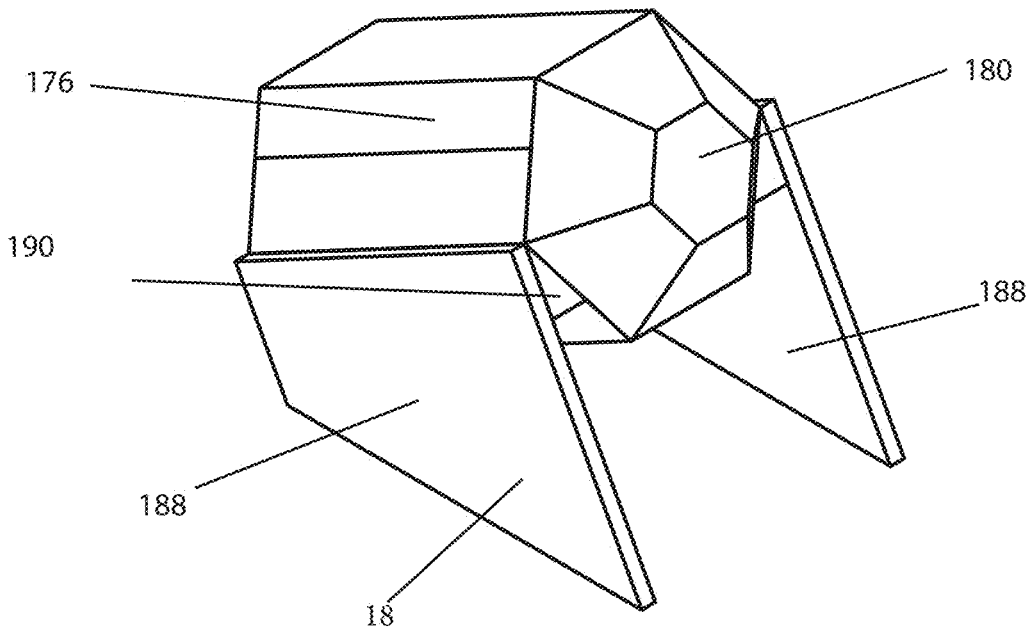

With reference to FIGS. 10A-10V, a still further embodiment of the system 18 for collection, sorting and storing of a variety of toys, toy parts, and other objects and debris 68 is shown. FIGS. 10A and 10B are perspective front side views featuring a hexagonal bin 176 that is positioned in a tilted fashion with the front portion of the bin lifted upwards. FIG. 10A-10E feature the hexagonal bin 176 with a hexagonal opening 178 at the front and a hexagonal lid 180. The lid 180 is attached with a conventional hinge 182 connected at the bottom of the lid 180 to the bottom edge of the hexagonal bin opening 178. The hinge 182 allows the lid 180 to rotate around the bottom edge of the opening 178 so that the lid 180 can fully close the bin opening 178 when the lid 180 is lifted up as well as rotate towards the ground to serve as a dustpan-like apparatus for collecting objects 68 into the bin.

In this example, the bin 176 is attached to a stand 186 with a right side 188R and a left side 188L. The sides 188 are higher towards the front of the bin 176 than at the back so as to support the bin 176 in a tilted fashion, thus allowing objects 68 to fall to the inner bottom portion of the bin 176 when they are deposited through the bin opening 178. The front portion of the bin 176 must be tilted high enough off the ground to allow the bin's lid 180 to open and close at the front of the bin 176 but low enough to the ground to enable the lid 180 to be used as a dustpan-like scooping apparatus when its flipped open and touches the ground or other flat surface. The stand's base 190 is the exact shape of the bottom half of the hexagonal bin 176 and is attached to the top inner edge of the stand's sides 188.

The bin lid 180 is shaped like a truncated hexagonal pyramid (the base of the pyramid is a regular hexagon, all sides are equal, and the angles between the sides are 120 degrees).

The bin 176, bin opening 178, bin lid 180, stand 186, stand's sides 188, stand's base 190, and any of the connecting sides or parts can be made from a variety of materials and sizes and with a variety of shapes and connectors to allow the scooping function to occur.

For example, the bin can be, but is not limited to being, triangular shaped with a connected lid in the shape of a truncated triangular pyramid. The bin can also be square shaped with a truncated square pyramid lid, pentagonal shaped with a pentagonal pyramid lid, heptagonal shaped with a truncated heptagonal pyramid lid, octagonal shaped with a truncated octagonal pyramid lid, enneagonal shaped with a truncated enneagonal pyramid lid, decagonal shaped with a truncated decagonal pyramid lid, hendecagonal shaped with a truncated hendecagonal pyramid lid, dodecagonal shaped with a truncated dodecagonal pyramid lid, etc.

Hexagonal bins are ideal because hexagonal bins can be stored in a honey-comb like structure which utilizes minimal storage space and is very sturdy.

A variety of connecting apparatus such as, but not limited to, a lever, wheel, foot pedal, etc. can be used to minimize the need for a user bending to open and close the lid 180.

A conventional lip 184 made of rubber, silicone, or a variety of other materials is at the surface of the lower front end of the bin lid 180. When the bin lid 180 is in the position touching the floor as seen in FIGS. 10A, 10B, 10F, 10I, and 10L, the lip 184 is on the surface of the lid 180 and no gap exists between the bin lid 180 and the ground, or any other flat surface unto which the system 18 is placed. The lip 184 is typical in design to a conventional dustpan rubber or silicone lip. The lip 184 may be affixed permanently to the lid 180 or it may be replaceable when necessary. The stand 186, stand sides 188, base 190, bin lid 180, and bin 176 can be made out of a variety of materials, including but not limited to plastic, wood, and metal.

The stand 186 and hexagonal bin 176 may be separable to allow replacement of the bin 176 with another bin for alternate use, compact storage, or cleaning. Alternatively, the stand 186 and hexagonal bin 176 may be permanently connected as one piece. Optionally, bin lid 180 can be separated from the bin opening 178 so as to allow easier access to the objects within the hexagonal bin 176, for example, when a child wants to play with the toys inside the bin. Alternatively, the entire system 18 can be turned around to allow individuals to access the bin's contents without the bin lid in the way by adding an opening flap (not shown) on the top surface of the hexagonal bin 176. The stand's sides 188 may optionally have wheels (not shown) on the bottom to allow a user to more easily maneuver the system 18. Optionally, the stand's base 190 can be a variety of other shapes. It's possible for a lid in the shape of a truncated hexagonal pyramid (or a variety of other shapes) to be connected directly with a conventional hinge or other mechanism to the front edge of the stand's base 190 and for the hexagonal bin 176 to have its own lid connected with a conventional hinge at the top edge of the bin 176 or elsewhere. This would allow for the bin 176 to not use its lid as a dustpan-like apparatus, but rather use the dustpan-like apparatus that is connected directly to the front edge of the stand's base 190 as a scooping mechanism on the stand which would, in turn, allow the bin 176 to be easily replaceable with other bins.

FIGS. 10O to 10S show additional views embodying the above alternate version of the system 18 featuring multiple rows and columns of this embodiment.

FIGS. 10E, 10H, 10K, and 10N show the hexagonal bin 176 closed with the bin's lid 180 closed in the front over the opening 178 of the hexagonal bin 176. In FIG. 10A, a user 92 has opened the hexagonal bin 176 by pulling down the bin's lid 180 towards the front of the hexagonal bin 176 and downwards, either manually or using a connected apparatus such as, but not limited to, a conventional lever, wheel, foot pedal, etc. (not shown). To open the bin 176, the user pulls down the bin's lid 180 towards themselves if they are standing in front of the bin 176.

Figure 10F:
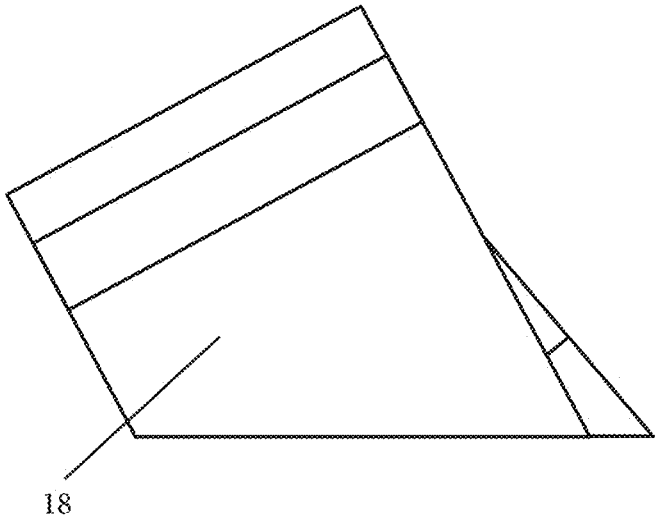

In a method of operation/use, in step 1, as shown in FIG. 10F to 10K, the bin's lid 180 is flipped over and the lip 184 is touching the ground or bottom surface. In FIG. 10F, the user uses a broom 88 or other collection mechanism to sweep, sort, and collect a desired category of objects such as toys, toy parts, and other objects and debris 68 into the bin's lid 180.

Figure 10G:
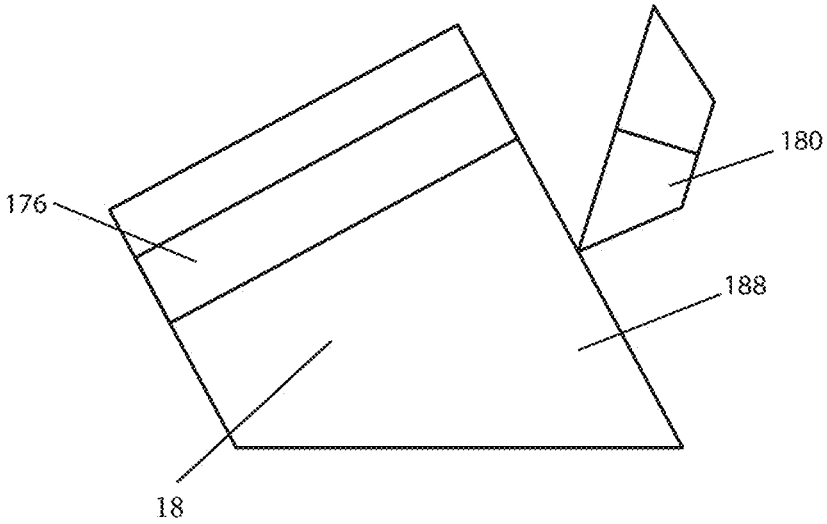

In step 2, once the user has completed collecting all of the relevant objects into the bin's lid 180, the user returns the system 18 to the position shown in FIG. 10G by lifting up the bin lid 180 either manually or using a connected apparatus such as a lever, wheel, foot pedal, etc. and flips the bin lid 180 over the bin's opening 178. As the bin's lid 180 is lifted up, the objects inside of it are deposited into the hexagonal bin 176 and the bin's lid 180 serves as the lid of the hexagonal bin 176 (shown in FIG. 10H).

Figure 10H:
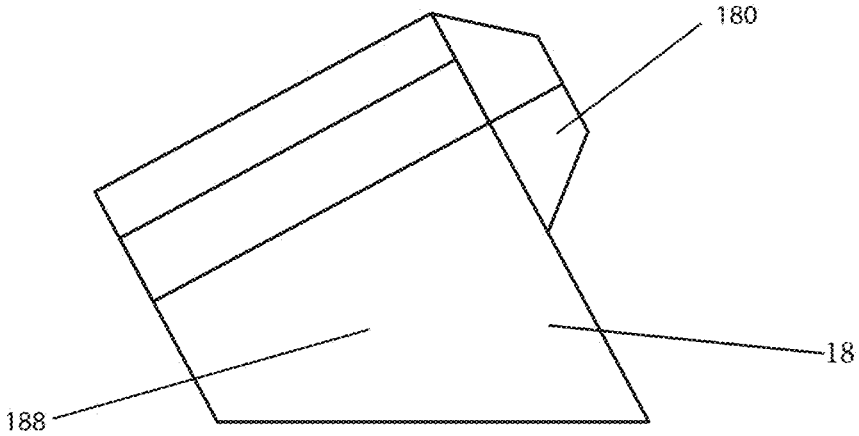
Figure 10I:
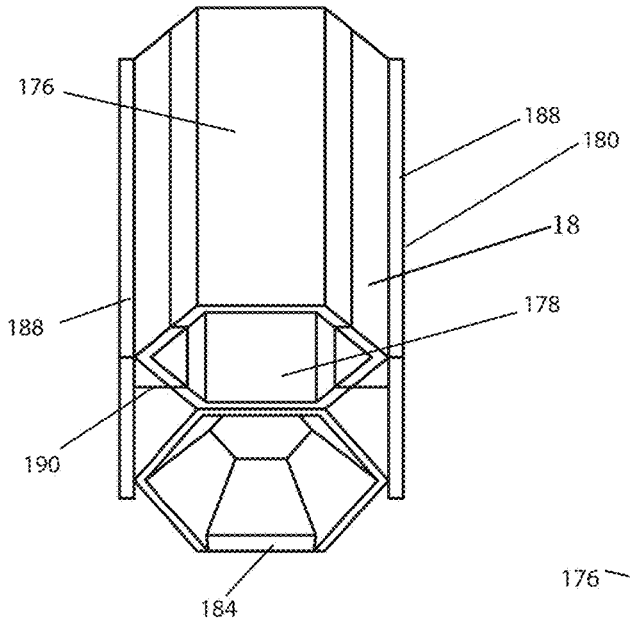
Figure 10J:
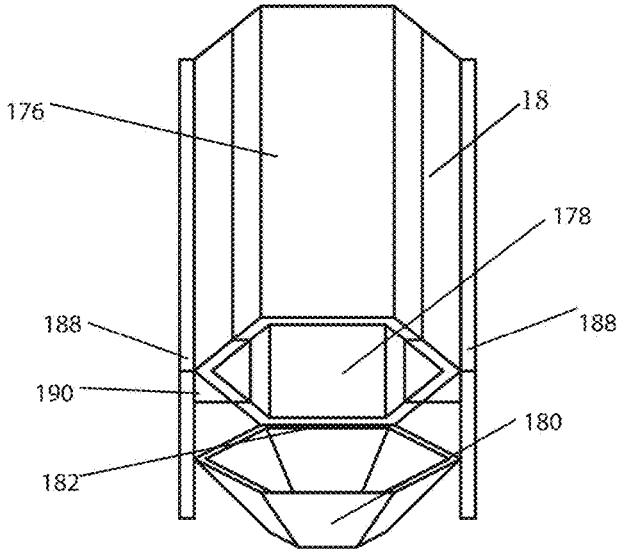
Figure 10K:
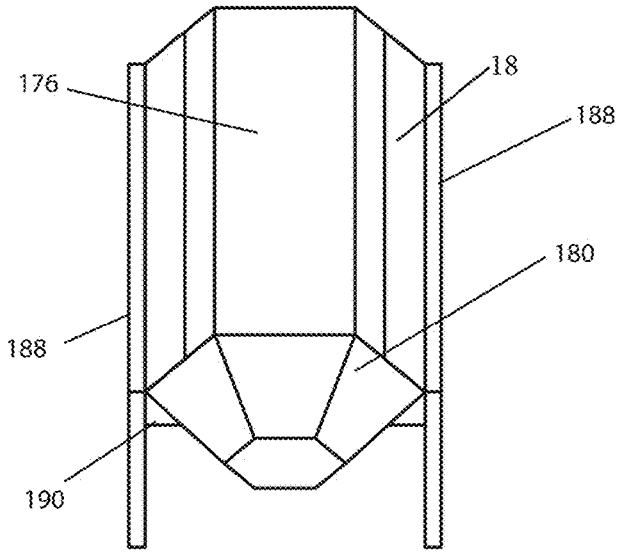
Figure 10L:
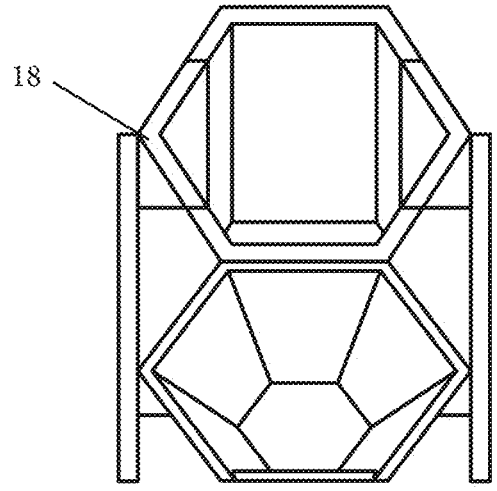
Figure 10M:
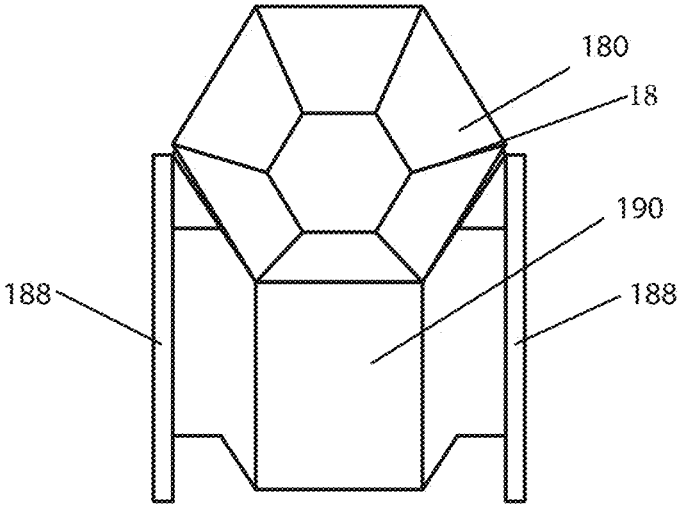

In step 3, in the orientation shown in FIG. 10H, the bin's lid 180 can lock into place over the hexagonal bin 176 using a variety of conventional child-proof locking mechanisms (not shown) implemented using a variety of options including magnetic child-proof locks, latch locks, etc. to prevent children from flipping open the bin lid 180 when it is desired that the bin remain inaccessible to the child. Also, conventional magnet connectors can be used on the sides of the bin lid 180, as well as the bin opening 178 and the hexagonal bin 176 to keep the respective lid held in place.

The bowl-like shape of the bin lid 180, serves to minimize objects 68 from falling out as the bin lid 180 is lifted towards the bin opening 178.

Figure 10N:
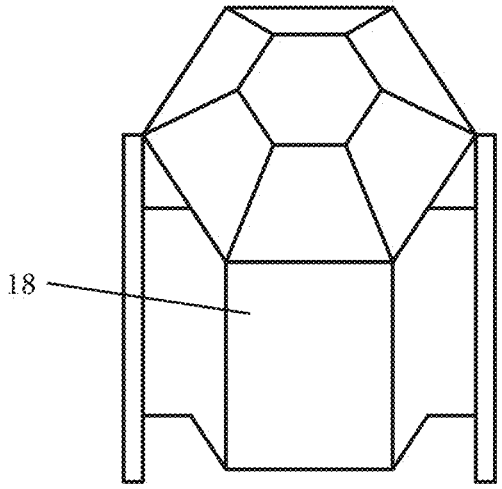
Figure 10O:
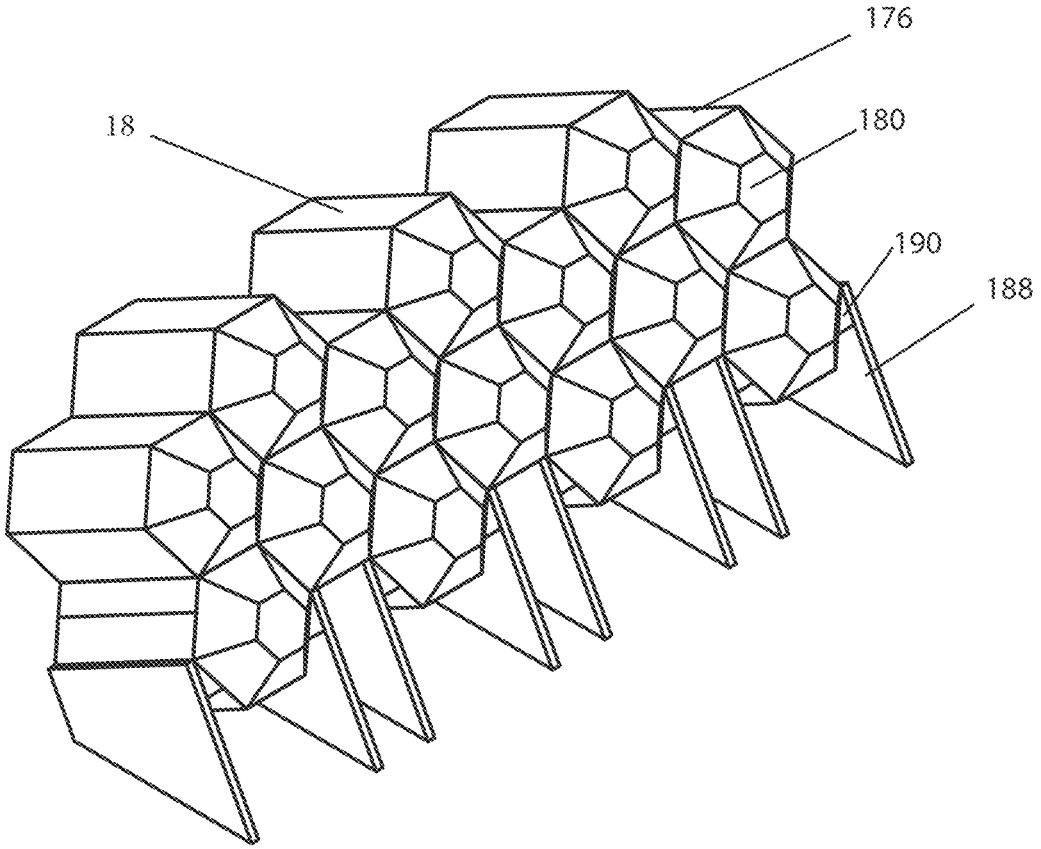
Figure 10P:
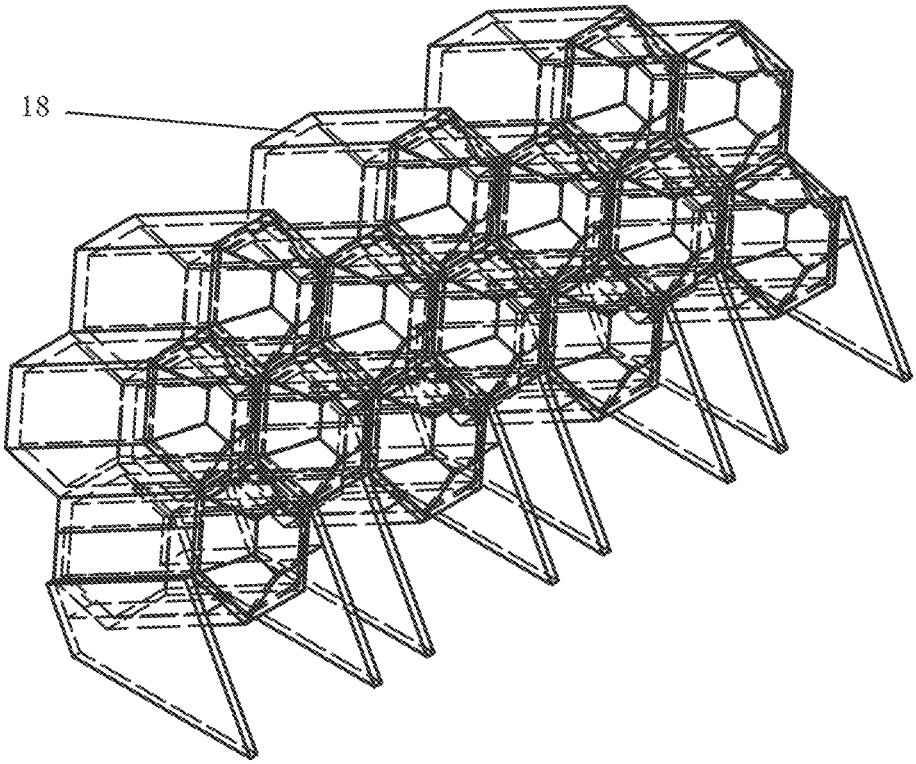
Figure 10Q:
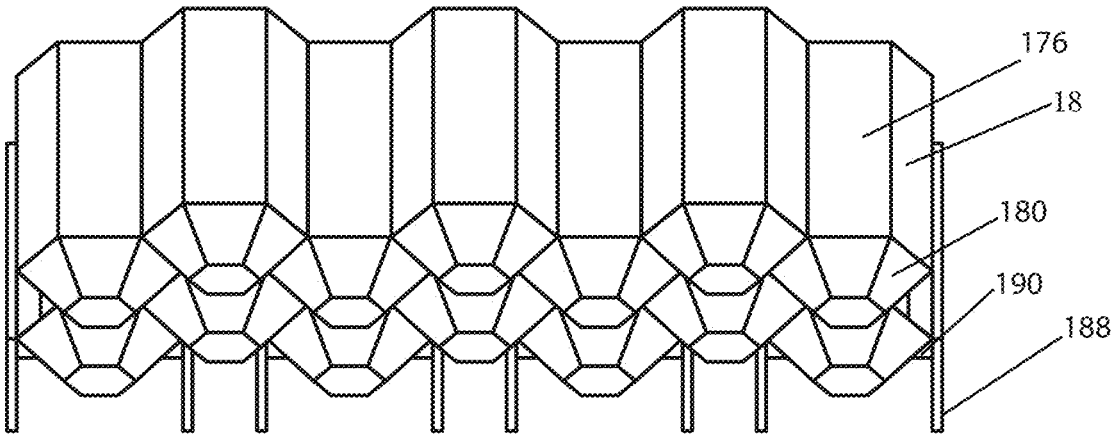
Figure 10R:
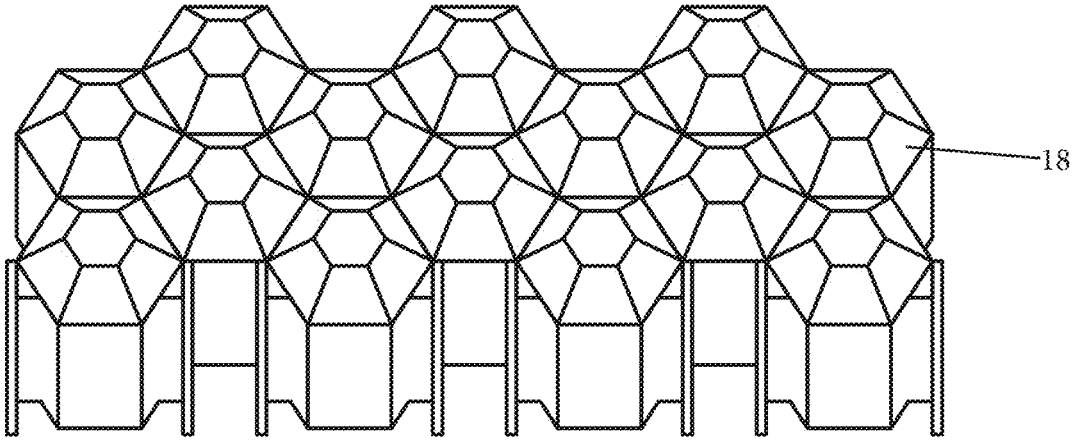
Figure 10S:
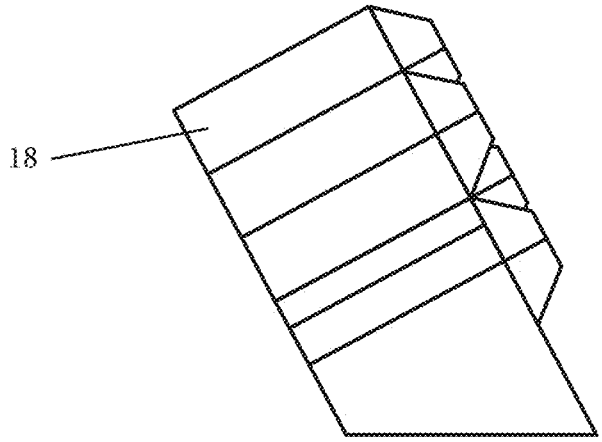

FIGS. 10O to 10S show multiple rows and columns of the hexagonal bins 176 shown in FIG. 10A to 10N. The operation of this embodiment should be the same as that shown and described for FIGS. 10A to 10N but in this embodiment, objects can be swept or otherwise collected into any one of the first row's bin's lids 180, thus allowing a user to sort multiple categories of objects into various hexagonal bins. Objects 68 can also be deposited into the bins 176 not in the first row by opening and closing their respective bin lids 180. There can be any number of copies of the system 18, and in a variety of orientations. For example, the system 18 shown in FIG. 10A to 10N can be re-configured to fit to be a part of, but not limited to, a variety of furniture categories, such as coffee tables, kids tables, dinner tables, ottomans, shelving units, cabinets, etc. Optionally, the bin lid 180, can be clicked into the bin lids 180 of the bins 176 located to their right or left, by connecting the respective sides of bin lid 180, or other portion of the lids, using conventional connection methods such as, but not limited to, latch clamps, magnetic catches, interlocking brackets, etc. so that the lids of multiple bins 176 can be lowered and lifted simultaneously. This can be maneuvered using a connected apparatus such as a conventional lever, wheel, foot pedal, button, etc. (not shown). The ability to open and close the lids simultaneously creates a more efficient collection method for the user, and a more fun system 18 for children to interact with. Optionally, bin lids 180 can be separated from the bin openings 178 so as to allow easier access to the objects within the hexagonal bins 176.

Figure 11A:
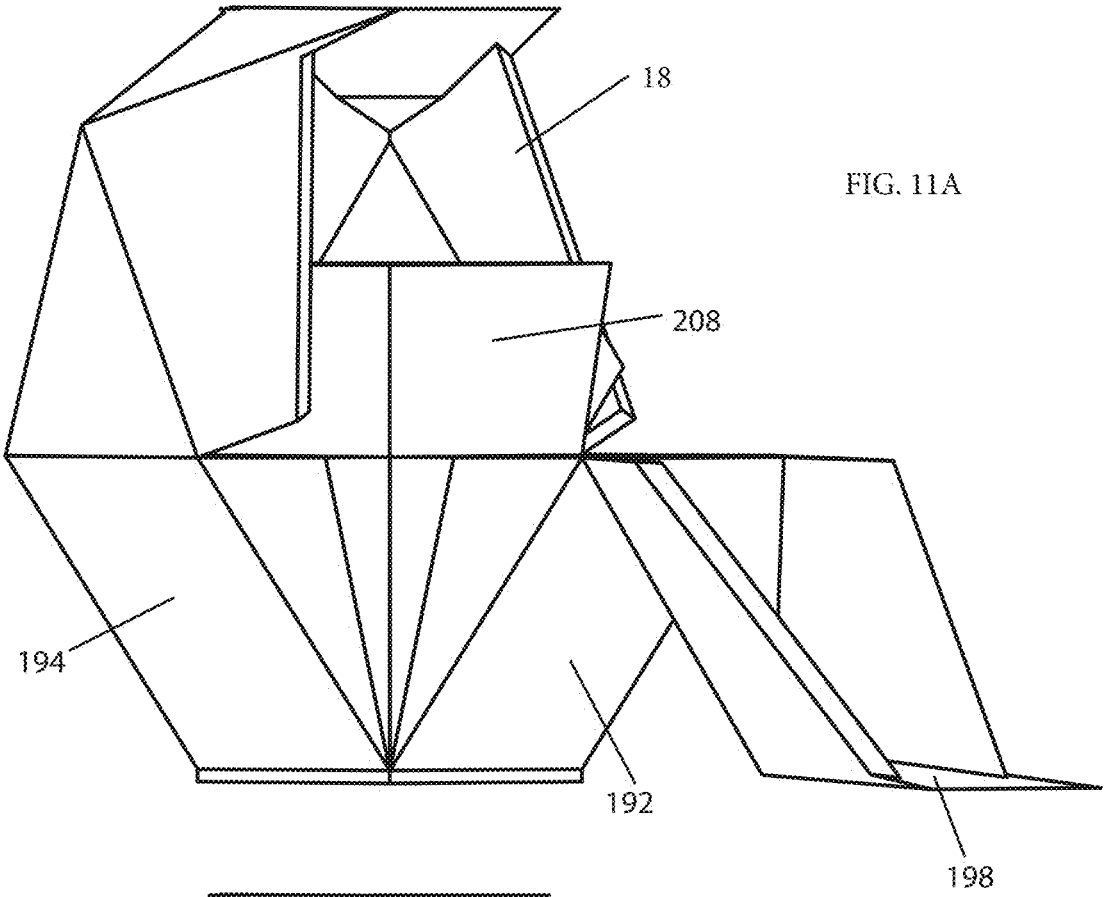
FIGS. 11A-11P illustrate another embodiment of a modular system featuring a cuboctahedron arrangement of bins.
Figure 11B:
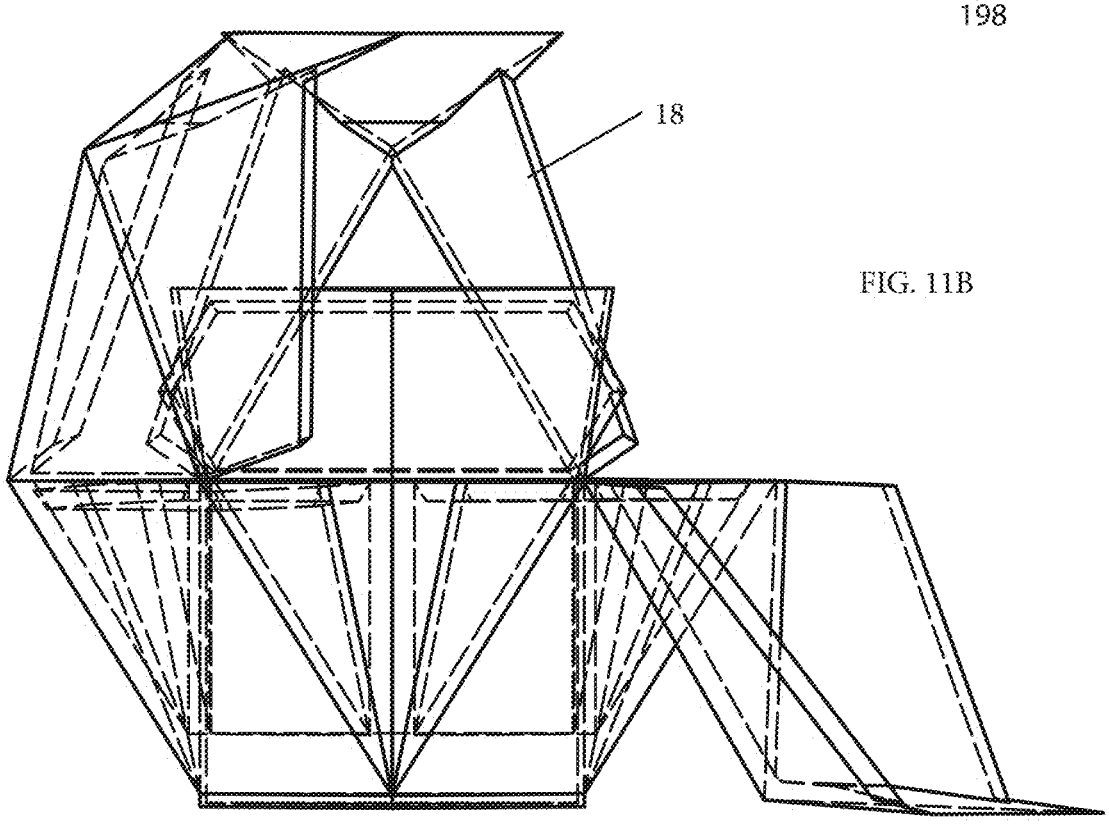
Figure 11C:
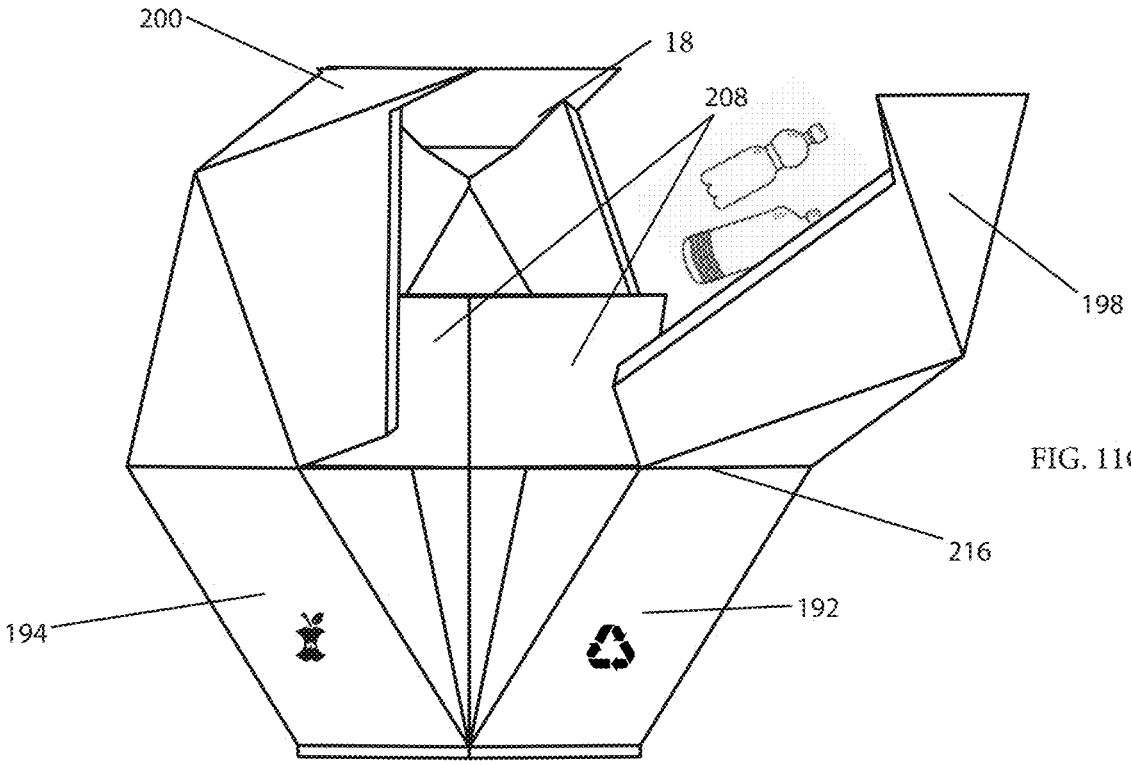
Figure 11D:
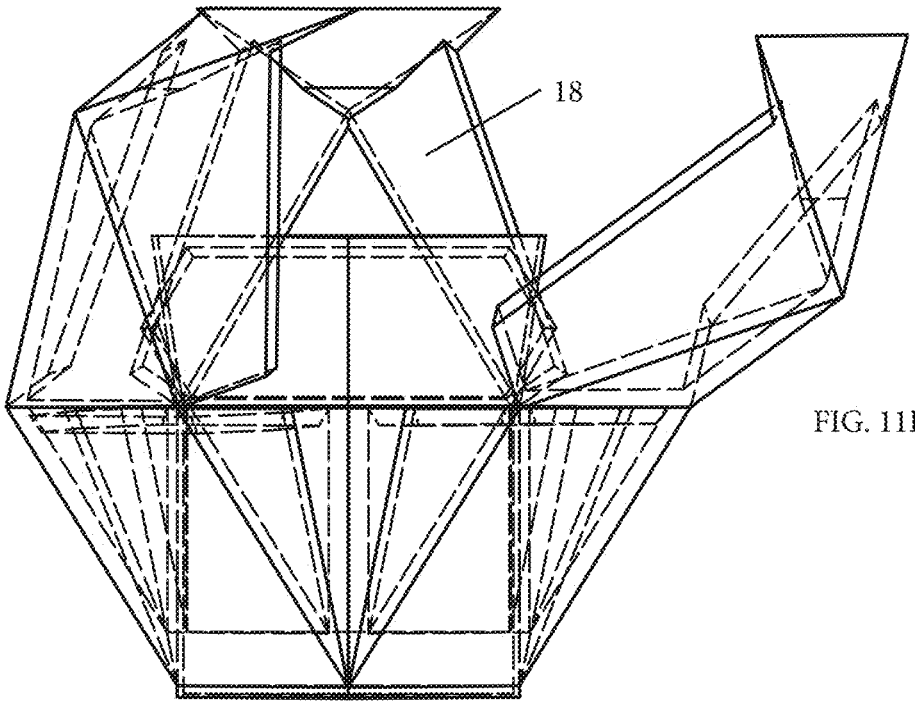
Figure 11E:
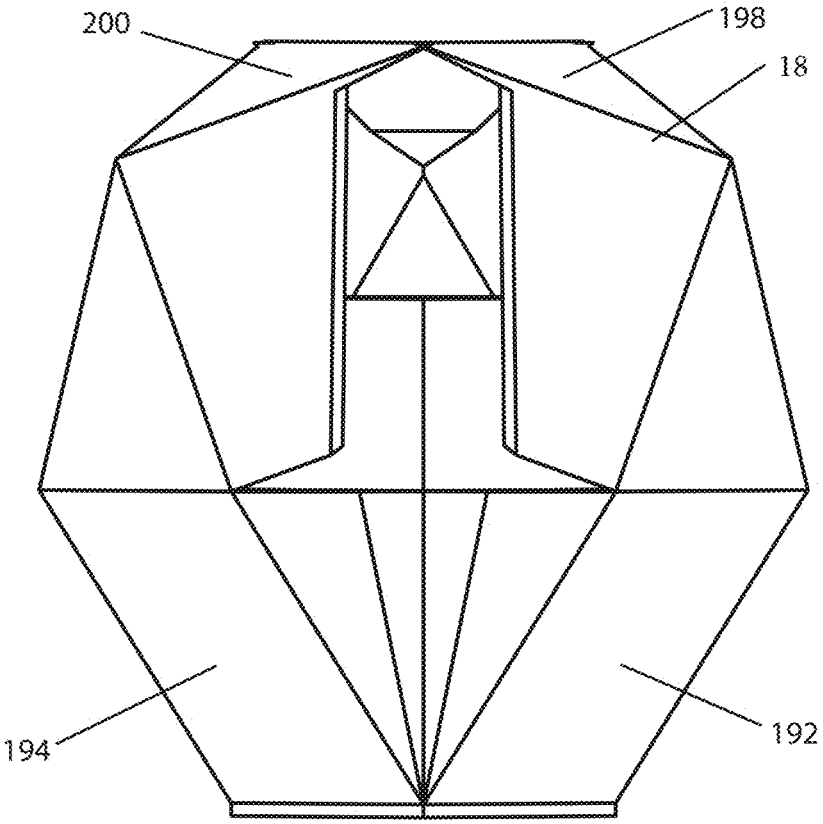
Figure 11F:
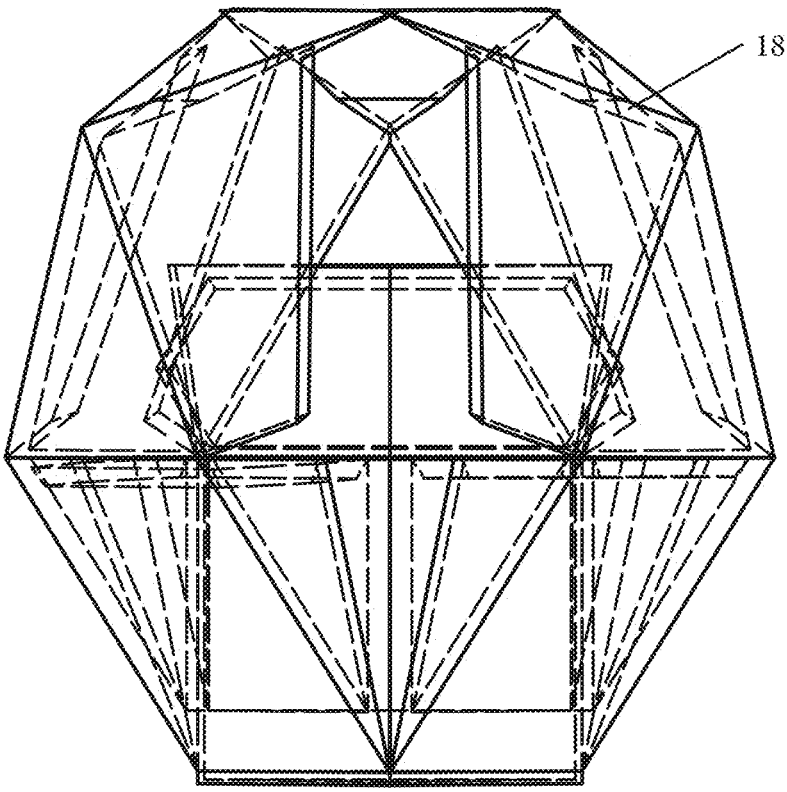
Figure 11G:
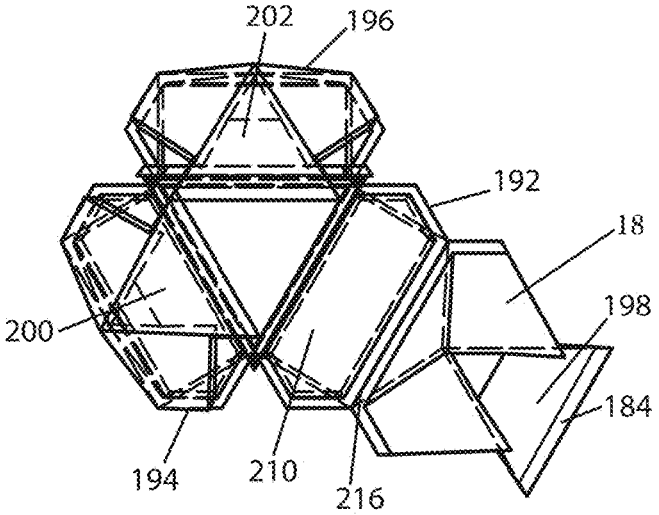
Figure 11H:
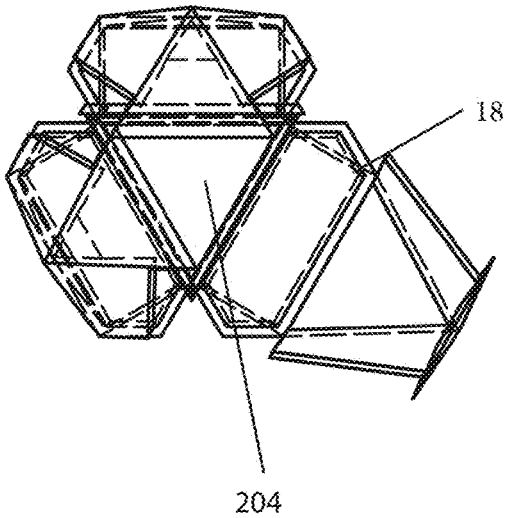
Figure 11I:
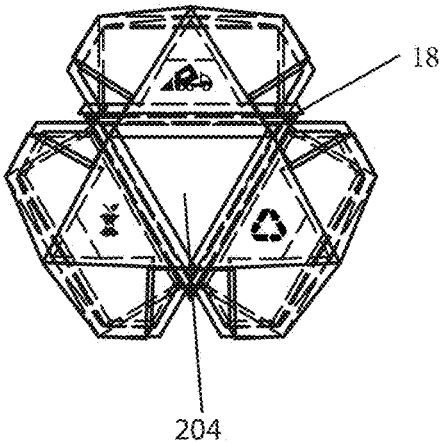
Figure 11J:
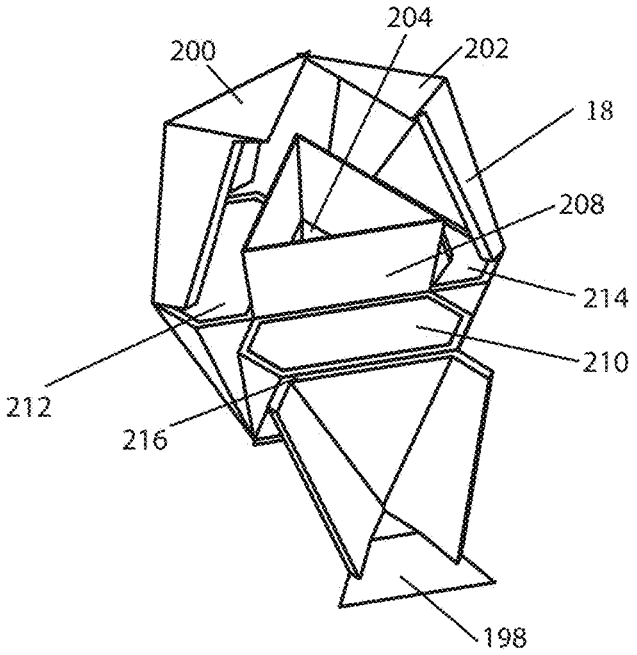
Figure 11K:
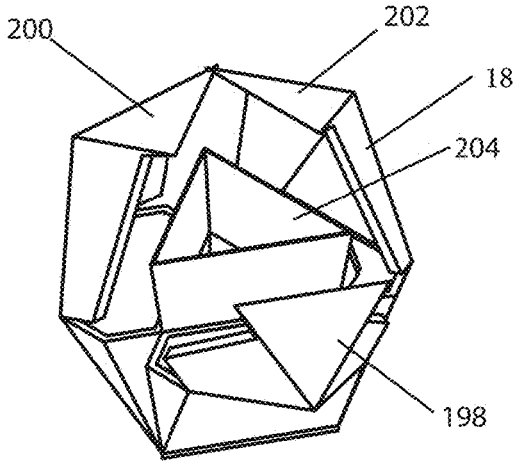
Figure 11L:
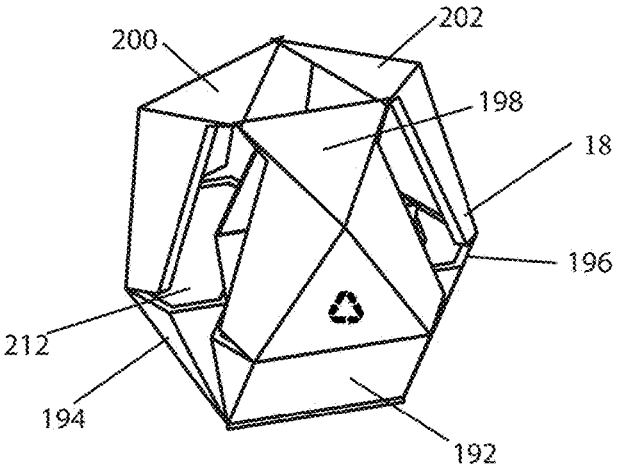
Figure 11M:
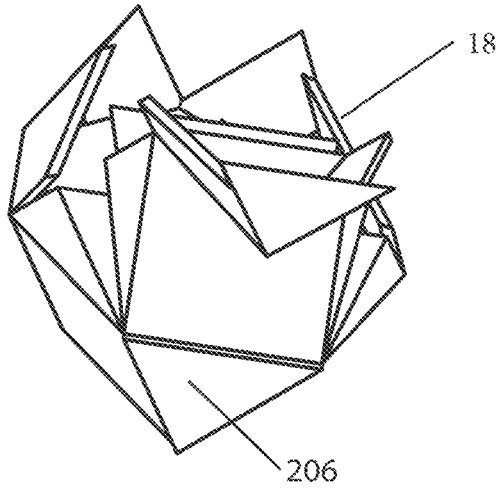
Figure 11N:
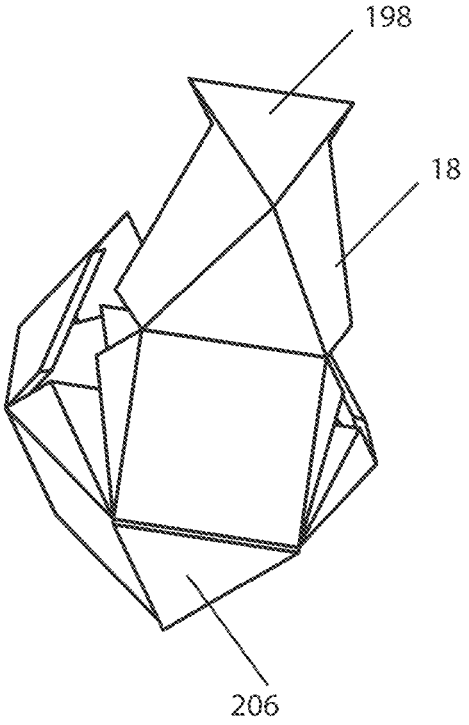
Figure 11O:
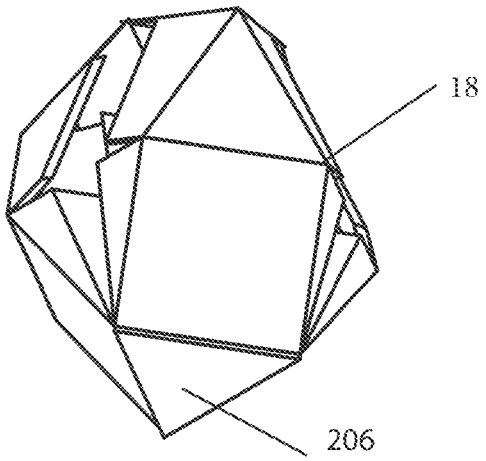
Figure 11P:
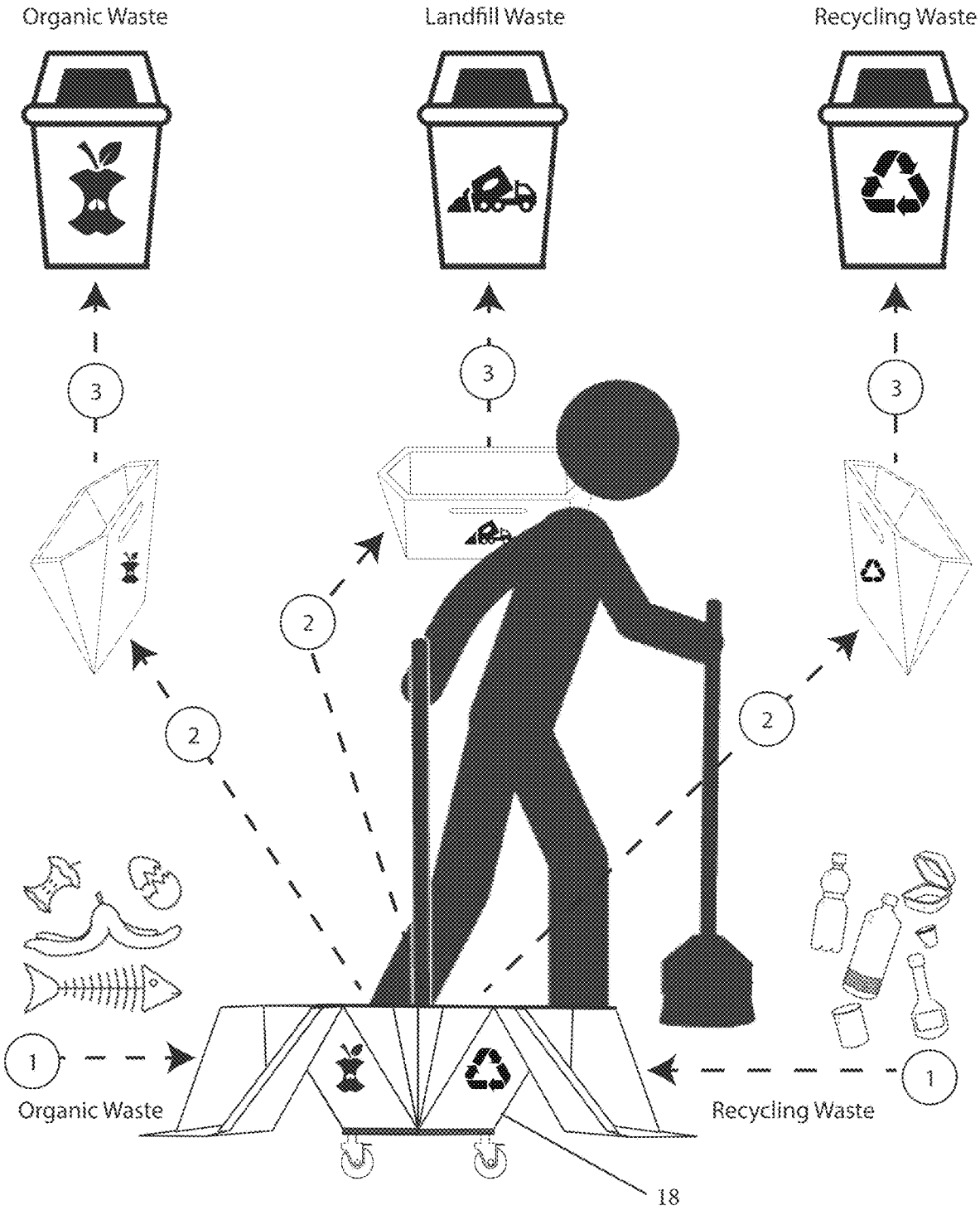

With reference to FIGS. 11A-11P, an additional embodiment of the system 18 for collection, sorting and storing of a variety of toys, toy parts, and other objects and debris 68 is shown. FIGS. 11A and 11B illustrate a perspective front side view featuring three attached bins 192, 194, and 196. There is one triangular stand 204 positioned in the middle center of the bins. The triangular stand 204 is made up of a triangular base 206 at the bottom with three vertical walls 208 that form the shape of a triangle. Each of the three bins 192, 194, 196 temporarily click into one vertical wall 208 of the triangular stand 204 using a conventional clicking method and other connection method (not shown).

The first bin 192 is a prismatic section of a cuboctahedron with a triangular top face that forms the top part of the first bin's lid 198. The first bin 192 is oriented at 120-degree intervals with the second bin 194 and third bin 196, around the central triangular cavity of the triangular stand 204. The first bin 192 also has empty spaces at its sides, and it's bottom edge aligns perfectly with the respective side of the triangular base 206.

The second bin 194 and third bin 196 are identical in features and functionality to the first bin 192—they all feature a triangular top face and align at a 120-degree angle with the other bins. Together, these shapes reconstruct a shape similar to a cuboctahedron.

The first bin 192 is split horizontally in the middle to create a lid 198 which also serves as a dustpan-like apparatus when the lid 198 is fully open and touching the ground or other flat surface.

When the lid 198 is flipped open so that the top surface of its triangular top face touches the ground, it reveals an elongated hexagonal bin opening 210. The lid 198 is attached with a conventional hinge 216 connected at the bottom front edge of the lid 198 to the top front edge of the first bin's opening 210. The hinge 216 allows the lid 198 to rotate around the top front edge of the opening 210 so that the lid 198 can fully close the bin opening 210 when the lid 198 is lifted up as well as rotate towards the ground to serve as a dustpan-like apparatus for collecting objects 68 into the first bin 192.

The same features and functionalities are replicated respectively for the second bin 194 and the third bin 196 and all of their respective parts.

The bins 192, 194, 196, bin lids 198, 200, 202, stand 204, and any of the connecting sides or parts can be made from a variety of materials and sizes and with a variety of shapes and connectors to allow the scooping function to occur.

For example, instead of dividing a cuboctahedron to create three bins, one can divide a Rhombic Dodecahedron or a Truncated octahedron to create multiple bins. Different numbers of bins and different shapes can be implemented as well.

A variety of connecting apparatus such as, but not limited to, a lever, wheel, foot pedal, etc. can be used to minimize the need for a user bending to open and close the lids and maneuver the system 18.

A conventional lip 184 made of rubber, silicone, or a variety of other materials is at the top front end of the bin lid 198. When the bin lid 198 is in the position touching the floor as seen in FIGS. 11A, 11B, 11G, 11J, and 11M, the lip 184 is on the top surface of the lid 198 and no gap exists between the lid 198 and the ground, or any other surface unto which the system 18 is placed. The lip 184 is typical in design to a conventional dustpan rubber lip. The lip 184 may be affixed permanently to the lid 198 or it may be replaceable when necessary. The stand 204, base 206, bin lids 198, 200, 202, and bins 192, 194, 196 can be made out of a variety of materials, including but not limited to plastic, wood, and metal.

The stand 204 and bins 192, 194, 196 may be separable from each other so that each bin may be replaced with another bin, for compact storage, for cleaning and for emptying contents. Alternatively, the bins may be permanently connected to the stand 204. Optionally, bin lids 198, 200, 202 may be separated from the bin openings 210, 212, 214 so as to allow easier access to the objects within the bins. The stand's triangular base 206 may optionally have wheels (not shown) on the bottom to allow a user to more easily maneuver the system 18. Optionally, the stand's triangular base 206 can be a variety of other shapes. It's possible for the triangular stand 204 to extend around the outer front facing side of each bin so as to cradle each bin and to have a dustpan-like apparatus connect to this outer side of the stand using a conventional hinge. This would allow each bin to have its own lid, that would connect to the bin using a conventional hinge on the inner back edge of the bin opening 210, 212, 214. This would allow for the bin 192, 194, 196 to not use its lid 198, 200, 202 as a dustpan, but rather use the dustpan that's connected to the stand 204 to collect objects 68 from the ground. This embodiment of the system 18, shown in FIG. 11P, would be especially useful for janitors wanting to collect various types of refuse, including recyclables into various compartments. Optionally, a vertical handle or pole may simply be attached to the triangular stand 204 and conventional rotating wheels or casters could be added to the bottom of the triangular base 206 to enable a janitor to maneuver this invention to various locations and positions for sorting and collecting various types of refuse into the desired bins.

FIGS. 11E and 11F show an elevated side view of this embodiment in which the first bin 192 is closed with the bin's lid 198 closed over the opening 210 of the bin 192. In FIGS. 11C and 11D, a user opens the bin 192 by pulling down the bin's lid 198 towards the front of the bin 192 either manually or using a connected apparatus such as a conventional lever, wheel, foot pedal, etc. (not shown). The user pulls down the bin's lid 198 towards themselves if they are standing in front of the bin 192 or to the right of themselves if they are standing on the right side of the bin 192.

In a method of operation/use, at step 1, as shown in FIGS. 11A and 11B, the bin's lid 198 is flipped over and the lip 184 is touching the ground or bottom surface. The user or possible automated device uses a broom 88 or other collection mechanism to sweep, gather, or collect a desired category of objects such as toys, toy parts, and other objects and debris 68 into the bin's lid 198.

At step 2, once the user has completed collecting all of the relevant objects into the bin's lid 198, the user brings the system 18 into the position shown in FIG. 11C to 11D by lifting the bin lid 198 either manually or using a connected apparatus such as, but not limited to, a lever, wheel, foot pedal, etc. and flips the bin lid 198 over the bin's opening 210. As the bin's lid 198 is lifted up, the objects inside of it are deposited into its respective bin 192.

At step 3, in FIG. 11E to 11F, the bin's lid 198 transforms from a dustpan-like apparatus to a bin's lid 198 for the first bin 192. In this orientation, the bin's lid 198 can click or lock into place over the first bin 192 using a variety of conventional child-proof locking mechanisms (not shown) implemented using a variety of options including magnetic child-proof locks, latch locks, etc. to prevent children from flipping open the bin lid 198 when it is desired that the bin remain inaccessible to the child. Also, conventional magnet connectors can be used on the sides of the bin lid 198, as well as the bin opening 210 and the bin 192 to keep the respective lid held in place.

The dustpan-like shape of the bin lid 198, serves to minimize objects 68 from falling out as the bin lid 198 is lifted towards the bin opening 210.

If the user desires to sweep or otherwise collect more objects 68 into the first bin 192, they can repeat steps 1-2. Steps 1-3 can be repeated to deposit objects 68 into the second bin 194 and third bin 196 as well.

Multiple copies of this cuboctahedron embodiment can be packed tightly together. The cuboctahedron is a type of space-filling polyhedron, which means it can tessellate 3-dimensional space without leaving any gaps. This tessellation is known as a "face-centered cubic" (FCC) packing or a "cuboctahedral honeycomb."

FIGS. 12A-12J provide an enhanced view of side and perspective views of an alternate embodiment of the system 18 configured for use with a trash bin 220. This embodiment integrates a custom-designed lid 218 and a supportive stand 222, enhancing its functionality for collecting, sorting, and disposing of refuse 224.

FIG. 12A depicts an attachment mechanism 226 that secures a custom-sized lid 218 to the trash bin 220. The attachment mechanism 226 is designed to accommodate a variety of trash bin sizes and shapes, providing versatility in application. The lid 218 is pivotally connected to the bin 220 via a hinge 228 located at the top edge of the bin opening 230. This hinge 228 allows the lid 218 to rotate between open, closed, and intermediate positions, facilitating object collection and secure containment within the bin 220.

FIGS. 12A-12D illustrate the operation of the lid 218 in open, intermediate, and closed positions. In the open position shown in FIG. 12A, the lid 218 serves as a collection interface, acting as a dustpan-like surface to facilitate sweeping or funneling objects into the bin opening 230 from the ground 236 or other surface. In the intermediate positions shown in FIGS. 12B and 12C, the lid 218 can be partially lifted to deposit objects collected on its surface into the bin 220. In the closed position shown in FIG. 12D, the lid 218 fully covers the bin opening 230, preventing the escape of contents and providing a clean, enclosed appearance.

Figure 12C:
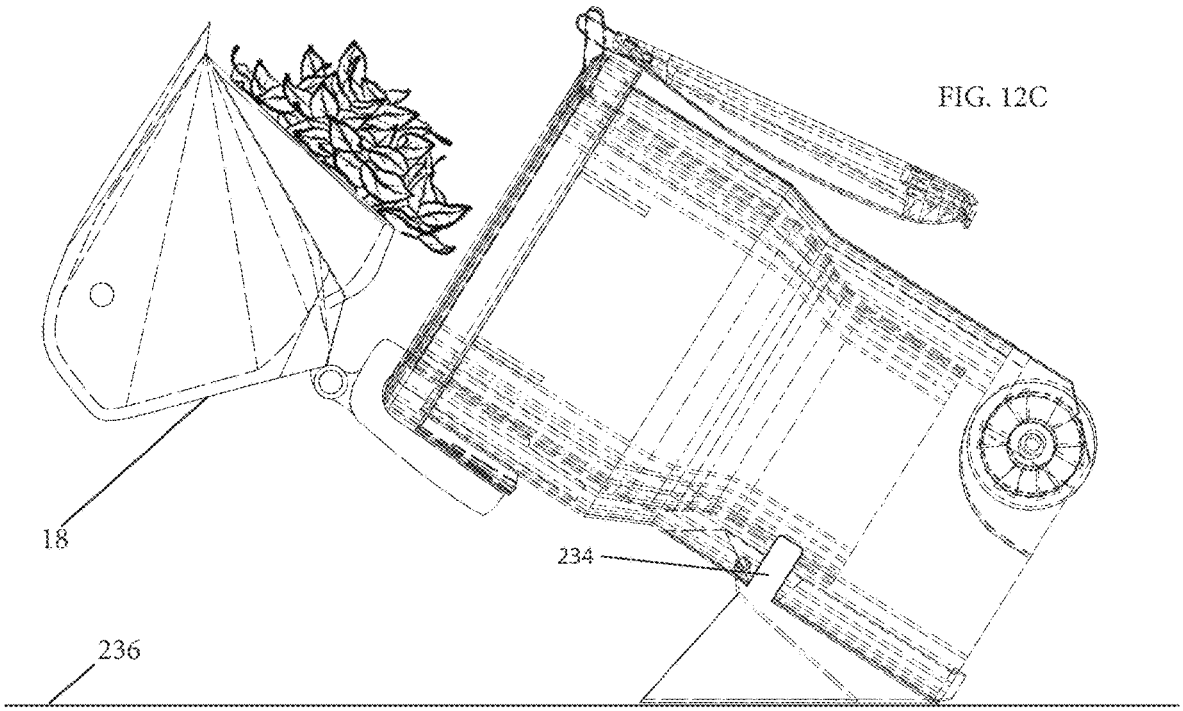
Figure 12D:
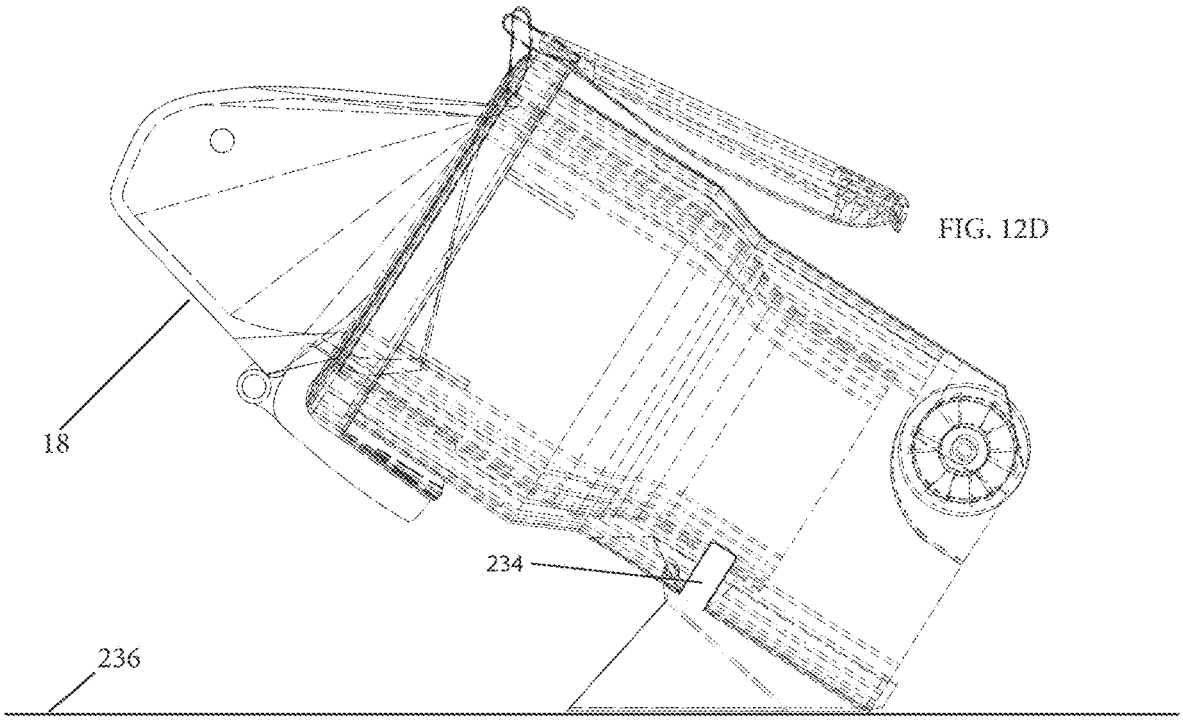
Figure 12E:
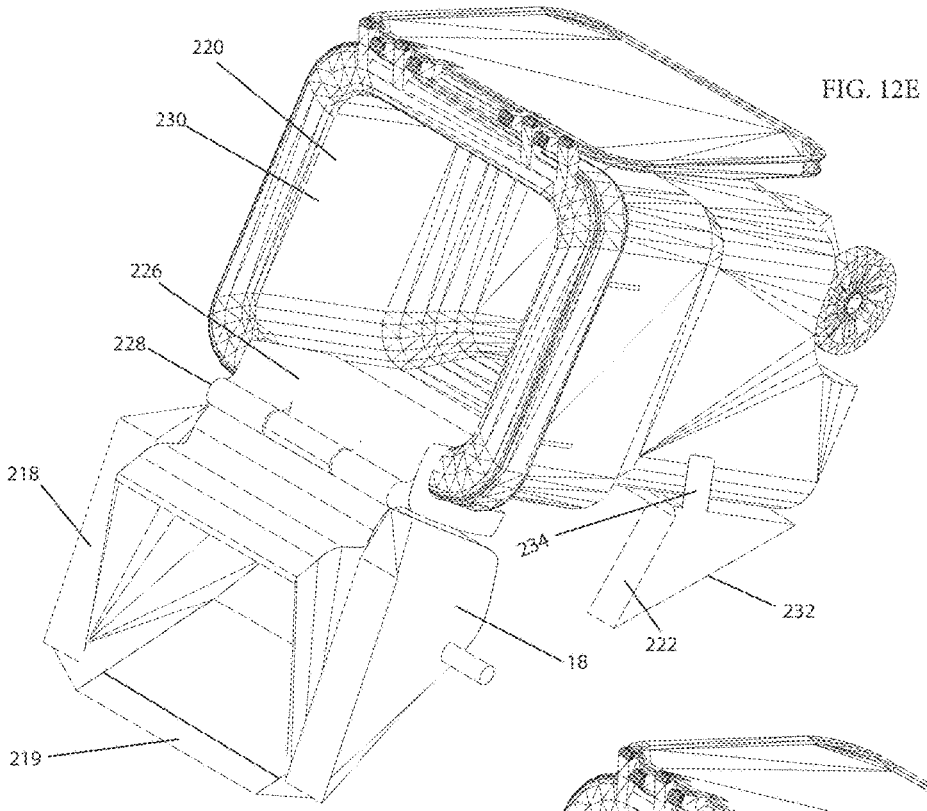
Figure 12F:
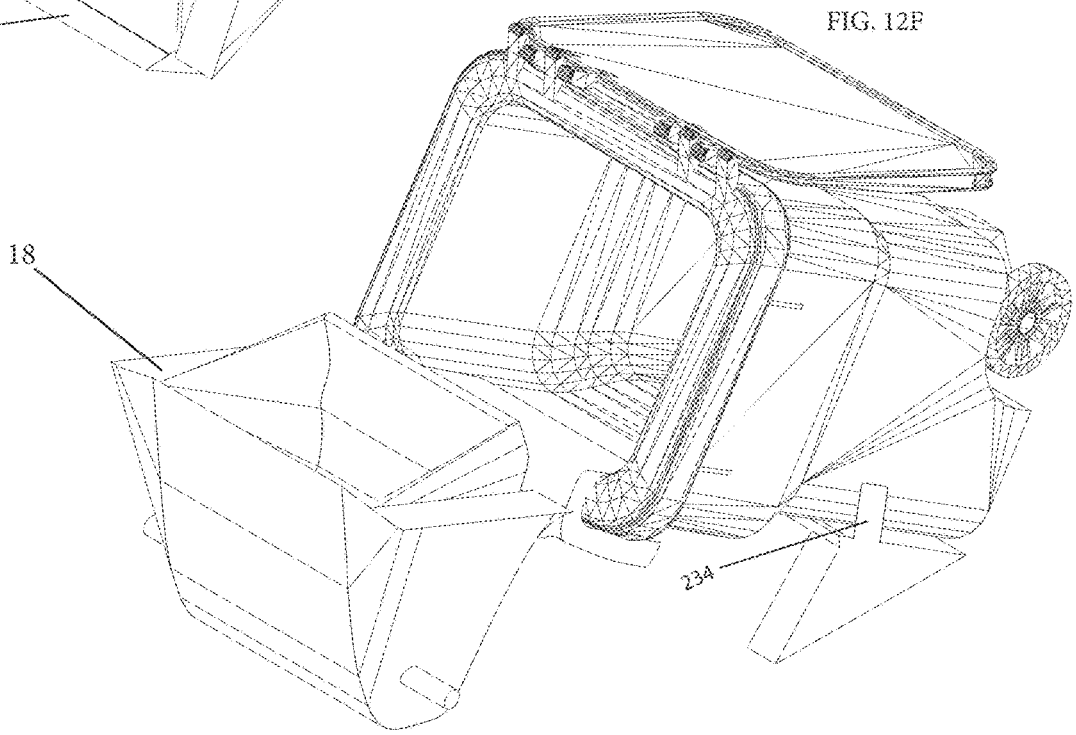
Figure 12G:
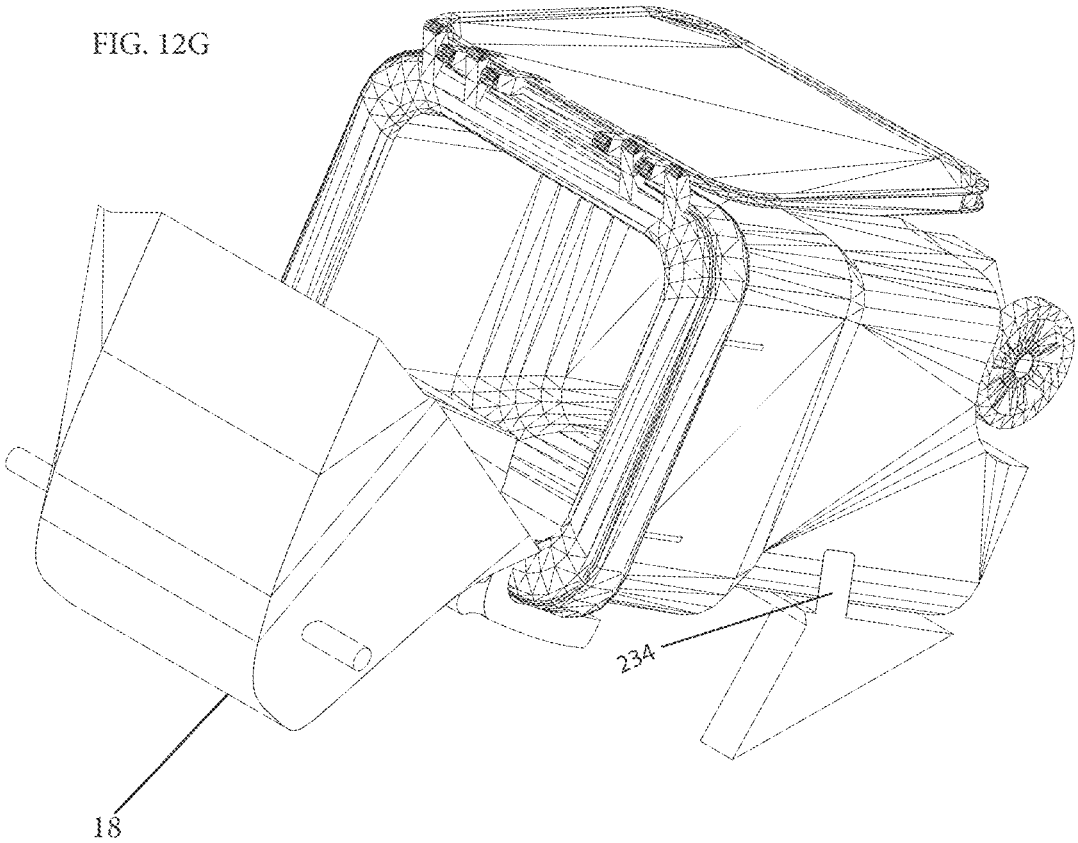

FIGS. 12E-12G demonstrate perspective front views of the system 18, highlighting the stand 222 that supports the trash bin 220 at a tilted angle. The stand 222 is configured with a stable base 232 and angled support arms 234 that hold the bin 220 in a stable, forward-tilted orientation. This tilt enhances ergonomic access, allowing users to sweep objects into the lid 218 with minimal physical strain. The stand 222 may be equipped with optional mobility aids, such as wheels, handles, or adjustable height mechanisms, to further improve usability in various environments.

The custom-sized lid 218 is designed with a broad, flat surface and a front lip 219, which acts as a sweeping edge. The lip 219 is made of durable, flexible material such as rubber or silicone to ensure a tight seal when the lid 218 is closed and to optimize its function as a dustpan-like interface during object collection. The lid 218 is optionally detachable, allowing for easy cleaning, replacement, or use with other compatible trash bins.

The attachment mechanism 226 of the lid 218 is customizable and may include adjustable clamps, brackets, or other securing elements to ensure compatibility with bins of varying dimensions. This feature supports retrofitting onto existing trash bins, expanding the scope of potential applications. It also includes the production of a custom trash bin to fit the lid 218 and attachment mechanism 226.

The stand 222 is designed to stabilize the bin 220 during operation, preventing tipping or unintended movement. The angled configuration of the stand 222 ensures that objects swept onto the lid 218 naturally fall into the bin 220 when the lid 218 is rotated upward.

Figure 12H:
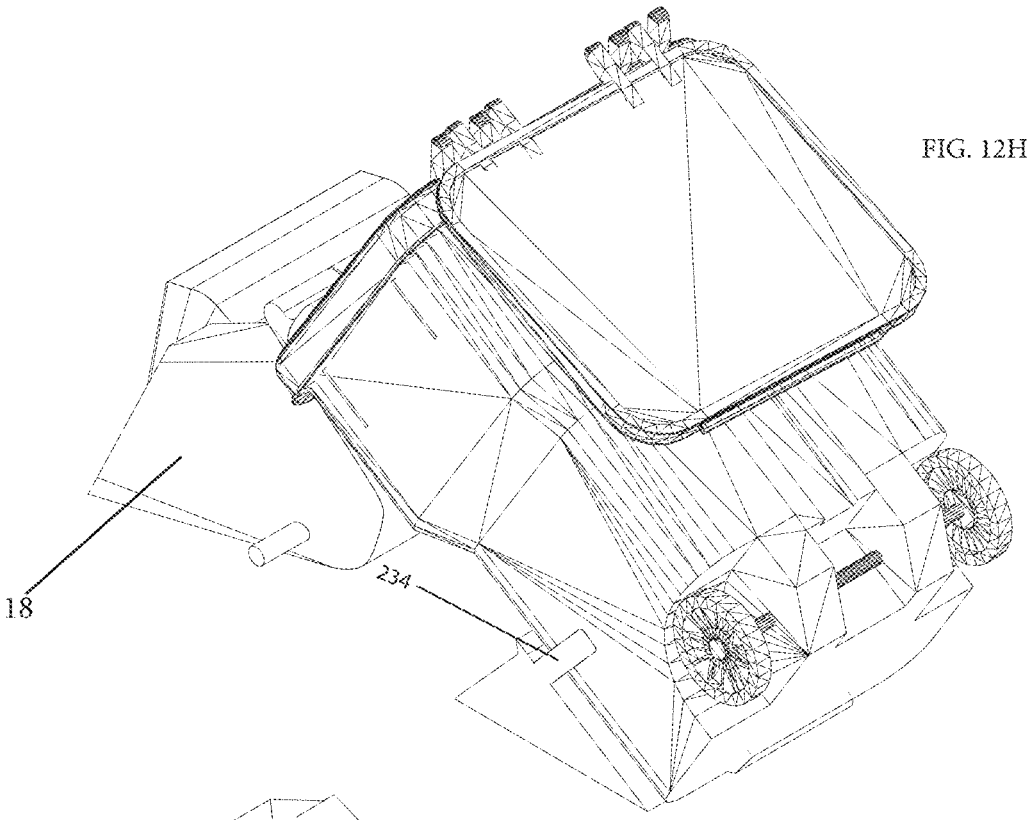
Figure 12I:
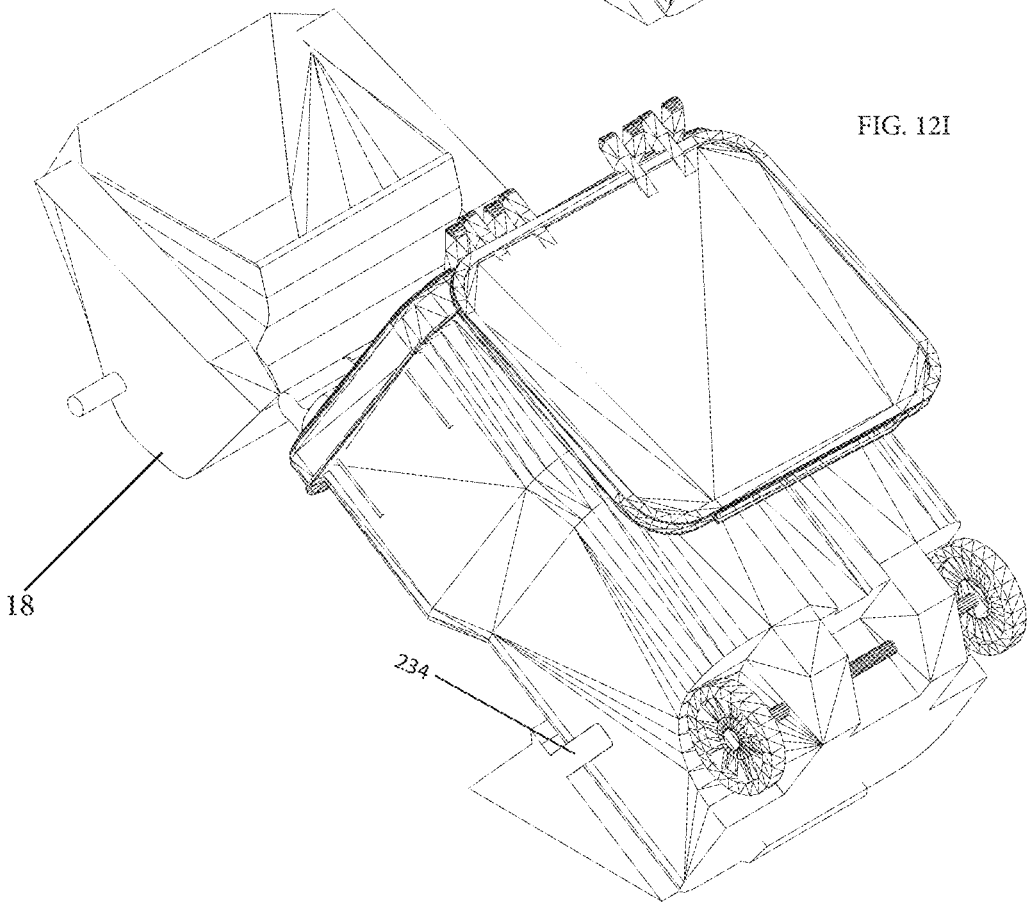
Figure 12J:
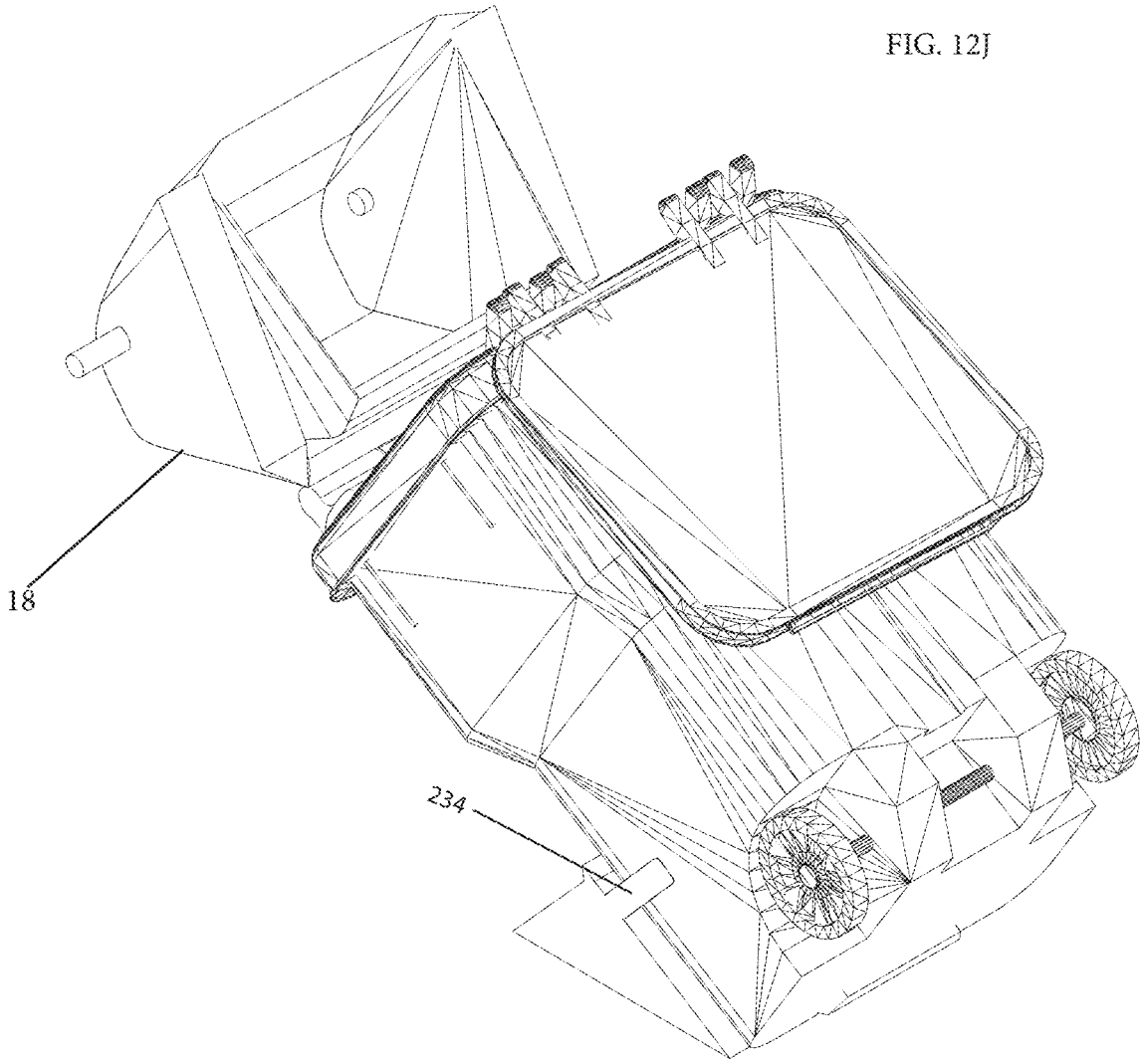

FIGS. 12H-12J demonstrate perspective back views of the system 18 in various operational states, emphasizing its adaptability for both residential and commercial environments. The embodiment is particularly useful for janitorial applications, where the dustpan-like lid 218 allows for efficient sorting and collection of refuse, recyclables, or compostables into separate bins 220. This embodiment can be customized to fit a variety of container types and sizes.

This embodiment may include additional optional features, such as integrated handles on the bin 220 for ease of transport, a locking mechanism to secure the lid 218 in the closed position, and color-coded components for distinguishing between bins 220 designated for different types of waste.

The design of the system 18 prioritizes durability and case of use, with materials chosen to withstand frequent handling and exposure to various environments. The modular nature of the lid 218, bin 220, and stand 222 allows for replacement or upgrading of individual components, ensuring long-term usability and versatility across multiple settings.

The modular collection, sorting, and storage system 18 is meticulously engineered to support a vast array of organizational needs across multiple sectors, including residential, educational, commercial, public, industrial, agricultural, medical, food service, and waste management. The system 18 comprises removable, reconfigurable bins that can accommodate a wide range of items, such as toys, recyclables, compostables, waste materials, tools, and sensitive materials like medical or hazardous waste. Bins are adaptable to a variety of configurations—circular, linear, stacked, tilted or side-by-side—allowing for optimized space utilization tailored to specific user environments. This adaptability makes the system 18 highly customizable across diverse applications.

General Design and Functionality

At the core of this system 18 is a multi-functional collection mechanism engineered for versatility and adaptability in various applications. The collection mechanism serves several roles, including: functioning as a dual-purpose dustpan, funnel, or scoop that facilitates efficient collection and sorting of items and can also transform into a secure lid to enclose contents within the bin once collection is complete, and acting as a deposit-only interface where items are directed into the bin, without necessarily functioning as a lid thereafter.

An alternate configuration includes a bin designed with a slightly tilted forward position, allowing items to be swept or directed directly into the bin's opening. Upon completing the collection process, the bin can be tilted back to a standard position, with or without the involvement of a collection mechanism. In one embodiment, the collection mechanism remains stationary or is manually or automatically lowered to the ground using a conveyor, track, or similar mechanism to facilitate the sweeping or gathering of items into the collection mechanism. The conveyor or lifting mechanism may then raise the collection mechanism to a position above the bin opening, where the collection mechanism deposits the items into the bin by flipping, tilting, or other controlled maneuvering. Alternatively, the bin itself may tilt back to a standard position, with the collection mechanism remaining stationary or playing no role in the deposit process. This configuration provides flexibility for various operational methods, enabling efficient collection and deposit of items into the bin while protecting against potential design modifications by competitors seeking to achieve similar results through alternative mechanisms.

The collection mechanism may be permanently affixed to the bin itself, be integrated within a larger housing structure, and/or operate as part of a detachable bin unit, allowing the entire bin and collection mechanism to function independently in a standalone configuration.

The attachment mechanism of the system 18 is designed to accommodate various bin types, including standard residential bins (often color-coded for specific waste streams like recycling, compostables, and general waste) and commercial-grade metal dumpsters or receptacles commonly positioned outside businesses. This attachment mechanism is customizable in size and configuration to fit securely on bins of varying dimensions, offering universal compatibility. Attachment options include adjustable clamps, interchangeable connectors, and fasteners that enable the collection mechanism to attach securely to bins of different sizes and shapes, enhancing the system's 18 adaptability across multiple environments.

Modular and Standalone Configurations

The bins are modularly designed to operate as either standalone units or as part of a larger, interconnected sorting system 18. This modular flexibility enables the bins to function independently for smaller sorting tasks or to be arranged in larger configurations—such as circular, linear, stacked, tilted, or side-by-side—providing comprehensive sorting solutions in residential, commercial, industrial, and public settings. This modular capability enhances the system's 18 versatility, allowing users to customize configurations based on the needs of specific environments.

Securement and Tilting Mechanism

To further improve functionality, the system 18 may include an integrated securement and tilting mechanism that stabilizes the bin during use while providing optional tilting capabilities to enhance user accessibility and operational efficiency. The securement feature prevents unintended movement or displacement, ensuring that the bin remains fixed in place during the collection, sorting, and storage processes.

The tilting mechanism is designed to pivot or incline the bin at controlled angles, which facilitates user access and optimizes ergonomic comfort for collection and sorting tasks. This feature can be particularly beneficial in high-traffic or high-volume collection settings. The tilting and securement mechanism may include adjustable clamps, brackets, pivot points, and lockable hinges, enabling users to engage or disengage the tilt function as needed. This mechanism is versatile and can be customized to accommodate both durable commercial-grade bins and lighter residential bins, supporting a variety of orientations that enhance the bin's usability across different environmental conditions and use cases.

Tilting Integrated Design

To further enhance usability, the bin and collection mechanism can be designed as a single unit with a slightly tilted, forward-facing opening. In this configuration, users can sweep items directly into the bin's opening. Once items are collected, the unit can either be tilted back to a closed position, with the collection mechanism acting as a lid, or remain open, depending on the storage needs. This tilting functionality enhances ergonomic handling and minimizes physical strain, allowing users—especially children—to engage in cleanup tasks with ease.

Applications in Various Settings

The modular collection, sorting, and storage system 18 is specifically engineered to support diverse applications across residential, educational, commercial, public, industrial, pharmaceutical, agricultural, food service, and waste management environments. Its highly adaptable design enables efficient collection, sorting, and secure storage of a wide array of items, such as toys, recyclables, compostables, hazardous materials, organic waste, and general refuse. Key features—such as customizable attachment mechanisms, securement and tilting options, compatibility with multiple bin types, and furniture integration-enhance the system's 18 usability across different settings.

Residential and Educational Environments:

In homes, schools, and other educational facilities, the system 18 provides an efficient solution for organizing toys, educational materials, and household items. The collection mechanism allows items to be gathered directly into it, acting as a funnel or dustpan before transferring items into the bin, which promotes organized play and cleanup.

In one configuration, the collection mechanism can transform into a secure lid that encloses the bin once collection is complete, securing items within. Alternatively, the collection mechanism may function solely to deposit items into the bin without necessarily acting as a lid. This flexibility allows the system 18 to adapt to various storage and organizational needs while providing retrofit options for existing bins.

The collection mechanism may be directly integrated with a dedicated bin or housing unit designed for toy collection and sorting. For added adaptability, the system 18 also includes retrofit options, enabling the collection mechanism to be attached to existing toy bins or standard residential storage bins using hinges or secure clamps.

Child-friendly features, such as childproof locks, ergonomic handles, levers, low-height access points, and labeled partitions (to promote sorting by characteristics like color or type), enhance safety, ease of use, and interactivity, encouraging children to actively participate in organization tasks. The collection mechanism can also act as a dustpan, making it easy for children to sweep toys or other items directly into the bin, thereby cultivating organized habits.

Commercial and Retail Environments

In commercial and retail environments, the system 18 is designed to securely attach to commercial-grade dumpsters and metal waste bins. The customizable attachment mechanism ensures compatibility with various commercial bin sizes and shapes, while the securement feature holds the bin stable during use. An optional tilting mechanism allows the bin to incline at controlled angles, providing ergonomic access and facilitating efficient waste collection and sorting, particularly in high-traffic retail settings where waste management efficiency is paramount.

Janitorial and Public Space Management

For janitorial and public space applications, the system 18 enables multi-bin sorting at the point of collection, reducing redundant handling and improving workflow. The collection interface can be configured as a standing sorting dustpan, allowing for direct waste collection without secondary sorting. Bins can be arranged in a variety of configurations, including circular and stacked layouts, enabling janitors to sort recyclables, compostables, and general waste as they move through spaces like parks, schools, and industrial sites. The bins are durable and can withstand heavy-duty use, suitable for high-traffic or public environments.

Food and Waste Management Applications

In food service, waste management, and recycling applications, the system's 18 compatibility with bins of varying sizes and customizable attachment mechanisms ensure it meets specific operational requirements. In high-waste environments like cafeterias and restaurants, the securement mechanism holds the collection interface firmly in place, even under high waste volumes. The tilting feature enables controlled bin inclination, improving ergonomic comfort and operational efficiency during waste disposal and recycling tasks.

Furniture Integration

The system 18 can also be embedded within furniture items, such as tables, shelves, cabinets, ottomans, and similar storage furnishings, to provide discreet, accessible storage in residential and retail spaces. By embedding bins into furniture, the system 18 optimizes spatial utilization and allows for organized storage solutions in environments where unobtrusive storage is beneficial, such as homes, offices, and retail spaces.

Industrial and Agricultural Settings:

The system 18 can be constructed from high-durability, impact-resistant materials to handle large volumes of debris, organic waste, and agricultural by-products. The system 18 can be compatible with robotic/automated systems, such as robotic arms and AI-driven sorting modules, to manage high-volume workflows efficiently. Additionally, the collection interface is adaptable for attachment to larger bins or containers, both residential and industrial, enabling collection directly from work surfaces or fields.

System Components and Ergonomic Features:

Collection Interface

Serves as a dual-purpose dustpan or funnel that transitions seamlessly into a secure lid. The collection interface may attach to the bin using hinge mechanisms, be permanently affixed, or be designed for easy detachment, depending on the application. Additionally, it may attach to standard waste bins, providing retrofitting options across residential, commercial, and public waste systems.

Modular Bins with Partitioning Options

Each bin may include one or more adjustable partitions, enabling the sorting of objects by characteristics such as color, size, type, material, or other distinguishing attributes. These partitions may be configured to divide the bin into multiple compartments, each corresponding to specific categories for organized collection and storage. The collection mechanism may also include integrated partitions or be configured as multiple separate collection mechanisms, each corresponding to the compartments created by the bin partitions. This allows objects to be sorted directly during the collection process, before being deposited into the appropriate compartments. Such configurations are particularly advantageous in environments requiring precise categorization, such as households, schools, recycling centers, industrial facilities, medical facilities, or any application where multi-category sorting is necessary. This partitioning system may be implemented with static or adjustable partitions and may include mechanisms to guide or direct objects into the appropriate compartments, such as funnels, chutes, or conveyor systems, further enhancing the sorting and collection process.

Housing Structure

In configurations where multiple bins are used, a shared housing structure can support the bins and the collection interface, providing a unified system for large-scale sorting.

Ergonomic Enhancements

May include wheels, handles, and foot pedals to reduce user strain, ideal for janitorial and high-traffic environments.

Automation and Technological Compatibility:

The system 18 is compatible with automation and robotics, making it suitable for high-traffic and industrial applications. It accommodates robotic arms, AI modules, and sensor-based sorting systems capable of autonomously identifying, collecting, and sorting objects by characteristics such as weight, size, or material type. This design further supports future adaptability for humanoid robots, ensuring ongoing versatility as automation technology advances. This flexibility allows for efficient sorting and collection in varied settings, including airports, public parks, and schools.

Sustainability and Future-Proof Design:

The system 18 may be constructed from sustainable materials with modular adaptability, supporting current and emerging applications. Available in manual, semi-automated, or fully automated configurations to meet diverse needs.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

I claim:

1. A method of using a modular collection system, the modular collection system comprising a plurality of removable, reconfigurable, or permanently affixed bins; and a collection interface; wherein at least one bin of the bins is configured to function with the collection interface, the collection interface is configured to allow for collection and deposit of items into the at least one bin; and sorting of the items during collection, after collection, or at a subsequent stage, the method steps comprising:

(a) configuring the collection interface for collection by placing the collection interface in a floor-facing position in direct contact with a floor;

(b) collecting the items by placing, sweeping or sliding the items from or along the floor into the collection interface;

(c) securing the items within the at least one bin using the collection interface as a lid by placing the collection interface in a closed position covering an opening of the at least one bin; and (d) optionally sorting of the items during collection, after collection, or at a subsequent stage;

wherein the collection interface is pivotably attached to the at least one bin during each of steps (a)-(c) and pivotably movable between steps (a)-(c) with the bins in a generally upright position;

wherein the system facilitates material collection and bin closure with fewer user actions and reduced ergonomic effort, permitting intuitive user manipulation of the collection interface to perform both collection and securement in fewer steps, thereby reducing physical strain and operational complexity compared to prior systems.

2. The method of claim 1, wherein the collection interface includes a dustpan-like structure pivotably attached to the at least one bin and movable between the floor-facing position for direct material collection and the closed position covering the opening of the at least one bin, the method further comprising:

collecting the items by sweeping or placing the items into the dustpan-like structure while it is in the floor-facing position; and transitioning the dustpan-like structure from the floor-facing position to the closed position, without detaching the dustpan-like structure from the at least one bin, thereby depositing the collected items into the at least one bin and enclosing the opening.

* * * * *